United States Patent [19]

Kaneko et al.

[11] Patent Number: 4,973,546

[45] **Date of Patent: * Nov. 27, 1990**

[54] LIGHT-SENSITIVE SILVER HALIDE PHOTOGRAPHIC MATERIAL IMPROVED IN STABILITY OF DYE IMAGE

[75] Inventors: Yutaka Kaneko, Sagamihara; Kenzi Kadokura, Hachioji, both of Japan

[73] Assignee: Konishiroku Photo Industry Co., Ltd., Tokyo, Japan

[ * ] Notice: The portion of the term of this patent subsequent to Mar. 21, 2006 has been disclaimed.

[21] Appl. No.: 224,242

[22] Filed: Jul. 26, 1988

Related U.S. Application Data

[63] Continuation of Ser. No. 41,237, Apr. 22, 1987, abandoned.

[30] Foreign Application Priority Data

Apr. 23, 1986 [JP] Japan ..... 61-95172

[51] Int. Cl.[5] ..... G03C 1/34; G03C 7/38

[52] U.S. Cl. ..... 430/551; 430/558; 430/613; 430/614

[58] Field of Search ..... 430/551, 558, 614, 613

[56] References Cited

U.S. PATENT DOCUMENTS 4,795,696 1/1989 Sasaki et al. ..... 430/512

4,814,262 3/1989 Sugita et al. ..... 430/551

*Primary Examiner*—Paul R. Michl

*Assistant Examiner*—Lee C. Wright

*Attorney, Agent, or Firm*—Finnegan, Henderson, Farabow, Garrett and Dunner

[57] ABSTRACT

A light-sensitive silver halide photographic material comprising a magenta coupler represented by the formula I:

I at least one magenta image stabilizer represented by formula XII:

XII at least one magenta dye image stabilizer selected from a group consisting of a compound represented by general formulas XIIIa and XIIIb:

XIIIa

XIIIb

12 Claims, No Drawings

LIGHT-SENSITIVE SILVER HALIDE PHOTOGRAPHIC MATERIAL IMPROVED IN STABILITY OF DYE IMAGE

This application is a continuation of application Ser. No. 041,237, filed Apr. 22, 1987, now abandoned.

FIELD OF THE INVENTION

The present invention relates to a light-sensitive silver halide color photographic material. More particularly, it relates to a light-sensitive silver halide color photographic material giving stable dye images against heat or light, and also having prevented stain from being generated.

It has been well known that dye images are produced by subjecting a light-sensitive silver halide color photographic material to imagewise exposure to effect color development, whereby an oxidized product of an aromatic primary amine type color developing agent couples with a coupler to form dyes including, for example, indophenol, indoaniline, indamine, azomethine, phenoxazine, phenazine and other dyes similar to these. In such a photographic system, generally employed is a color reproduction system utilizing the subtractive color process, in which used is a color photographic material comprising blue-sensitive, green-sensitive and red-sensitive silver halide emulsion layers containing couplers each having the relationship of complementary color, namely, couplers which color-develop in yellow, magenta and cyan, respectively.

The coupler used for the formation of yellow color images includes, for example acetoanilide type couplers, and, as the coupler for the formation of magenta color images, for example, pyrazolone, pyrazolobenzimidazole, pyrazolotriazole or indazolone type couplers are known, and further, as the coupler for the formation of cyan color images, for example, phenol or naphthol type couplers are generally used.

The dye images thus obtained are desired not to undergo any color change or color-fading even when exposed to light for a long period of time or preserved under the conditions of high temperature and high humidity. Also desired are those in which non-image portions of a color photographic material (hereinafter called "color photographic material") may not yellow by light, moisture or heat (hereinafter referred to as "Y-stain").

However, in the case of magenta couplers, Y-stain by light, at a non-image portion and color-fading by light, at a dye image portion are very largely caused as compared with those in the case of yellow couplers or cyan couplers, to often raise problems.

The coupler widely used for the formation of magenta dye includes 5-pyrazolone type couplers. It has been a serious problem that the magenta couplers of 5-pyrazolone type have a secondary absorption at the vicinity of 430 nm in addition to a primary absorption at the vicinity of 550 nm, and therefore various studies have been made to solve such a problem.

A magenta coupler having an anilino group at the 3-position of the 1,2-pyrazol-5-on type coupler, which is small in the above-mentioned secondary absorption, is useful for obtaining, in particular, a color image for printing. This art is disclosed, for example, in U.S. Pat. No. 2,343,703, British Patent No. 1,059,994, etc.

However, the above magenta couplers have a disadvantage that they are extremely poor in the image stability, in particular, the fastness to light of dye images, to suffer from Y-stain at a non-image portion.

As a means for decreasing the secondary absorption at the vicinity of 430 nm of the above magenta coupler, there have been proposed magenta couplers including, for example, pyrazolobenzimidazoles disclosed in British Patent No. 1,047,612; indazolones disclosed in U.S. Pat. No. 3,770,447, and 1H-pyrazolor[5,1-c]-1,2,4-triazole type couplers disclosed in U.S. Pat. No. 3,725,067, British Patents No. 1,252,418 and No. 1,334,515; 1H-pyrazolor[1,5-b]-1,2,4-trizaole type couplers disclosed in Japanese Patent Publication Open to Public Inspection (herein after called Japanese Patent O.P.I. Publication) No. 171956/1984 and Research Disclosure No. 24531; 1H-pyrazolo[1,5-c]-1,2,3-triazole type couplers disclosed in Research Disclosure No. 24626; 1H-imidazo[1,2-b]pyrazole type couplers disclosed in Japanese Patent O.P.I. Publication No. 162548/1984 and Research Disclosure No. 24531; 1H-pyrazolo[1,5-b]pyrazole type couplers disclosed in Japanese Patent O.P.I. Publication No. 43659/1985 and Research Disclosure No. 24230; and 1H-pyrazolo[1,5-d]tetrazole type couplers disclosed in Japanese Patent O.P.I. Publication No. 33552/1985 and Research Disclosure No. 24220. Of these, the dyes formed through 1H-pyrazolo[5,1-c]-1,2,4-triazole type couplers, 1H-pyrazolo[1,5-b]-1,2,4-triazole type couplers, 1H-pyrazolo[1,5-c]-1,2,3-triazole type couplers, 1H-imidazo[1,2-b]pyrazole type couplers, 1H-pyrazolo[1,5-b]pyrazole type couplers, and 1H-pyrazolo[1,5-d]tetrazole type couplers show extremely smaller secondary absorption at the vicinity of 430 nm than the dyes formed through the above 5-pyrazolone type couplers having an anilino group at the 3position do, and thus, they are desirable from the viewpoint of the color reproducibility, and also they are advantageous in that they are desirably very little liable to generation of Y-stain at a non-image portion against light, heat and humidity.

However, in general, the azomethine dyes to be formed through the magenta couplers of pyrazolotriazole type have very low fastness to light to seriously damage the performances of a color photographic material, in particular, a color photographic material for print, and therefore have not put into practical use in color photographic materials for print.

Japanese Patent O.P.I. Publication No. 125732/1984 also proposes a technique for improving the fastness to light of a magenta dye image obtained from 1H-pyrazolo[5,1-c]-1,2,4-triazole type magenta coupler by using 1Hpyrazolo-[5,1-c]-1,2,4-triazole type magenta coupler in combination with a phenol type compound or a phenyl ether type compound. However, even the above technique can not be said to be sufficient for preventing the color-fading of the above magenta dye image against light, and, moreover, has been recognized to have almost no capability to prevent the color-fading by light.

SUMMARY OF THE INVENTION

The present invention has been made taking account of the above problems, and a first object of the present invention is to provide a light-sensitive silver halide photographic material having excellent color reproducibility, and moreover remarkably improved in the fastness to light of a magenta dye image.

A second object of the present invention is to provide a light-sensitive silver halide photographic material giving a magenta dye image suffering less change against light.

A third object of the present invention is to provide a light-sensitive silver halide photographic material having prevented the generation of Y-stain at a non-image portion.

The above objects of the present invention can be achieved by a light-sensitive silver halide photographic material characterized in that it contains at least one of the magenta couplers represented by General Formula (I) shown below, at least one of the compounds represented by General Formula (XII) shown below, and at least one selected from the compounds represented by General Formulas (XIIIa) and (XIIIb) shown below.

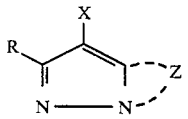

General Formula (I)

In the formula, Z represents a group of nonmetallic atoms necessary for the formation of a nitrogen-containing heterocyclic ring; said ring formed by Z may have a substituent.

X represents a hydrogen atom or a substituent eliminable through the reaction with an oxidized product of a color developing agent.

Also, R represents a hydrogen atom or a substituent.

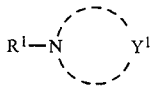

General Formula (XII)

In the formula, $R^1$ represents an aliphatic group, a cycloalkyl group or an aryl group; and $Y^1$ represents a group of nonmetallic atoms necessary for the formation of a morpholine ring or a thiomorpholine ring together with a nitrogen atom.

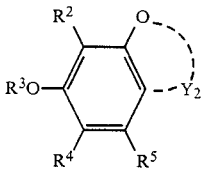

General Formula (XIIIa)

In the formula, $R^2$ and $R^5$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group, or an alkoxycarbonyl group; $R^3$ represents a hydrogen atom, an alkyl group, an alkenyl group, an aryl group, an acyl group, a cycloalkyl group or a heterocyclic group; and $R^4$ represents a hydrogen atom, a halogen atom, an alkyl group, an alkenyl group, an aryl group, an aryloxy group, an acyl group, an acyloxy group, a sulfonamide group, a cycloalkyl group or an alkoxycarbonyl group. $R^3$ and $R^4$ may be combined each other to form a 5or 6-membered ring. $R^3$ and $R^4$ may also be combined to form a methylenedioxy ring. $Y^2$ represents a group of atoms necessary for the formation of a chroman or coumaran ring.

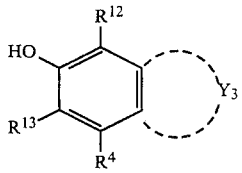

General Formula (XIIIb)

In the formula, $R^{12}$ and $R^{14}$ each represent a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group; and $R^{13}$ represents a hydrogen atom, a halogen atom, an alkyl group, an alkenyl group, a hydroxyl group, an aryl group, an acyl group, an acylamino group, an acyloxy group, a sulfonamide group, a cycloalkyl group or an alkoxycarbonyl group. $R^{13}$ and $R^{14}$ may be combined each other to form a 5- or 6-membered hydrocarbon ring.

$Y^3$ represents a group of atoms necessary for the formation of an indane ring.

DETAILED DESCRIPTION OF THE INVENTION

The present invention will be described below in detail.

In the magenta coupler according to the present invention, represented by General Formula (I);

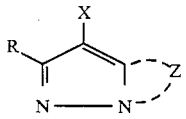

General Formula (I)

Z represents a group of nonmetallic atoms necessary for the formation of a nitrogen-containing heterocyclic ring; said ring formed by Z may have a substituent.

X represents a hydrogen atom or a substituent eliminable through the reaction with an oxidized product of a color developing agent.

And, R represents a hydrogen atom or a substituent. The substituent represented by the above R may include, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The halogen atom may include, for example, a chlorine atom and a bromine atom. Particularly preferred is a chlorine atom.

The alkyl group represented by R may preferably be those having 1 to 32 carbon atoms; the alkenyl group and the alkynyl group, each having 2 to 32 carbon atoms; the cycloalkyl group and the cycloalkenyl group, each having 3 to 12 carbon atoms, particularly 5 to 7 carbon atoms. The alkyl group, the alkenyl group and the alkynyl group each may be straight chain structure or branched structure.

Also, these alkyl group, alkenyl group, alkynyl group, cycloalkyl group and cycloalkenyl group each may have a substituent including, for example, an aryl, a cyano, a halogen atom, a heterocyclic ring, a cycloalkyl, a cycloalkenyl, a spiro compound residual group, a bridged hydrocarbon compound residual group, and besides these, those, which are substituted through a carbonyl group such as an acyl, a carboxyl, a carbamoyl, an alkoxycarbonyl and an aryloxycarbonyl, and those which are substituted through a hetero atom (specifically, those which are substituted through an oxygen atom such as a hydroxyl, an alkoxy, an aryloxy, a heterocyclic oxy, a siloxy, an acyloxy and a carbamoyloxy, those which are substituted through a nitrogen atom such as a nitro, an amino (including a dialkylamino, etc.), a sulfamoylamino, an alkoxycarbonylamino, an aryloxycarbonylamino, an acylamino, a sulfonamide, an imide and a ureido, those which are substituted through a sulfur atom such as an alkylthio, an arylthio, a heterocyclic thio, a sulfonyl, a sulfinyl and a sulfamoyl and those which are substituted through a phosphorus atom such as a phosphyl, etc).

More specifically, they include, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a tri-fluoromethyl group, a 1e-thoxytridecyl group, a 1-methoxyisopropyl group, an ethyl methanesulfonyl group, a methyl 2,4-di-t-amyulfenoxy group, an anilino group, a 1-phenylisopropyl group, a 3-m-butanesulfonaminophenoxypropyl group, a 3-4'-{α-[4''(p-hydroxybenzene sulfonyl)phenoxy]-dodecanoylamino}phenylpropyl group, a 3-{4'-[α-(2'',4''-di-t-amylphenoxy)butanamide]phenyl}propyl group, a 4-[α-(o-chlorophenoxy)tetradecanamidophnoxy]propyl group, an allyl group, a cyclopentyl group, a cylcohexyl group, etc.

The aryl group represented by R is preferably a phenyl group, and may have a substitutent (for example, an alkyl group, an alkoxy group, an acylamino group, etc.).

More specifically, it may include a phenyl group, a 4-t-butylphenyl group, a 2,4-di-t-amylphenyl group, a 4-tetradecanamidophenyl group, a hexadicyloxyphenyl group, a 4'-[α-(4''-t-butylphenoxy)tetradecanamido)-phenyl group, etc.

The heterocyclic group represented by R is preferably one having 5- to 7-members, which may be substituted or condensated. More specifically, it may include a 2-furyl group, a 2-thienyl group, a 2-pyrimidinyl group, a 2-benzothiazolyl group, etc.

The acyl group represented by R may include, for example, alkylcarbonyl groups such as an acetyl group, a phenyl acetyl group, a dodecanoyl group and an α-2,4-di-t-amylphenoxybutanoyl group; arylcarbonyl groups such as a benzoyl group, a 3pentadecyloxybenzoyl group and a p-chlorobenzoyl group; etc.

The sulfonyl group represented by R may include alkylsulfonyl groups such as a methylsulfonyl group and a dodecylsulfonyl group; arylsufonyl groups such as a benzenesulfonyl group and a p-toluene sulfonyl group; etc.

The sulfinyl group represented by R may include alkylsulfinyl groups such as an ethylsulfinyl group, an octylsulfinyl group and a 3-phenoxybutylsulfinyl group; arylsulfinyl groups such as a phenylsulfinyl group, a m-pentadecylphenylsulfinyl group; etc.

The phosphonyl group represented by R. may include alkylsulfonyl groups such as a butyloctylphosphonyl group, alkoxyphosphonyl groups such as an octyloxyphosphonyl group, aryloxyphosphonyl groups such as a phenoxyphosphonyl group, arylphosphonyl groups such as a phenylphosphonyl group, etc.

The carbamoyl group represented by R may be substituted with an alkyl group, an aryl group (preferably, a phenyl group), etc., and may include, for example, an N-methylcarbamoyl group, an N,N-dibutylcarbamoyl group, an N-(ethyl 2-pentadecyloctyl)carbamoyl group, an N-ethyl-N-dodecylcarbamoyl group, an N-{3-(2,4-di-t-amylphenyoxy)propyl}carbamoyl group, etc.

The sulfamoyl group represented by R may be substituted with an alkyl group, an aryl group (preferably a phenyl group), etc., and may include, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group, etc.

The spiro compound residual group represented by R may include, for example, spiro [3.3]heptan-1-yl, etc.

The bridged hydrocabon compound residual group may include, for example, bicyclo[2.2.1]heptan-1-yl, tricyclo[3.3.1.1$^{3,7}$]decan-1-yl, 7,7-dimethyl-dibicyclo[2.2.1]heptan-1-yl, etc.

The alkoxy group represented by R may be further substituted with those mentioned as the substituents for the above alkyl group, and may include, for example, a methoxy group, a propoxy group, a 2-ethoxyethoxy group, a pentadecyloxy group, a 2-dodecyloxyethoxy group, a phenethyloxyethoxy group, etc.

The aryloxy group represented by R is preferably a phenyloxy, wherein the aryl nucleus may be further substituted with those mentioned as the substituents for the above aryl group, and may include, for example, a phenoxy group, a p-t-butylpohenoxy group, a m-pentadecylphenoxy group, etc.

The heterocyclic oxy group represented by R is preferably one having 5- to 7-members, wherein the heterocyclic ring may further have a substituent, and may include, for example, a 3,4,5,6-tetrahydropyranyl-2-oxy group, a 1-phenyltetrazole-5-oxy group, etc.

The siloxy group represented by R may further be substituted with an alkyl group, etc., and may include, for example, a trimethylsiloxy group, a triethylsiloxy group, a dimethylbutylsiloxy group, etc.

The acyloxy group represented by R may include, for example, an alkylcarbonyloxy group, an arylcarbonyloxy group, etc., and may further have a substitutent to include, specifically, an acetyloxy group, an α-chloroacetyloxy group, a benzoyloxy group, etc.

The carbamoyloxy group represented by R may be substituted with an alkyl group, an aryl group, etc., and may include, for example, an N-ethylcarbamoyloxy group, an N,N-diethylcarbamoyloxy group, an N-phenylcarbamoyloxy group, etc.

The amino group represented by R may be substituted with an alkyl group, an aryl group (preferably, a phenyl group), and may include, for example, an ethylamino group, an anilino group, a m-chloroanilino group, a 3-pentadecyloxycarbonylanilino group, a 2-chloro-5-hexadecanamidoanilino group etc.

The acylamino group represented by R may include an alkylcarbonylamino group, an arylcarbonylamino group (preferably, a phenylcarbonylamino group), etc., and may further have a substituent to include, specifically, an acetoamide group, an α-ethylpropaneamide group, an N-phenylacetoamide group, a dodecanamide group, a 2,4-di-t-amylphenoxyacetoamide group, an α-3-t-butyl-4-hydroxyphenoxybutaneamide group, etc.

The sulfonamide group represented by R may include an alkylsulfonylamino group, an arylsulfonylamino group, and may further have a substituent. It specifically may include, a methylsulfonylamino group, a pentadecylsulfonylamino group, a benzenesulfonamide group, a p-toluensulfonamide, a 2-methoxy-5-t-amylbenzensulfonamide group etc.

The imide group represented by R may be of open chain structure or cyclic structure, or may have a substituent to include, for example, a succinimide group, a 3-heptadecylsuccinimide, a phthalimide group, a glutalimide group, etc.

The ureido group represented by R may be substituted with an alkyl group, an aryl group (preferably, a phenyl group), etc., and may include, for example, an N-ethylureido group, an N-ethyl-N-decylureido group, an N-phenylureido group, an N-p-tolylureido group, etc.

The sulfamoylamino group represented by R may be substituted with an alkyl group or an aryl group (preferably, a phenyl group), etc., and may include, for example, an N,N-dibutylsulfamoylamino group, an N-methylsulfamoylamino group, an N-phenylsulfamoylamino group, etc.

The alkoxycarbonylamino group represented by R may further have a substituent, and may include, for example, a methoxycarbonylamino group, a methoxyethoxycarbonylamino group, an octadecyloxycarbonylamino group, etc.

The aryloxycarbonylamino group represented by R may have a substituent, and may include, for example, a phenoxycarbonylamino group, a 4-methylphenoxycarbonylamino group, etc.

The alkoxycarbonyl group represented by R may further have a substituent, and may include, for example, a methoxycarbonyl group, a butyloxycarbonyl group, a dodecyloxycarbonyl group, an octadecyloxycarbonyl group, an ethoxymethoxycarbonyloxy group, a benzyloxycarbonyl group, etc.

The aryloxycarbonyl group represented by R may further have a substituent, and may include, for example, a phenoxycarbonyl group, a p-chlorophenoxycarbonyl group, an m-pentadecyloxyphenoxycarbonyl group, etc.

The alkylthio group represented by R may further have a substituent, and may include, for example, an ethylthio group, a dodecylthio group, an octadecylthio group, a phenethylthio group, a 3-phenoxypropylthio group, etc.

The arylthio group represented by R is preferably a phenylthio group which may further have a substituent, and may include, for example, a phenylthio group, a p-methoxyphenylthio group, a 2-t-octylphenylthio group, a 3-octadecylphenylthio group, a 2carboxyphenylthio group, a p-acetoaminophenylthio group, etc.

The heterocyclic thio group represented by R is preferably a heterocyclic thio group of 5 to 7 members, and may further have a condensed ring or may have a substituent. It may include, for example, a 2-pyridylthio group, a 2-benzothiazolylthio group, a 2,4-diphenoxy-1,3,5-triazole-6-thio group, etc.

The substituent represented by X, which is eliminable through the reaction with an oxidized product of a color developing agent, may include, for example, a halogen atom (such as a chlorine atom, a bromine atom and a fluorine atom), and also groups which are substituted through a carbon atom, an oxygen atom, a sulfur atom or a nitrogen atom.

The groups which are substituted through a carbon atom may include a carboxyl group, and also, for example, a group represented by the general formula:

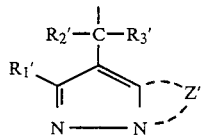

wherein R' is same as defined for the above R, Z' is same as defined for the above Z; and $R^{2'}$ and $R^{3'}$ each represent a hydrogen atom, an aryl group, an alkyl group or a heterocyclic group, a hydroxymethyl group and a triphenylmethyl group.

The groups which are substituted through an oxygen atom may include, for example, an alkoxy group, aryloxy group, heterocyclic oxy group, an acyloxy group, a sulfonyloxy group, an alkoxycarbonyloxy group, an aryloxycarbonyloxy group, an alkyloxaryloxy group, an alkoxyoxaryloxy group, etc.

The above alkoxy group may further have a substituent including, for example, an ethoxy group, a 2-phenoxyethoxy group, 2-cyanoethoxy group, a phenethyloxy group, a p-chlorobenzyloxy group, etc.

The above aryloxy group is preferably a phenoxy group, and the aryl group may further have a substituent. More specifically, it may include a phenoxy group, a 3-methylphenoxy group, a 3-dodecylphenoxy group, a 4-methanesulfonamidephenoxy group, a 4-[α-(3'-pentadecylphenoxy)butanamido]phenoxy group, a hexadecylcarbamoylmethoxy group, a 4-cyanophenoxy group, a 4-methanesulfonylphenoxy group, a 1-naphthyloxy group, a p-methoxyphenoxy group, etc.

The above heterocyclic oxy group is preferably a heterocyclic oxy group of 5 to 7 members, or may be of condensed ring, or may have a substituent. Specifically, it may include a 1-phenyltetrazolyloxy group, a 2-benzothiazolyloxy group, etc.

The above acyloxy group may include, for example, alkylcarbonyloxy groups such as an acetoxy group and butanoloxy group, and alkenylcarbonyloxy groups such as a cinnamoyloxy group, and arylcarbonyloxy groups such as a benzoyloxy group.

The above sulfonyloxy group may include, for example, a butanesulfonyloxy group and methanesulfonyloxy group.

The above alkoxycarbonyloxy group may include, for example, an ethoxycarbonyloxy group and a benzyloxycarbonyoxy group.

The above aryloxycarbonyloxy group may include a phenoxycarbonyloxy group, etc.

The above alkyloxalyloxy group may include, for example, a methyloxalyloxy group.

The above alkoxyoxalyloxy group may include an ethoxyoxalyloxy group, etc.

The group which is substituted through a sulfur atom may include, for example, an alkylthio group, an arylthio group, a heterocyclic thio group and an alkyloxythiocarbonylthio group.

The above alkylthio group may include a butylthio group, a 2-cyanoethylthio group, a phenethylthio group, a benzylthio group, etc.

The above arylthio group may include a phenylthio group, a 4-methanesulfonamidephenylthio group, a 4-dodecylphenethylthio group, a 4-nonafluoropentanamidephenythylthio group, a 4-carboxyphenylthio group, a 2-ethoxy-5-t-butylphenylthio group, etc.

The above heterocyclic thio group may include, for example, a 1-phenyl-1,2,3,4-tetrazolyl-5-thio group, a 2-benzothiazolylthio group, etc.

The above alkyloxythiocarbonylthio group may include a dodecyloxythiocarbonylthio group, etc.

The group which is substituted through a nitrogen atom may include, for example, a group represented by the general formula:

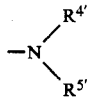

In this formula, $R^{4'}$ and $R^{5'}$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group, and $R^{4'}$ and $R^{5'}$ may be bonded to each other to form a heterocyclic ring, provided that $R^{4'}$ and $R^{5'}$ each are not a hydrogen atom at the same time.

The above alkyl group may be of straight chain or branched one, and is preferably one having 1 to 22 carbon atoms. Also, this alkyl group may have a substituent which may include, for example, an aryl group, an alkoxy group, an aryloxy group, an alkylthio group, an arylthio group, an alkylamino group, arylamino group, an acylamino group, a sulfonamide group, an imino group, an acyl group, an alkylsulfonyl group, an arylsulfonyl group, a carbamoyl group, a sulfamoyl group, an alkoxycarbonyl group, an alkyloxycarbonylamino group, an aryoxycarbonylamino group, a hydroxyl group, a carboxyl group, a cyano group and a halogen atom. The alkyl group may specifically include, for example, an ethyl group, an octyl group, a 2-ethylhexyl group and 2-chloroethyl group.

The aryl group represented by $R^{4'}$ or $R^{5'}$ is preferably one having 6 to 32 carbon atoms, in particular, a phenyl group and a naphtyl group, wherein the aryl group may have a substituent which may include those mentioned as the substituents for the alkyl group represented by the above $R^{4'}$ or $R^{5'}$. This aryl group may specifically include, for example, a phenyl group, a 1-naphthyl group and a 4-methylsulfonylphenyl group.

The heterocyclic group represented by $R^{4'}$ or $R^{5'}$ is preferably of 5 to 6 members, or may be of condensed ring, or may have a substituent. Specifically, it may include a 2-furyl group, a 2-quinolyl group, a 2-pyrimidyl group, a 2-benzothiazolyl group, a 2-pyridyl group, etc.

The sulfamoyl group represented by $R^{4'}$ or $R^{5'}$ may include an N-alkylsulfamoyl group, an N,N-dialkylsulfamoyl group, N-arylsulfamoyl group, an N,N-diarylsufamoyl group, etc., and the alkyl group and the aryl group of these may have the substituent mentioned for the above alkyl group and aryl group. The sulfamoyl group may specifically include, for example, an N,N-diehtylsulfamoyl group, an N-methylsulfamoyl group, N-dodecylsulfamoyl group and an N-p-tolysulfamoyl group.

The carbamoyl group represented by $R^{4'}$ or $R^{5'}$ may include an N-alkylcarbamoyl group, an N,N-dialkylcarbamoyl group, an N-arylcarbamoyl group, an N,N-diarylcarbamoyl group, etc., and the alkyl group and the aryl group of these may have the substituent mentioned for the above alkyl group and aryl group. The carbamoyl group may specifically include, for example, an N,N-diethylcarbamoyl group, an N-methylcarbamoyl group, an N-dodecylcarbamoyl group, N-p-cyanophenylcarbamoyl group and N-p-tolylcarbamoyl group.

The acyl group represented by $R^{4'}$ or $R^{5'}$ may include, for example, an alkylcarbonyl group, an arylcarbonyl group and a heterocyclic carbonyl group, and the alkyl group, the aryl group and the heterocyclic group each may have a substituent. The acyl group may specifically include, for example, a hexafluorobutanoyl group, 2,3,4,5,6-pentafluorobenzoyl group, an acety group, a benzoyl group, a naphthoel group, a 2-furylcarbonyl group, etc.

The sulfonyl group represented by $R^{4'}$ or $R^{5'}$ may include an alkylsulfonyl group, an arylsulfonyl group and a heterocyclic sulfonyl group, and may have a substituent. Specifically, it may include, for example, an ethanesulfonyl group, a benzenesulfonyl group, an octanesulfonyl group, a naphthalenesulfonyl group, a p-chlorobenzenesulfonyl group, etc.

The aryloxycarbonyl group represented by $R^{4'}$ or $R^{5'}$ may have as a substituent those mentioned for the above aryl group. Specifically, it may include a phenoxycarbonyl group, etc.

The alkoxycarbonyl group represented by $R^{4'}$ or $R^{5'}$ may have the substituent mentioned for the above alkyl group, and specifically may include a methoxycarbonyl group, a dodecyloxycarbonyl group, a benzyloxycarbonyl group, etc.

The heterocyclic ring to be formed by bonding of $R^{4'}$ and $R^{5'}$ is preferably of 5 to 6 members, and may be saturated or unsaturated, may be aromatic or non-aromatic, or may be of a condensed ring. This heterocyclic ring may include, for example, an N-phthalimide group, an N-succinimide group, a 4-N-urazolyl group, a 1-N-hydantoinyl group, 3-N-2,4-dioxooxazolydinyl group, a 2-N-1,1-dioxo-3-(2H)-oxo-1,2-benzthiazolyl group, a 1-pyrolyl group, a 1-pyrolidinyl group, a 1-pyrazolyl group, a 1-pyrazolydinyl group, a 1-pipelidinyl group, a 1-pyrolinyl group, a 1-imidazolyl group, a 1-imidazolinyl group, a 1-indolyl group, 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4,-tetrahydroquinolyl group, a 2-oxo-1-pyrrolidinyl group, a 2-1H-pyrrolidone group, a phthaladione group, a 2-oxo-1-piperidinyl group, etc., and these heterocyclic groups each may be substituted with an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imide group, a nitro group, a cyano group, a carboxyl group, a halogen atom, etc.

The nitrogen-containing heterocyclic ring to be formed by Z or Z' may include a pyrazole ring, an imidazole ring, a triazole ring, a tetrazole ring, etc., and the substituent which the above rings each may have include those mentioned for the above R.

When the substituents (for example, R, $R^1$ to $R^8$) on the heterocyclic rings in General Formula (I) and General Formulas (II) to (VIII) shown hereinbelow have a moiety of:

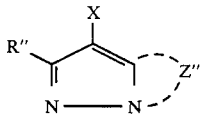

wherein R'', X and Z'' each have the same meaning as R, X, and Z in General Formula (I), a so-called bis-body type coupler is formed, which may be included in the present invention as a matter of course. Also, on the rings, formed by Z, Z', Z'' and the later-mentioned $Z^1$, other rings (for example, a cycloalkene of 5 to 7 members) may be further condensed. For instance, in General Formula (V), $R^5$ and $R^6$ may be, and, in General Formula (VI), $R^7$ and $R^8$ may be bonded to each other to form a ring (for example, a 5- to 7- membered cycloalkene, benzene).

The coupler represented by General Formula (I) may, more specifically, be represented, for example, by General Formulas (II) to (VII) shown below:

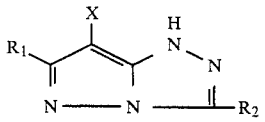

General Formula (II)

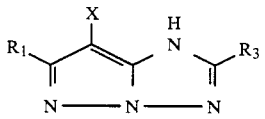

General Formula (III)

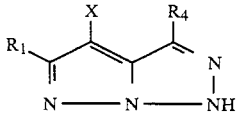

General Formula (IV)

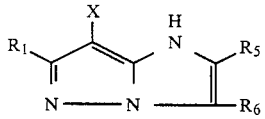

General Formula (V)

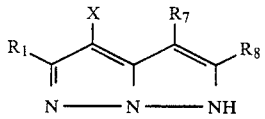

General Formula (VI)

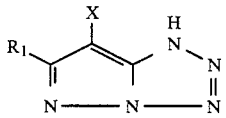

General Formula (VII)

In the above General Formulas (II) to (VII), $R^1$ to $R^8$ and X each have the same meaning as R and X mentioned before.

Also, what is most preferable in General Formula (I) is one represented by General Formula (VIII) shown below:

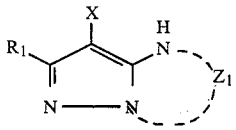

General Formula (VIII)

wherein $R^1$, X and $Z^1$ each have the same meaning as R, X and Z in General Formula (I).

Of the magenta couplers represented by the above General Formulas (II) to (VII), particularly preferred is the magenta coupler represented by General Formula (II).

As for the substituents on the heterocyclic rings in General Formula (I) to (VIII), it is preferable for R, in the case of General Formula (I), and for $R^1$, in the cases of General Formulas (II) to (VIII), to each satisfy the condition 1 shown below, and it is further preferable to satisfy the conditions 1 and 2 shown below, and it is particularly preferable to satisfy the conditions 1, 2 and 3 shown below:

Condition 1: A root atom directly bonded to the heterocyclic ring is a carbon atom.

Condition 2: Only one hydrogen atom is bonded to the above carbon atom, or not bonded thereto at all.

Condition 3: All of the bonds between the carbon atom and atoms adjoining thereto are in single bonding.

Substituents most preferable as the substituents R and $R^1$ in the above heterocyclic rings include those represented by General Formula (IX) shown below:

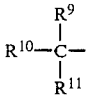

General Formula (IX)

In the above formula, $R^9$, $R^{10}$ and $R^{11}$ each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclic thio group; and at least two of $R^9$, $R^{10}$ and $R^{11}$ are not hydrogen atoms.

Two substituents in the above $R^9$, $R^{10}$ and $R^{11}$, for example, $R^9$ and $R^{10}$, may be bonded to form a saturated or unsaturated ring (for example, a cycloalkane, a cycloalkene, a heterocyclic ring), or $R^{11}$ may be further bonded to this ring to form a residue of a bridged hydrocarbon compound.

The groups represented by $R^9$ to $R^{11}$ may have a substituent, and examples of the groups represented by $R^9$ to $R^{11}$ and the substituents these groups may have, may include the specific examples and the substituents mentioned for the group represented by R in General Formula (I).

Also, examples of the ring to be formed by bonding, for instance, of $R^9$ and $R^{10}$ and the residue of bridged hydrocarbon compound to be formed by $R^9$ to $R^{11}$, and also the substituents which this ring may have, may include the specific examples and the substituents mentioned for the cycloalkyl, the cycloalkenyl and the residue of heterocyclic bridged hydrocarbon compound which are represented by R in the above General Formula (I).

In General Formula (X), preferable are;

(i) the case where two of $R^9$ to $R^{11}$ are each an alkyl group; and (ii) the case where one of $R^9$ to $R^{11}$, for example, $R^{11}$ is a hydrogen atom, and the other two, $R^9$ and $R^{10}$ are bonded to form a cycloalkyl together with the carbon atoms at the root.

Further preferable in the case (i) is the case where two of $R^9$ to $R^{11}$ are each an alkyl group, and the other one is a hydrogen atom or an alkyl group.

Here, the alkyl and the cycloalkyl each may further have a substituent, and examples of the alkyl, the cycloalkyl and the substituents of these may include those for the alkyl, the cycloalkyl and the substituents of these which are represented by R in the above General Formula (I).

The substituents which the ring to be formed by Z in General Formula (I) and the ring to be formed by $Z^1$ in General Formula (VIII) may have, and the substituents $R^2$ to $R^8$ in General Formulas (II) to (VI), are preferably those represented by General Formula (X) shown below:

$$-R^1-SO_2-R^2 \qquad \text{General Formula (X)}$$

wherein $R^1$ represents an alkylene group, $R^2$ represents an alkyl group, a cycloalkyl group or an aryl group.

The alkylene represented by $R^1$ preferably has 2 or more, and more preferably 3 to 6 carbon atoms at the straight chain portion, and may be of straight chain or branched structure. Also, this alkylene may have a substituent.

Examples of such substituent may include those shown as the substituents which the alkyl group when R in General Formula (I) may have.

Preferable substituents may include a phenyl.

Preferable examples for the alkylene represented by $R^1$ are shown below:

$$-CH_2CH_2CH_2-,\ -\underset{\underset{CH_3}{|}}{C}HCH_2CH_2-,\ -\underset{\underset{C_2H_5}{|}}{C}HCH_2CH_2-,$$

$$-CH_2CH_2\underset{\underset{C_7H_{15}}{|}}{C}H-,\ -CH_2CH_2\underset{\underset{C_2H_5}{|}}{C}H-,\ -CH_2CH_2CH_2CH_2-,$$

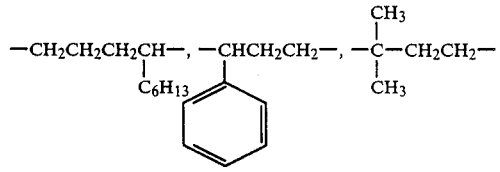

The alkyl group represented by $R^2$ may be of straight chain or branched structure.

Specifically, it may include methyl, ethyl, propyl, iso-propyl, butyl, 2-ethylhexyl, octyl, dodecyl, tetradecyl, hexadecyl, octadecyl, 2-hexyldecyl, etc.

The cycloalkyl group represented by $R^2$ is preferably of 5 to 6 members, and may include, for example, a cyclohexyl group.

The alkyl group and the cycloalkyl group represented by $R^2$ may each have a substituent including, for example, those exemplified as the substituents for the above $R^1$.

The aryl group represented by $R^2$ may specifically include a phenyl group and a naphthyl group. The aryl group may have a substituent. Such a substituent may include, for example, a straight chain or branched alkyl group, and besides, those exemplified as the substituents for the above $R^1$.

Also, when there are two or more substituents, they may be the same or different substituents.

Particularly preferable in the compounds represented by General Formula (I) are those represented by General Formula (XI) shown below:

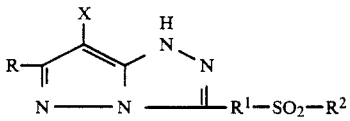

General Formula (XI)

wherein R and X each have the same meaning as R and X in General Formula (I), and $R^1$ and $R^2$ each have the same meaning as $R^1$ and $R^2$ in General Formula (X).

Specific examples of the compounds used in the present invention are shown below:

1

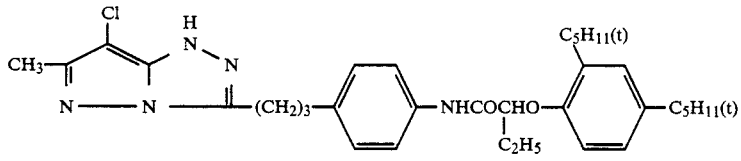

2

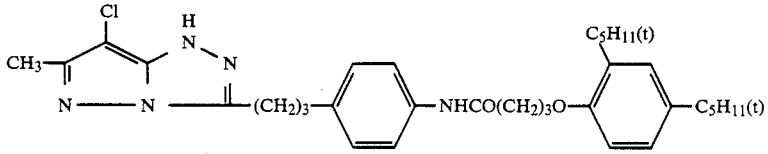

-continued
3
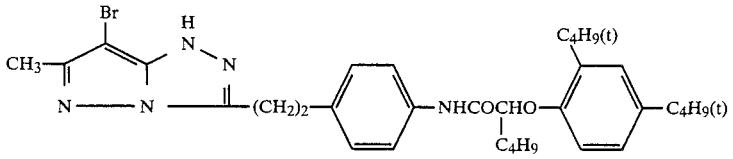
4
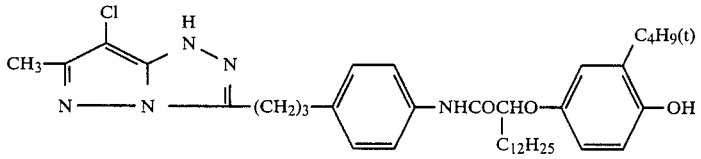
5
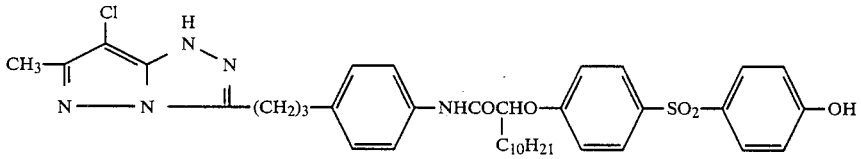
6
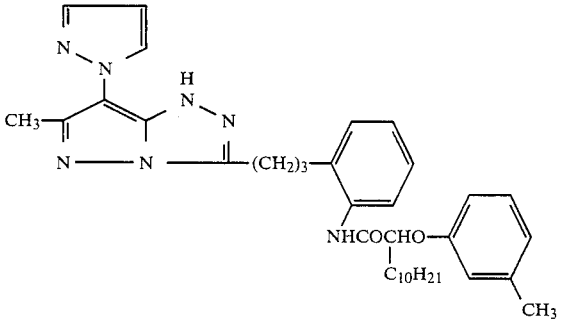
7
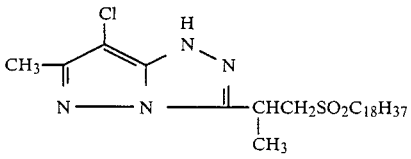
8
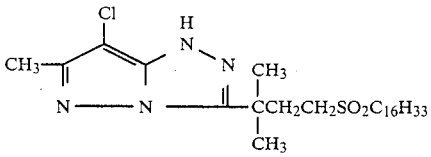
9
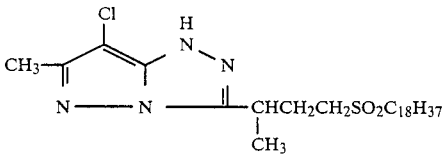
10
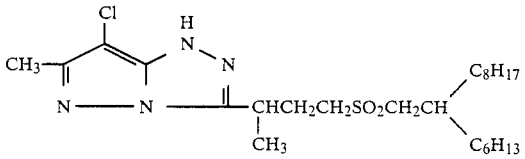

-continued
11
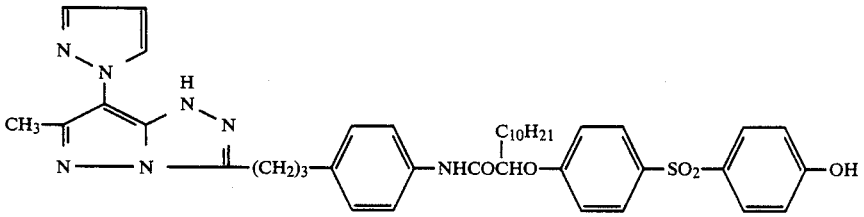
12
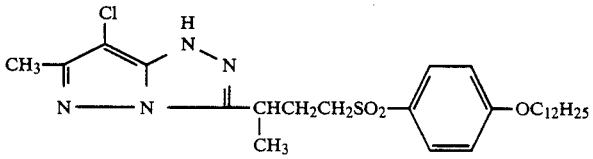
13
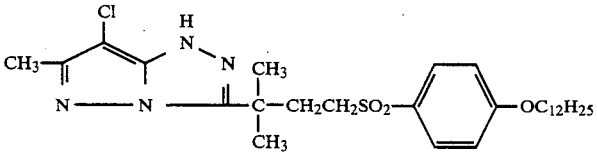
14
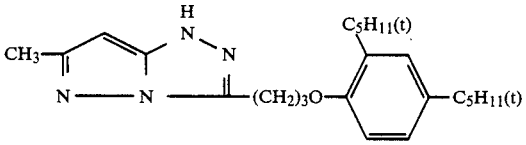
15
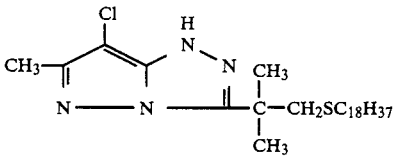
16
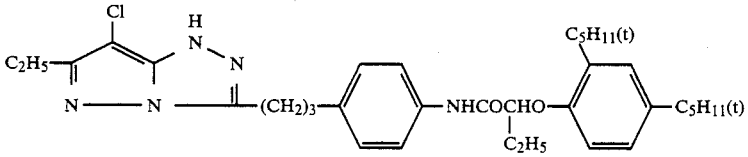
17
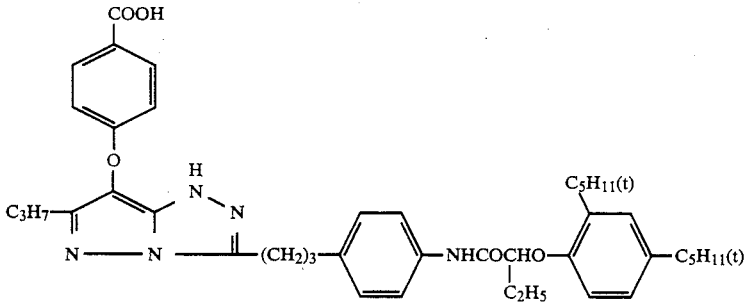
18
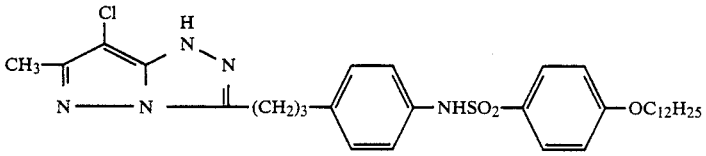

-continued
19
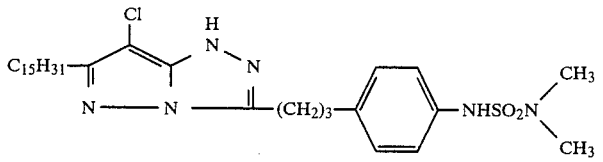
20
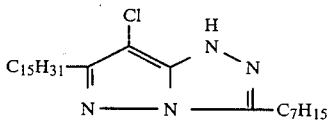
21
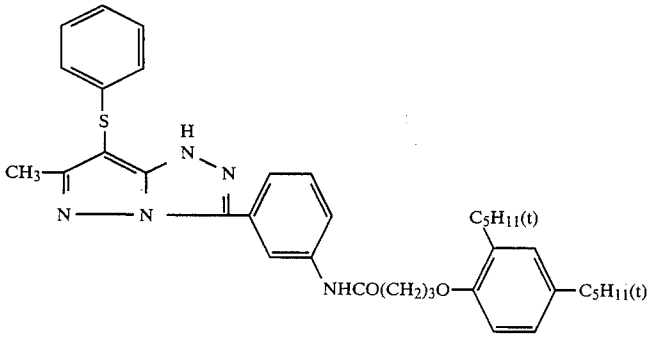
22
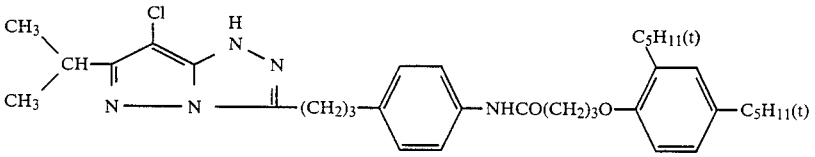
23
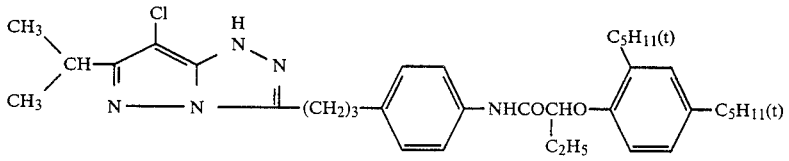
24
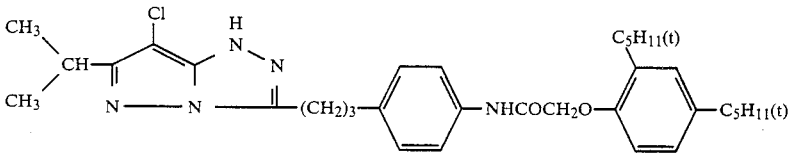
25
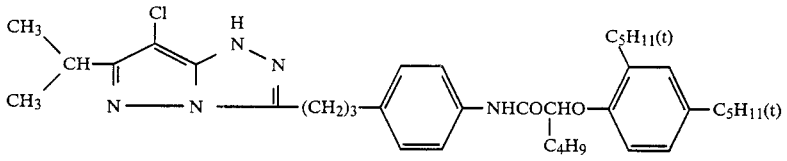
26
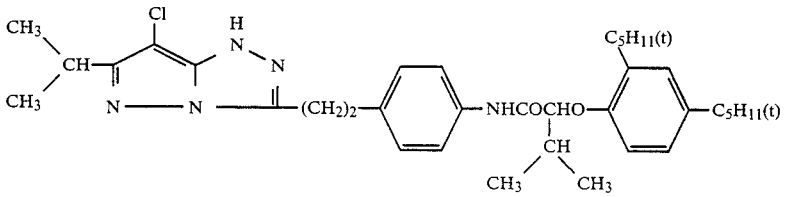

-continued
27
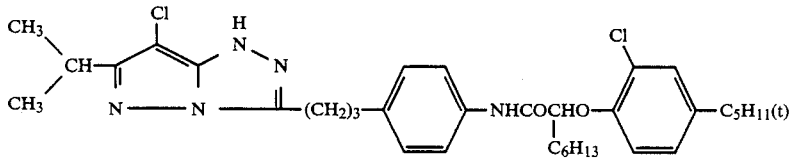
28
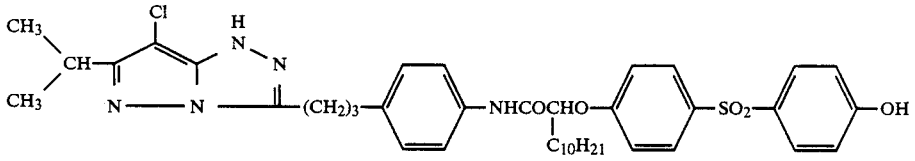
29
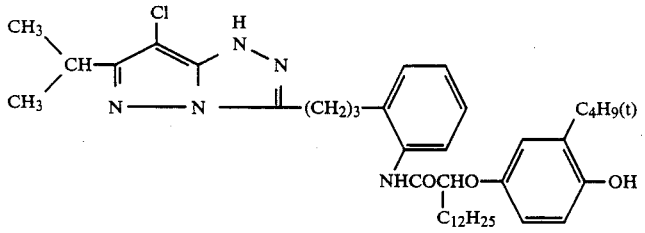
30
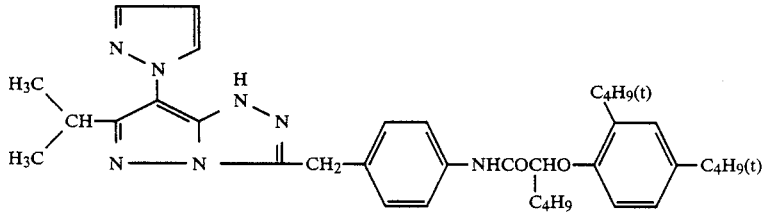
31
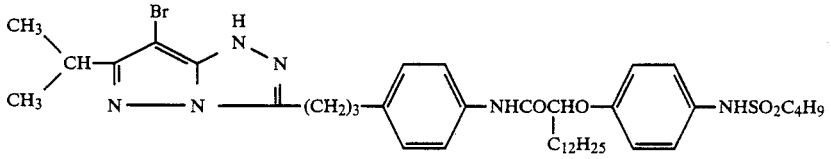
32
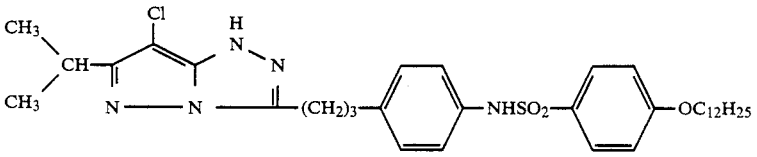
33
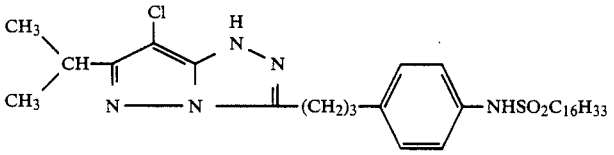
34
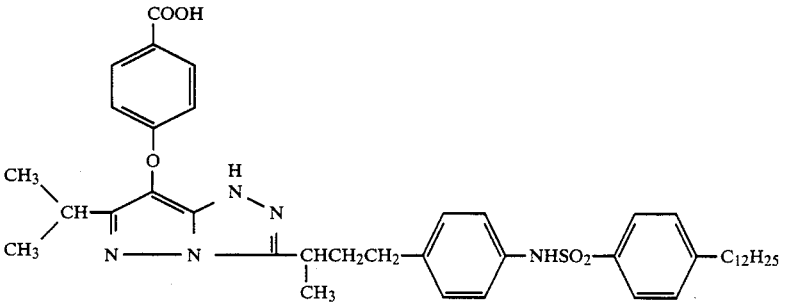

-continued
35
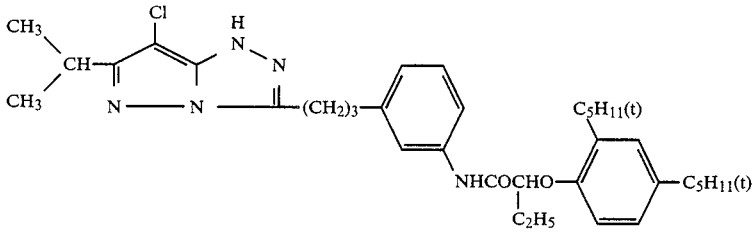
36
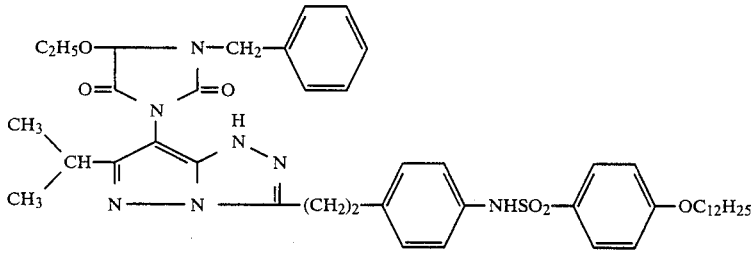
37
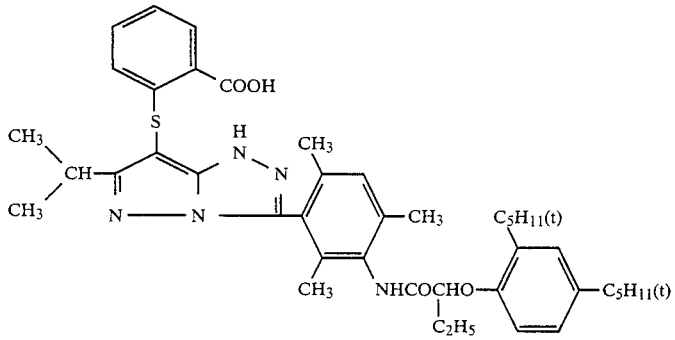
38
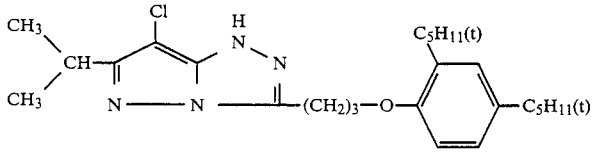
39
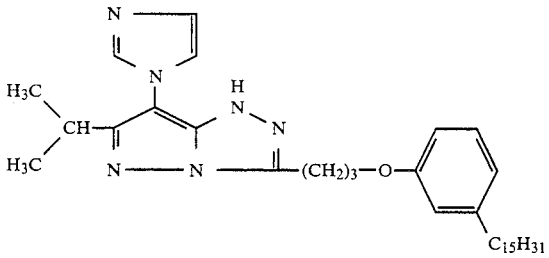
40
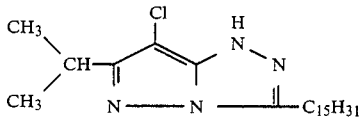
41
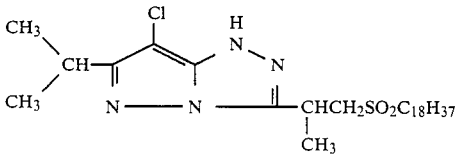

-continued
42
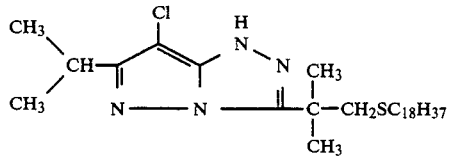
43
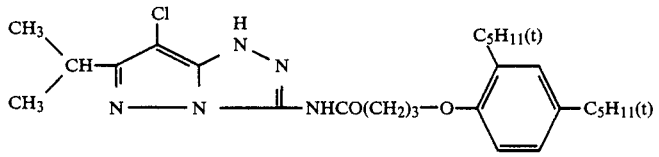
44
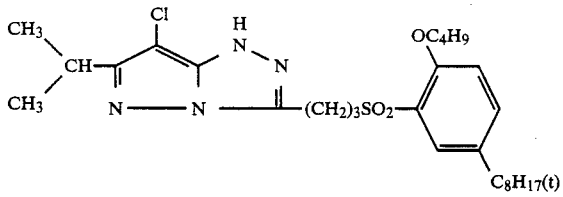
45
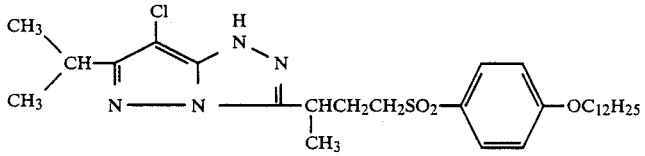
46
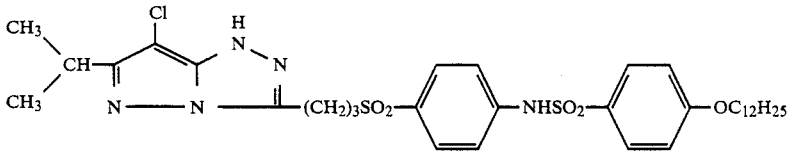
47
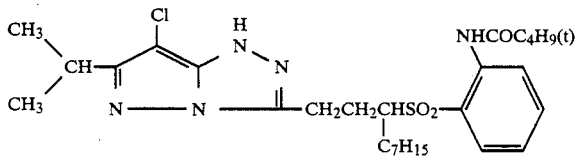
48
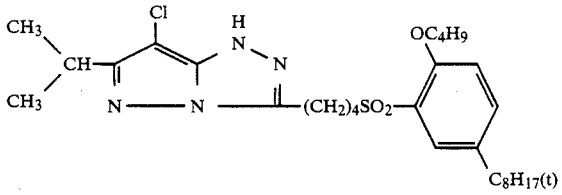
49
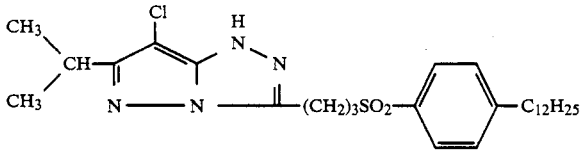
50
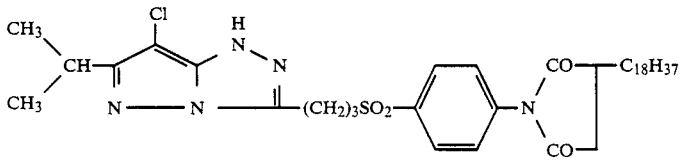

-continued
51
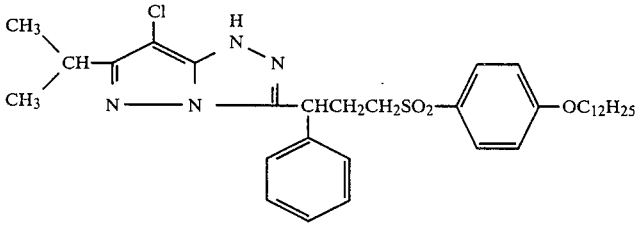
52
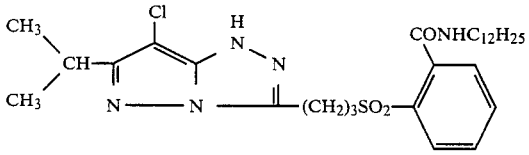
53
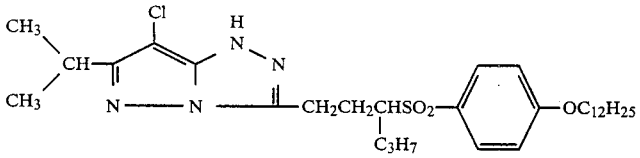
54
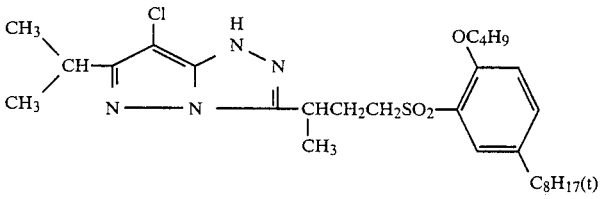
55
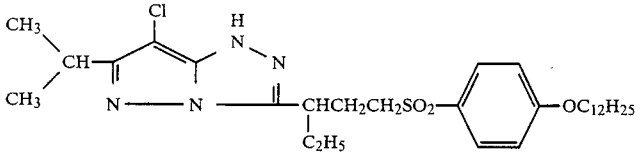
56
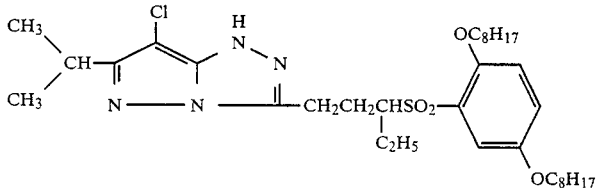
57
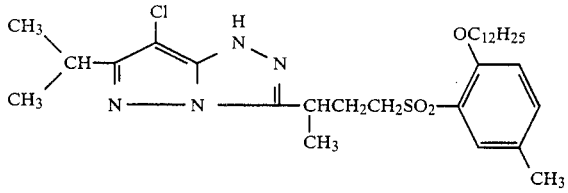
58
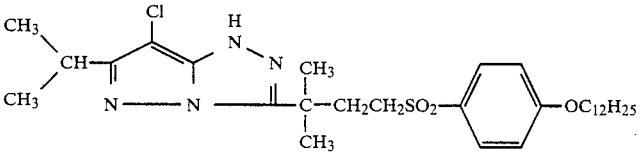
59
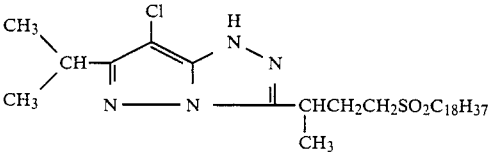

-continued
60
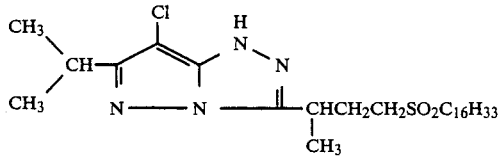
61
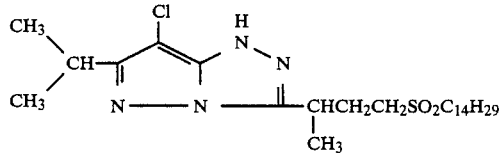
62
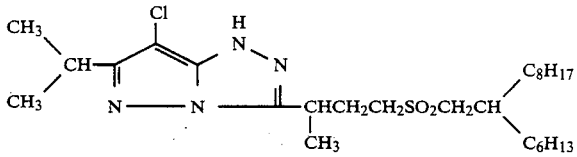
63
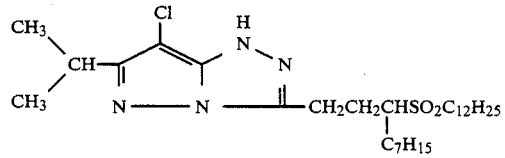
64
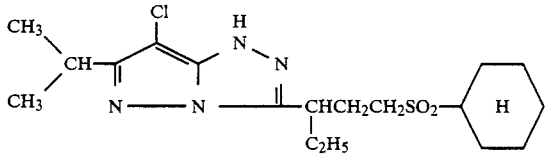
65
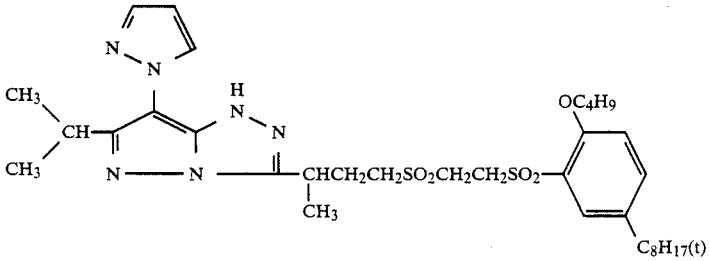
66
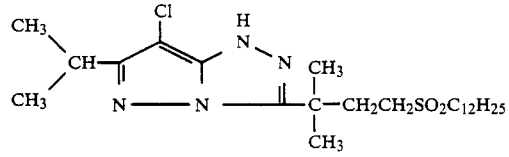
67
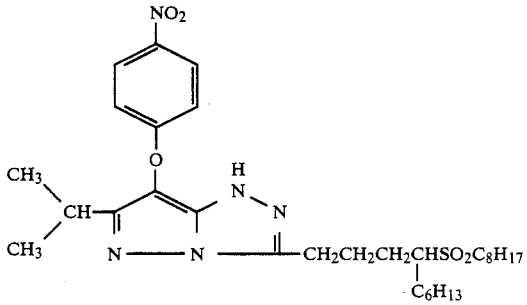

-continued
68
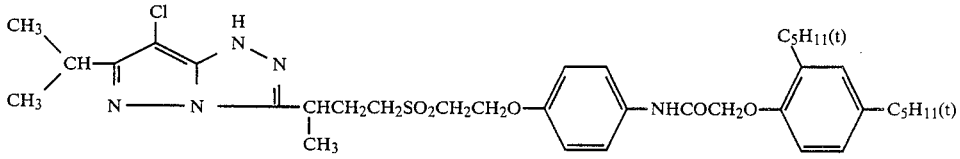
69
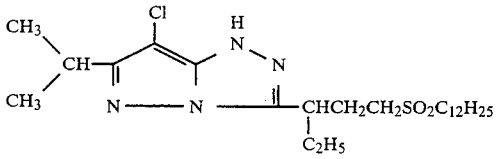
70
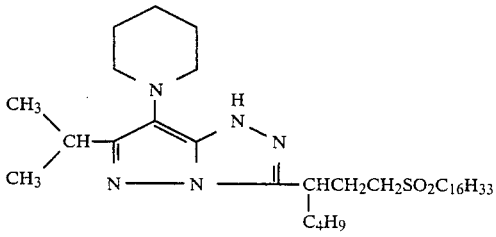
71
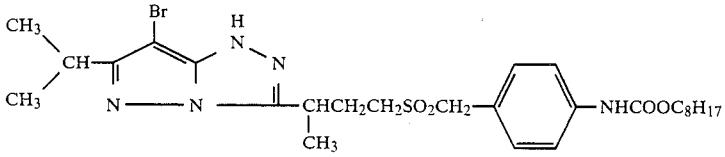
72
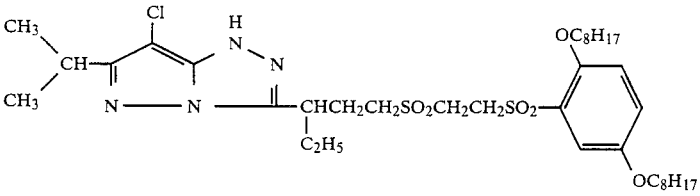
73
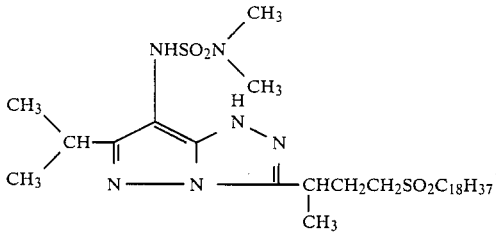
74
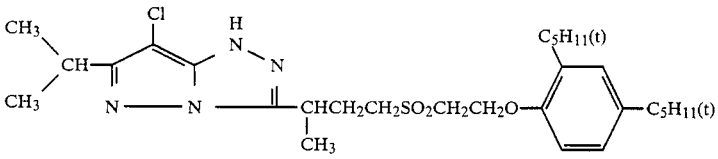
75
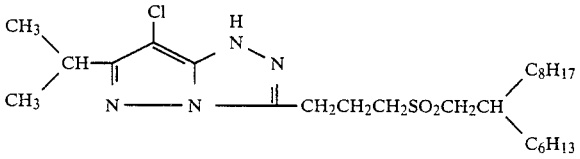

-continued
76
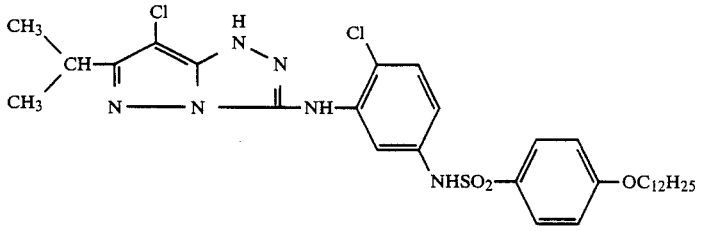
77
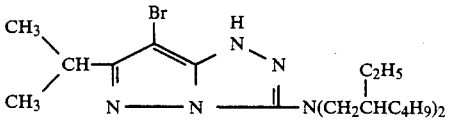
78
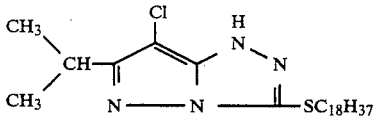
79
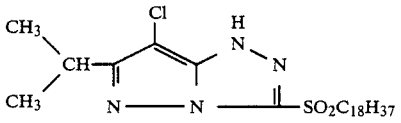
80
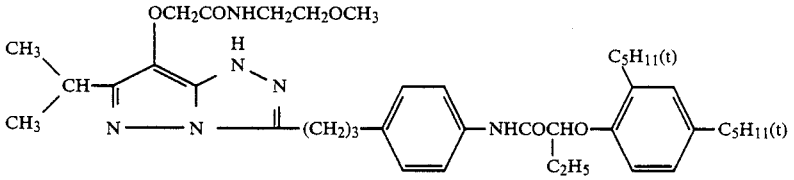
81
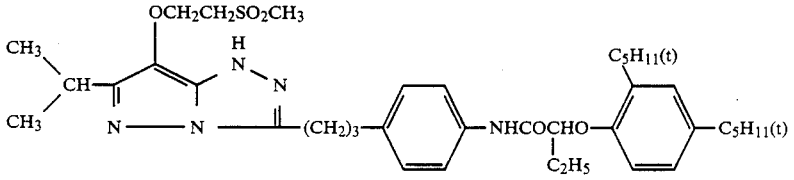
82
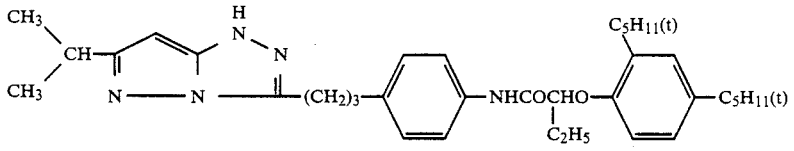
83
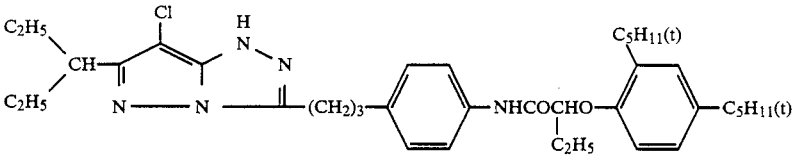
84
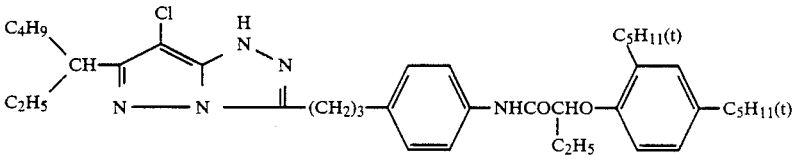

-continued
85
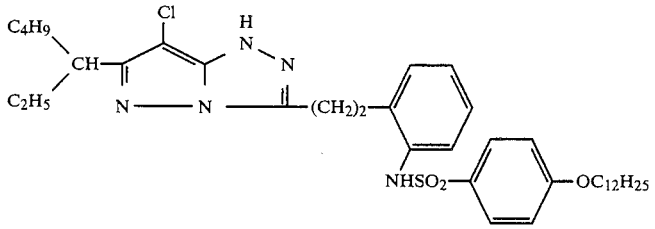
86
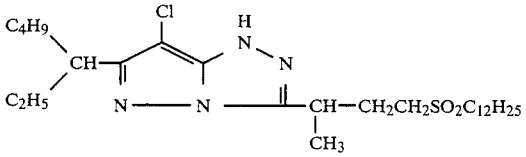
87
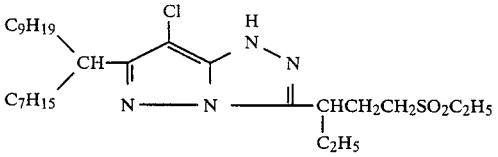
88
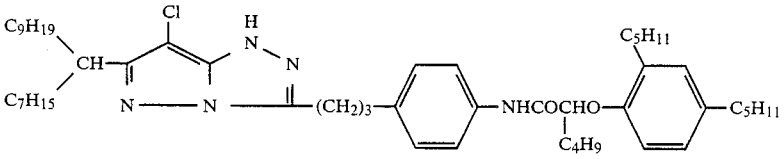
89
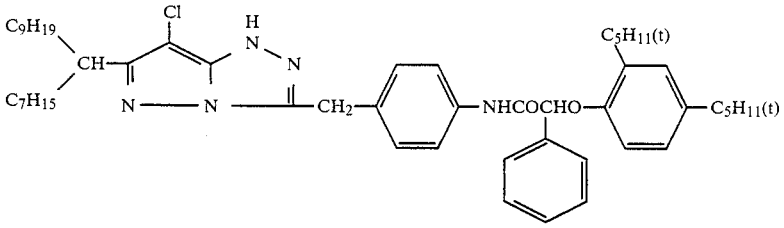
90
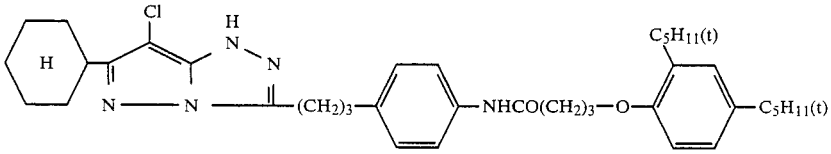
91
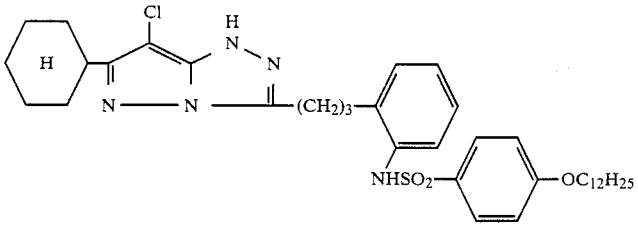
92
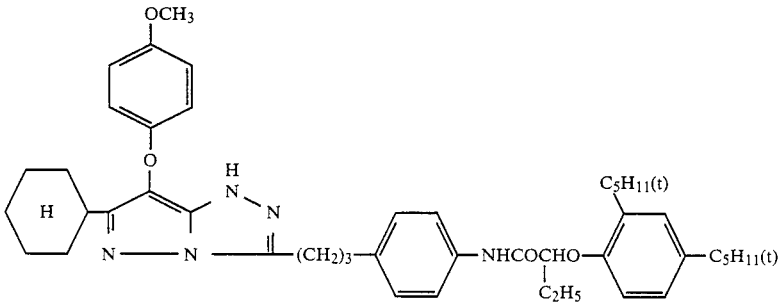

-continued
93
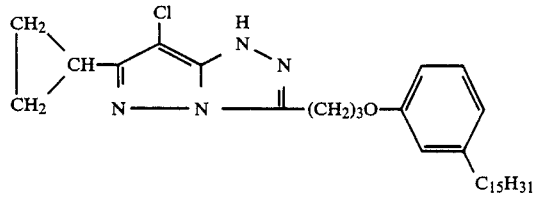
94
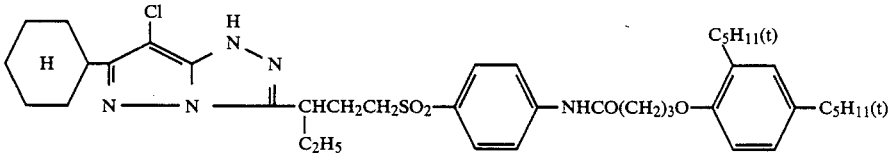
95
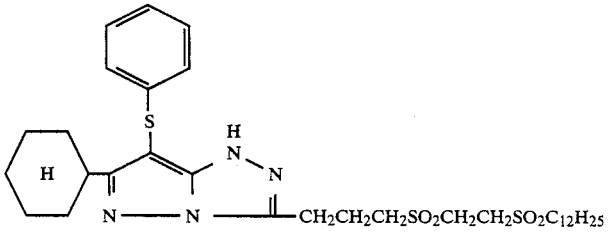
96
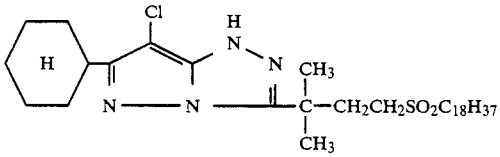
97
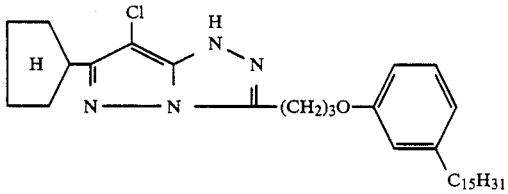
98
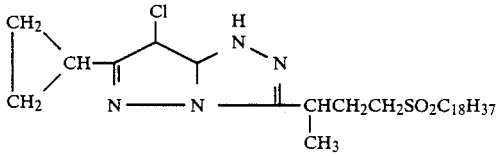
99
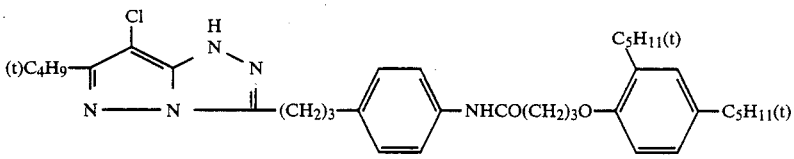
100
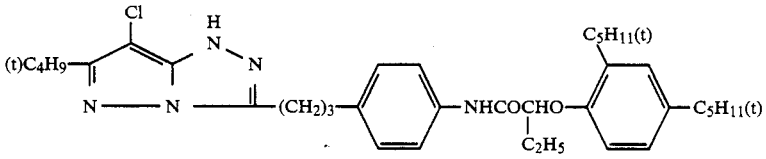
101
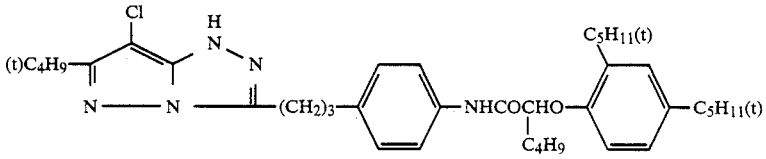

-continued
102
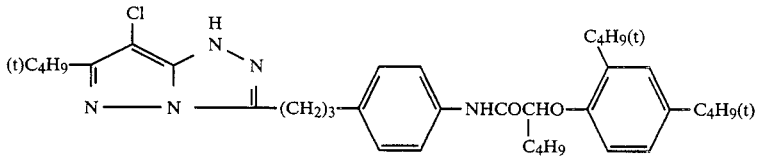
103
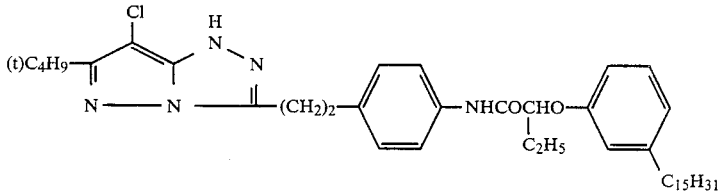
104
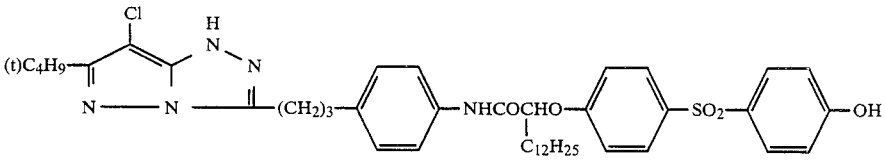
105
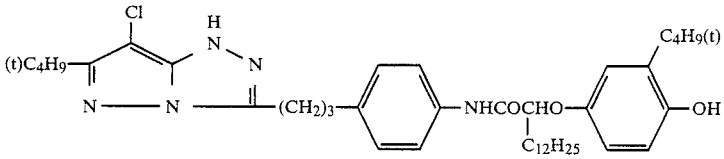
106
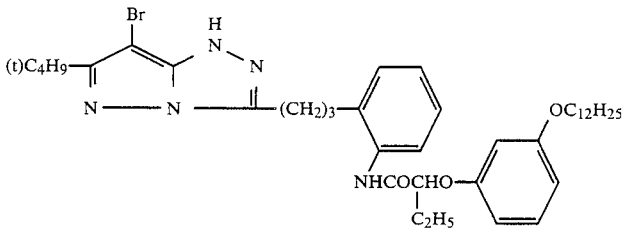
107
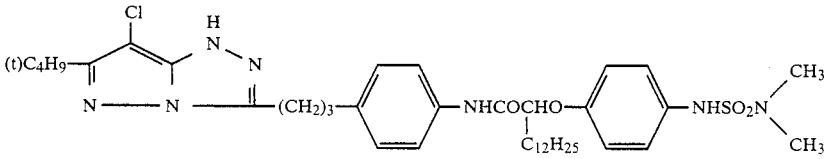
108
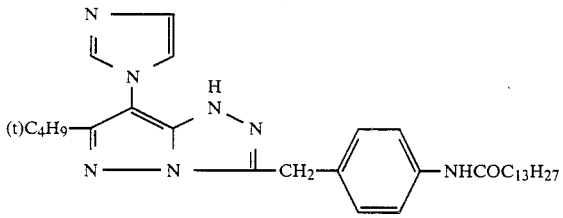
109
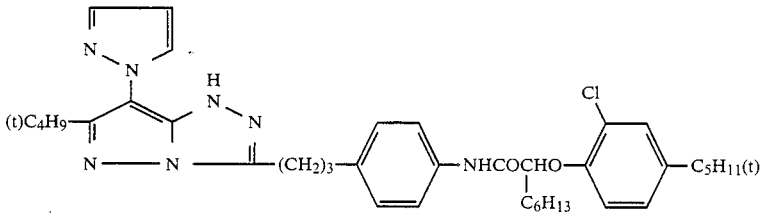

-continued
110
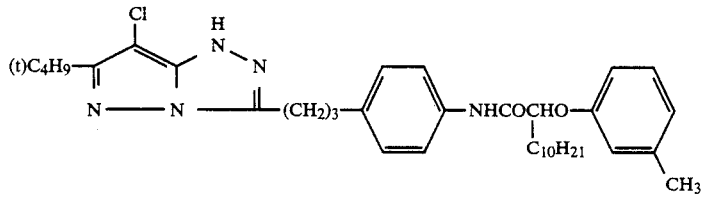
111
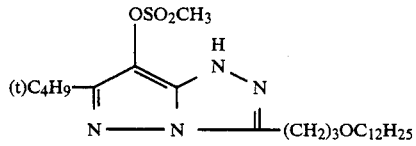
112
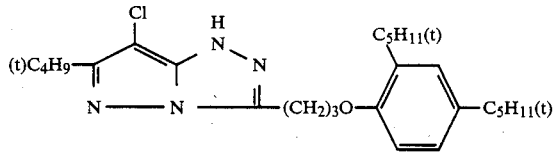
113
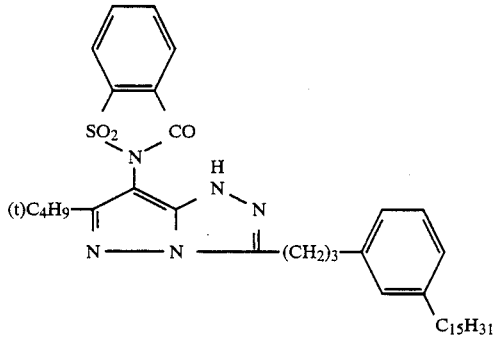
114
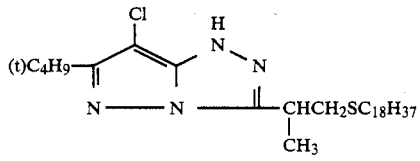
115
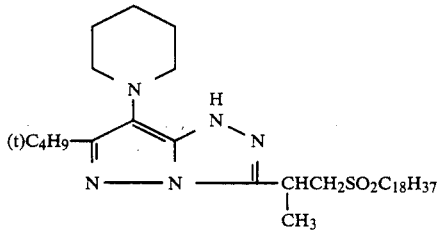
116
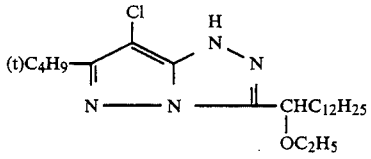
117
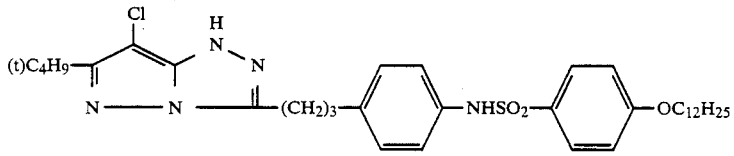

-continued
118
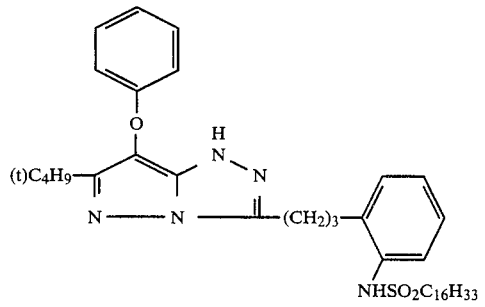
119
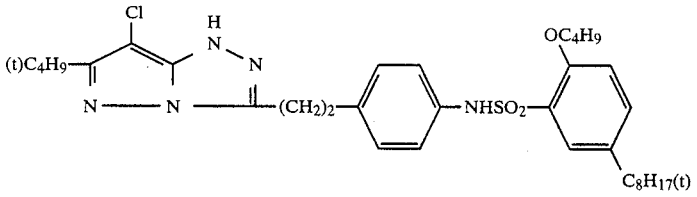
120
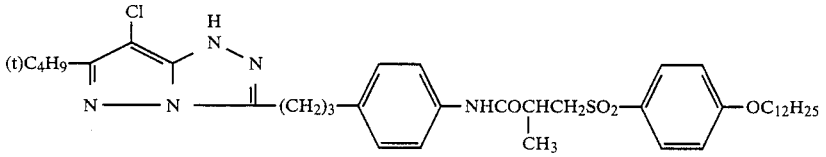
121
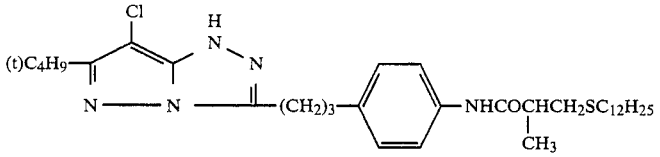
122
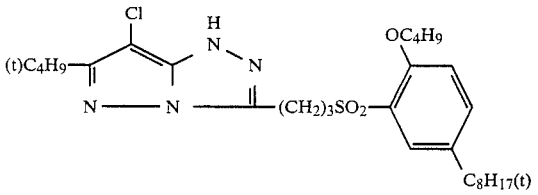
123
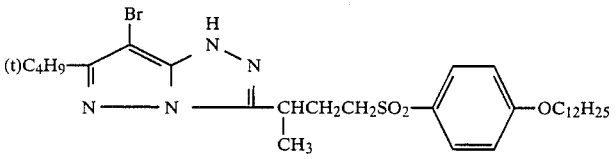
124
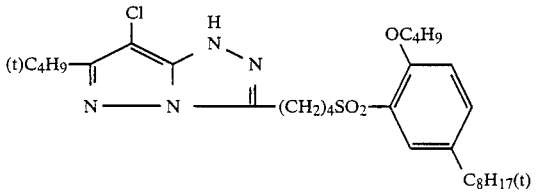

-continued
125
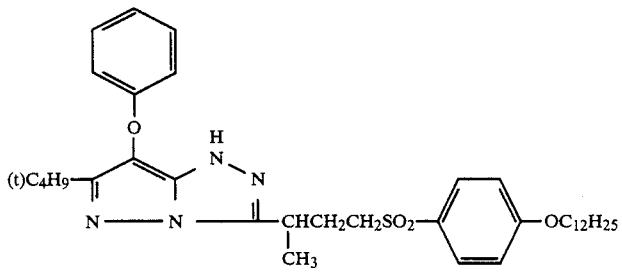
126
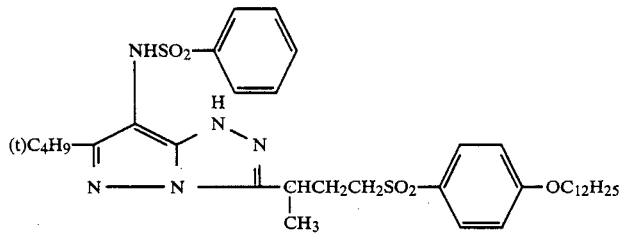
127
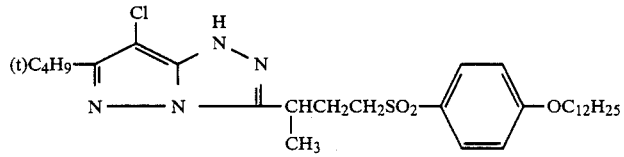
128
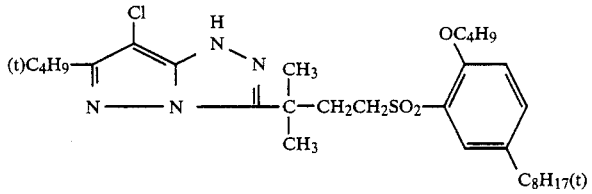
129
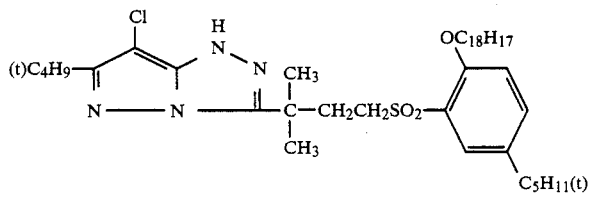
130
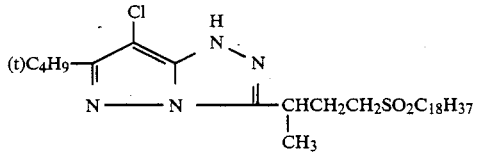
131
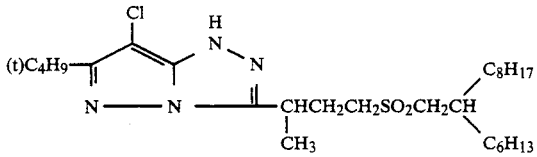
132
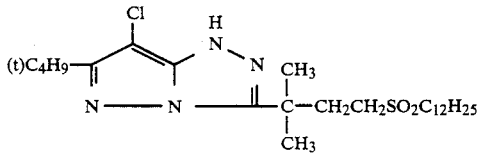

-continued
133
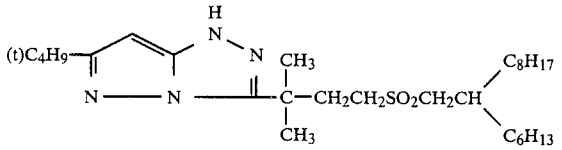
134
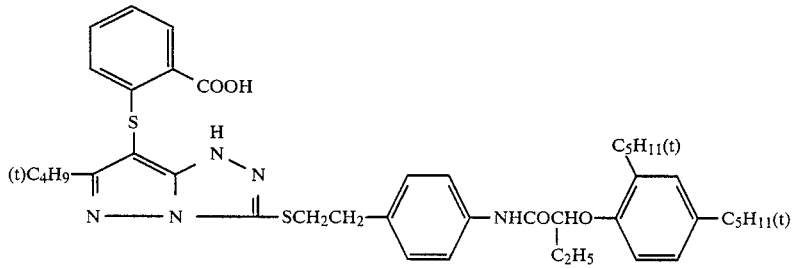
135
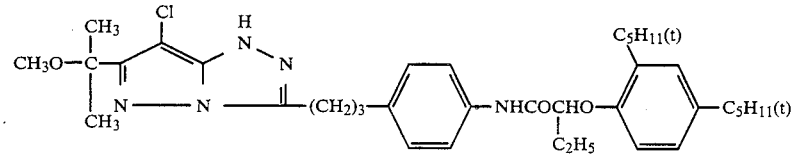
136
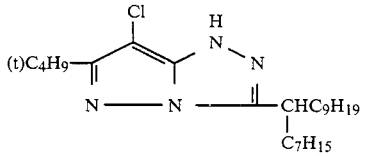
137
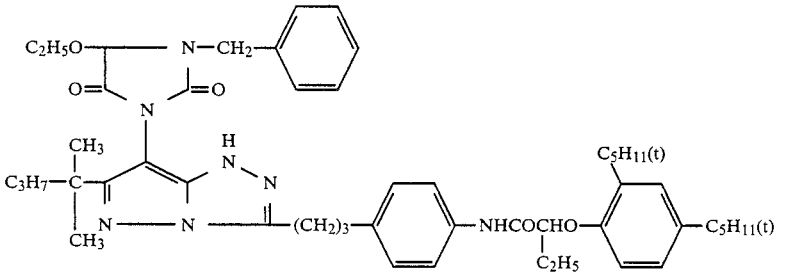
138
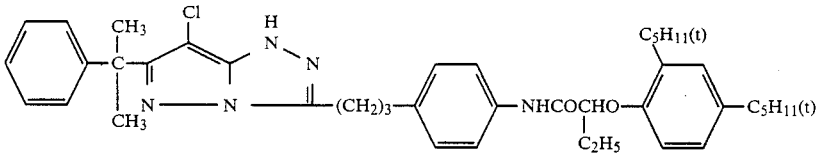
139
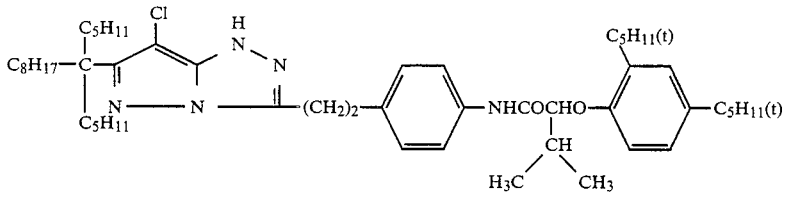
140
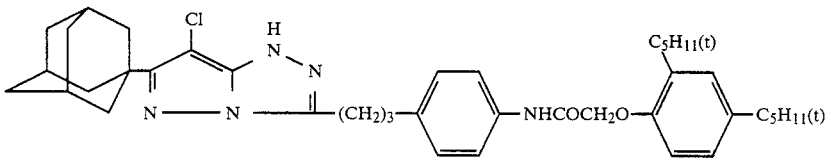

-continued
141
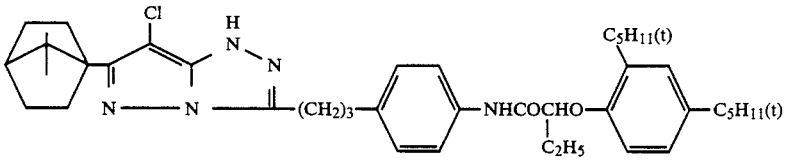
142
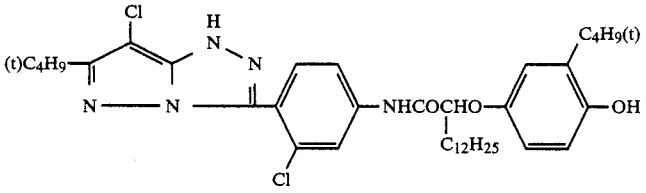
143
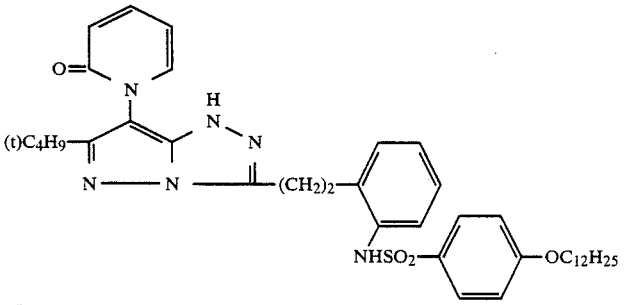
144
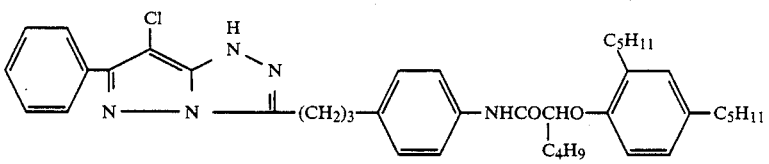
145
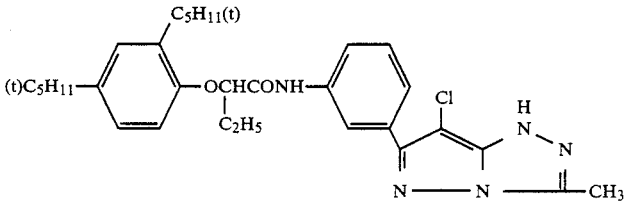
146
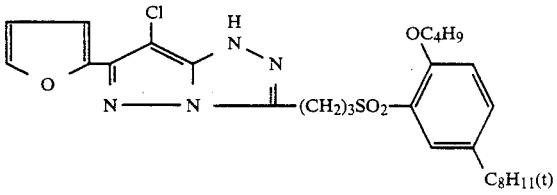
147
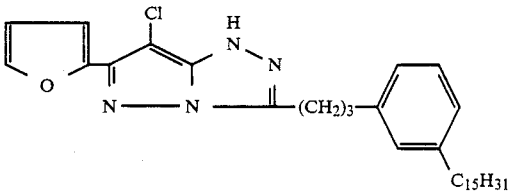

-continued
148
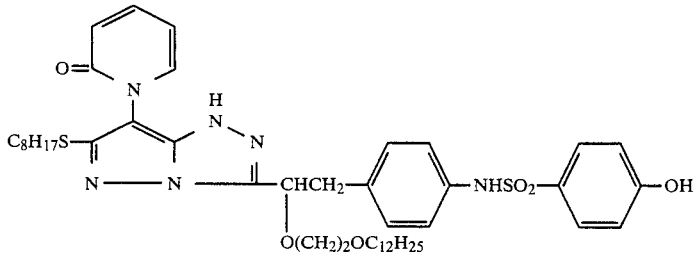
149
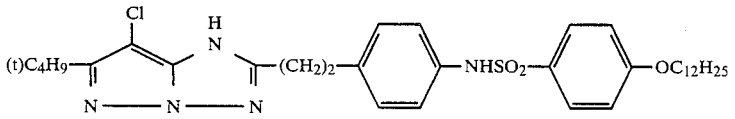
150
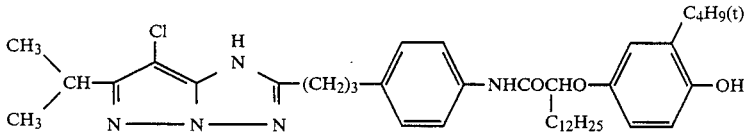
151
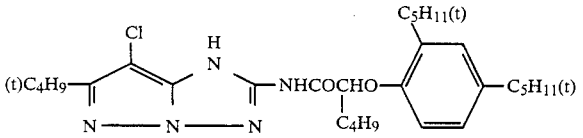
152
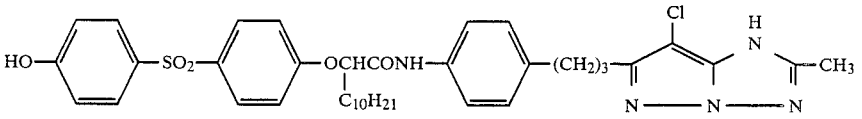
153
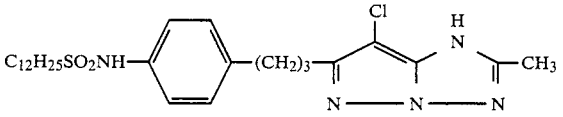
154
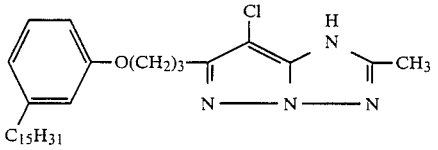
155
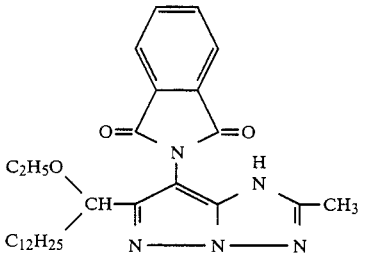
156
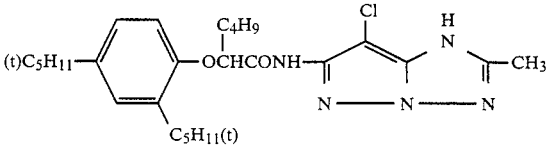

-continued
157
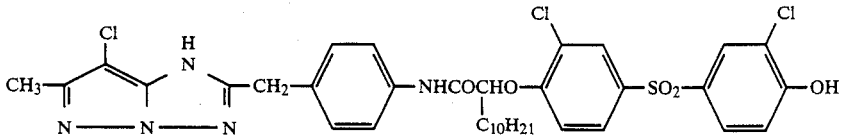
158
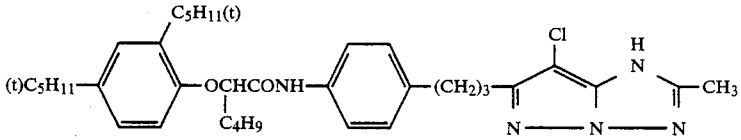
159
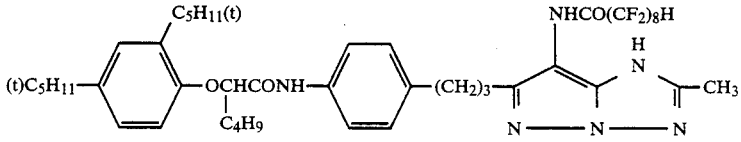
160
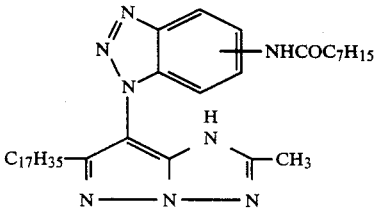
161
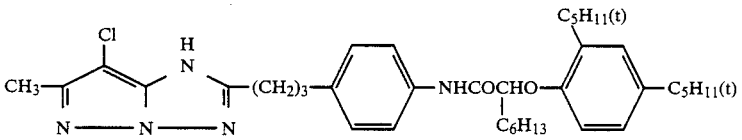
162
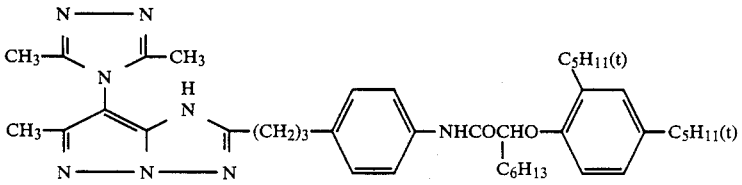
163
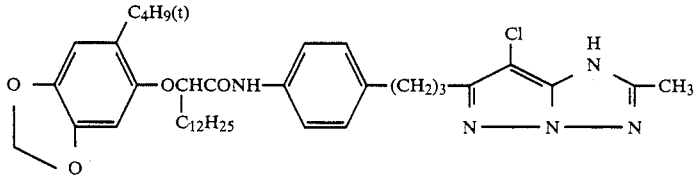
164
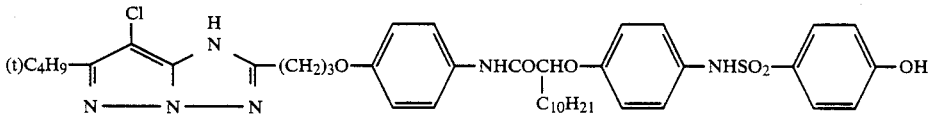
165
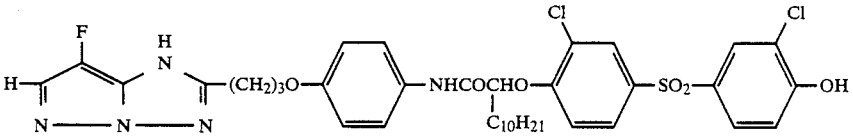
166
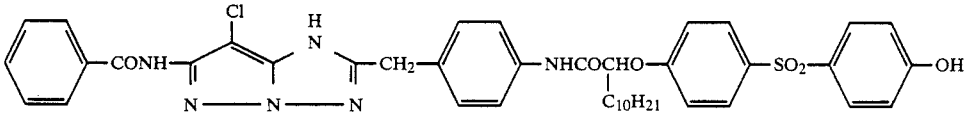

-continued
167
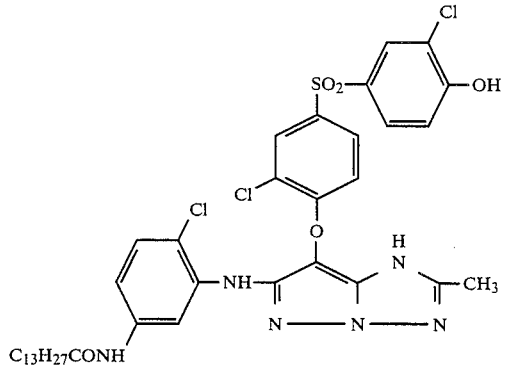
168
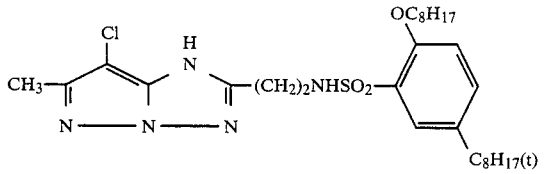
169
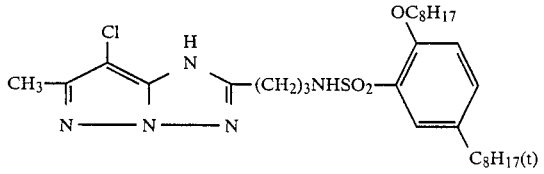
170
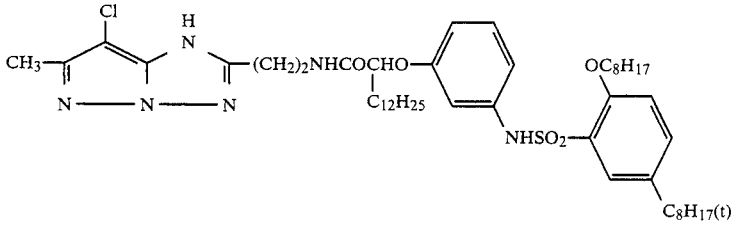
171
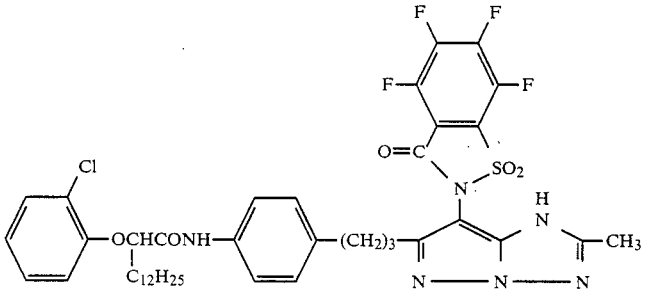
172
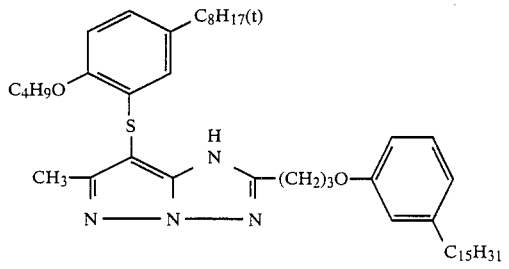

-continued
173
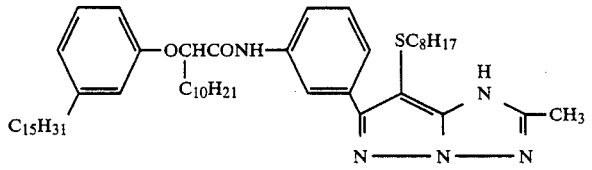
174
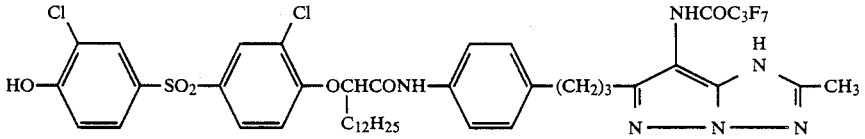
175
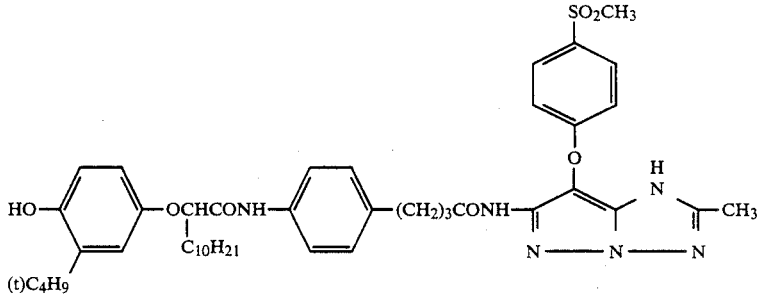
176
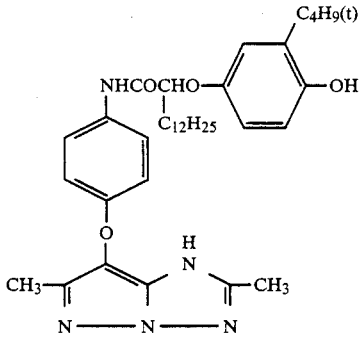
177
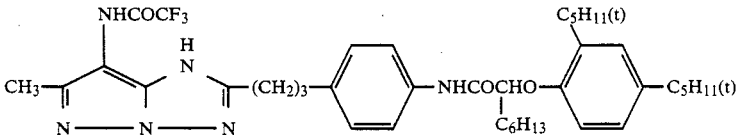
178
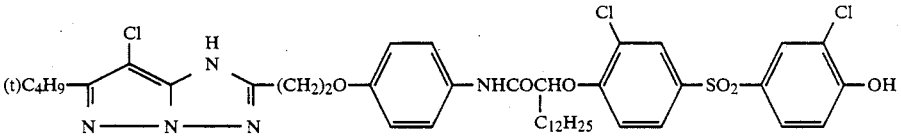
179
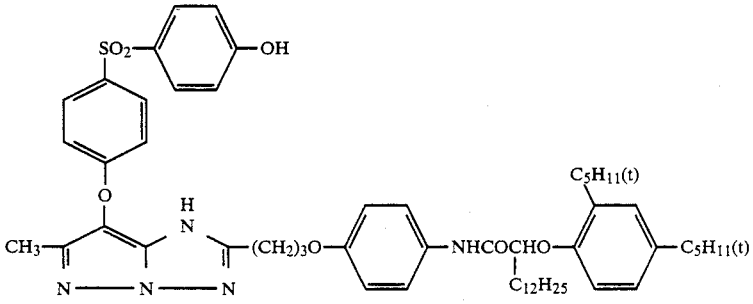

-continued
180
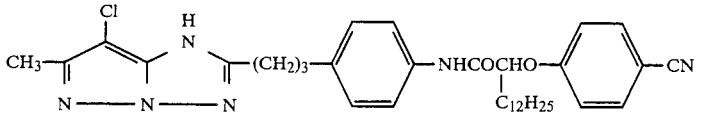
181
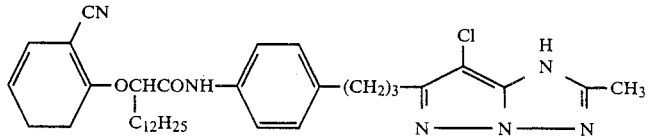
182
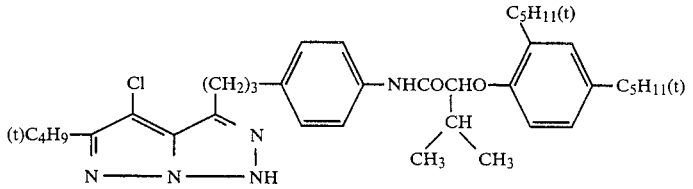
183
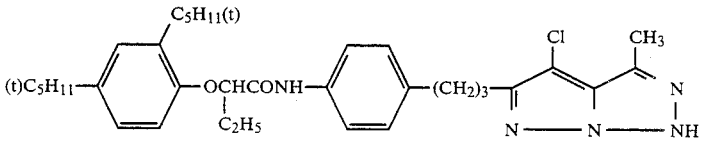
184
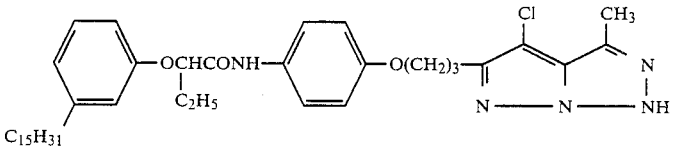
185
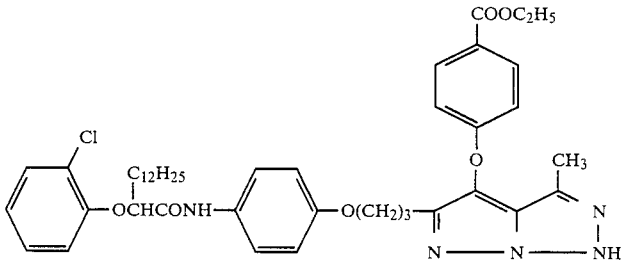
186
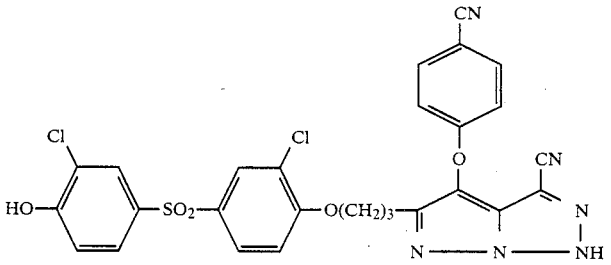
187
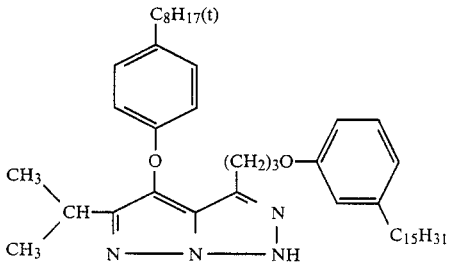

-continued
188
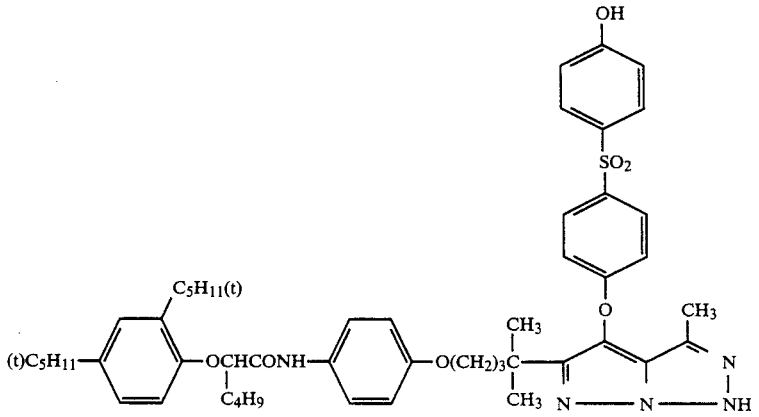
189
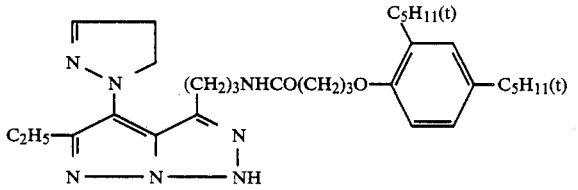
190
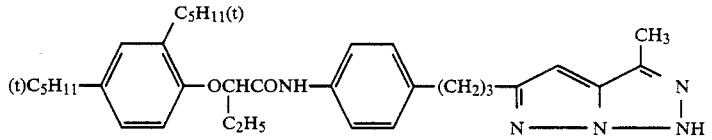
191
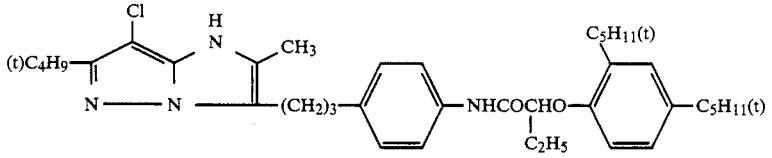
192
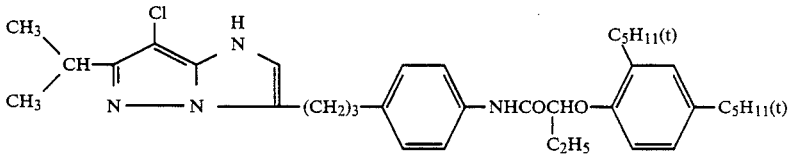
193
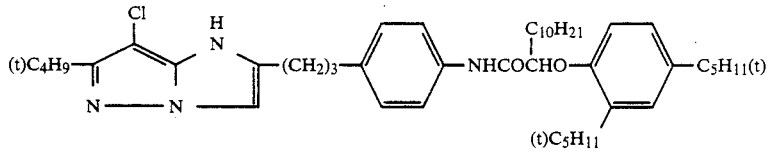
194
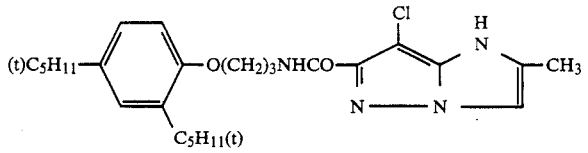
195
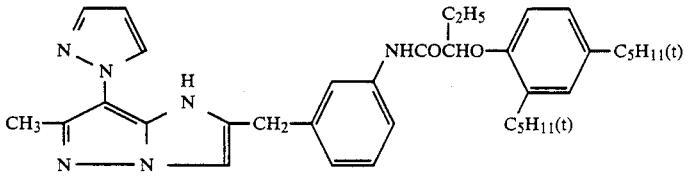

-continued
196
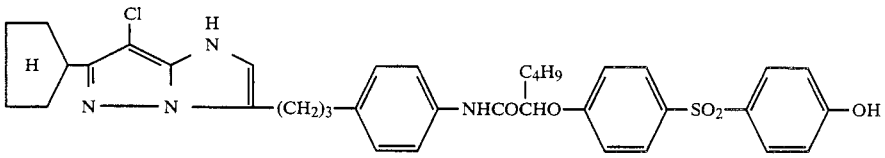
197
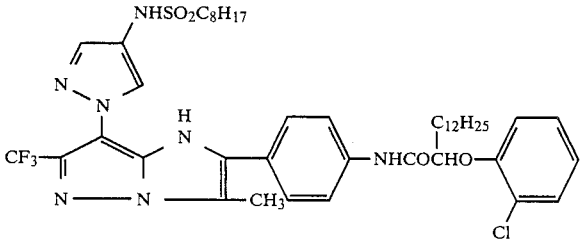
198
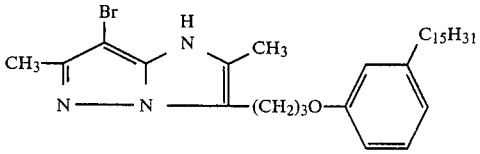
199
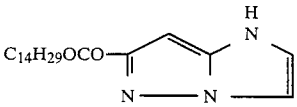
200
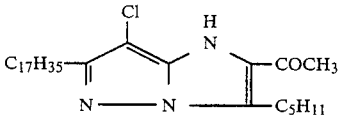
201
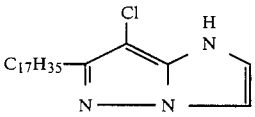
202
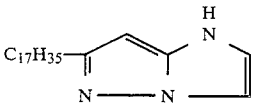
203
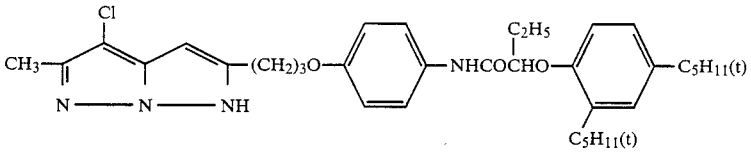
204
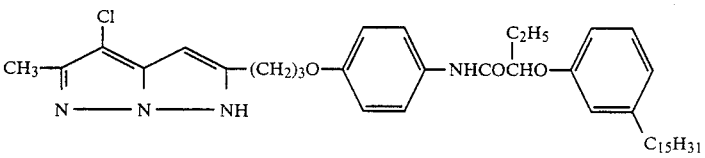

-continued
205
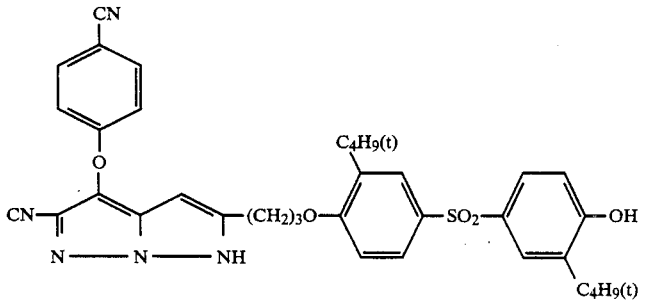
206
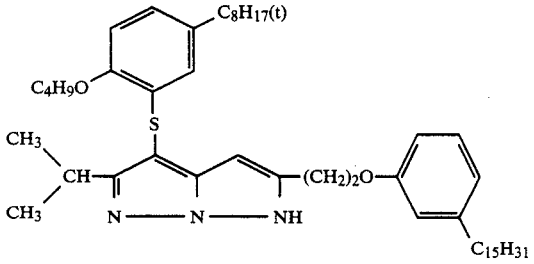
207
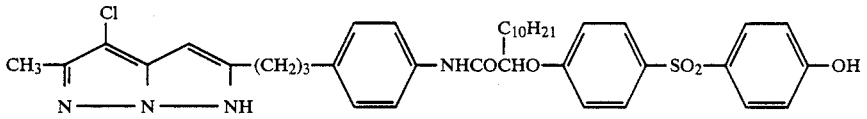
208
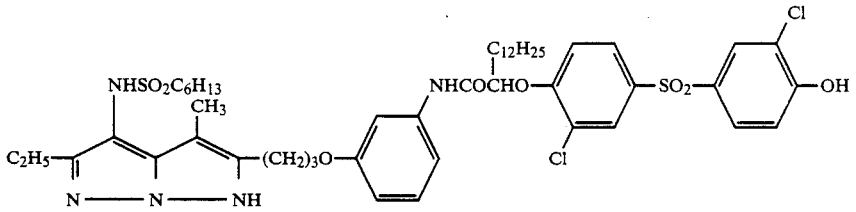
209
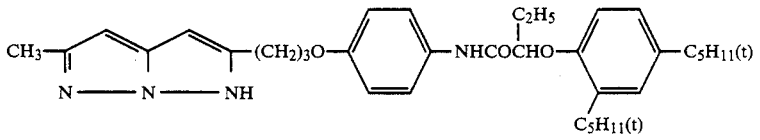
210
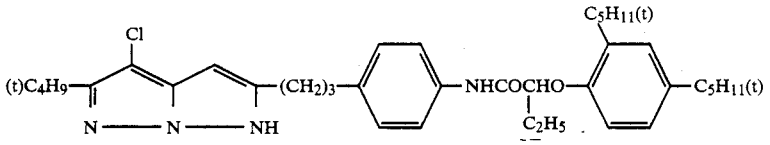
211
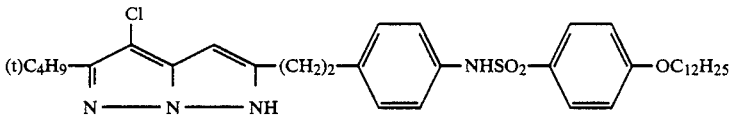
212
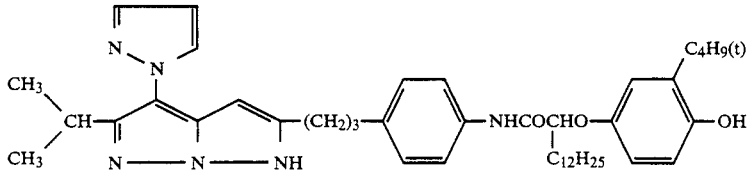

-continued
213
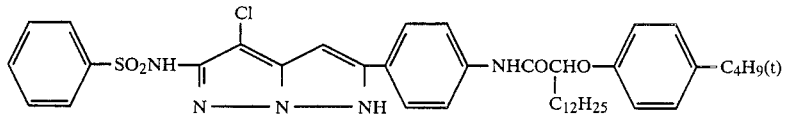
214
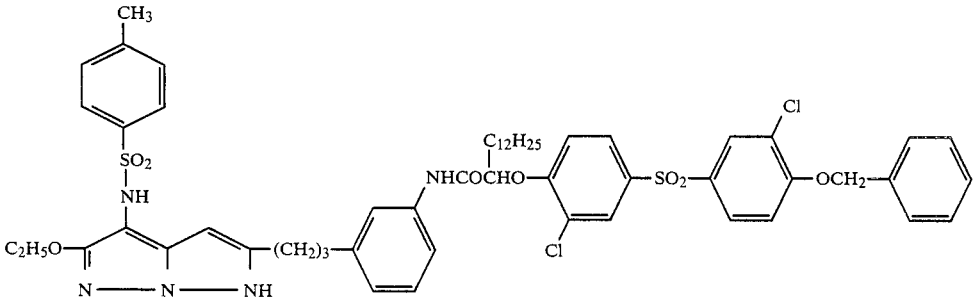
215
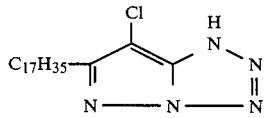
216
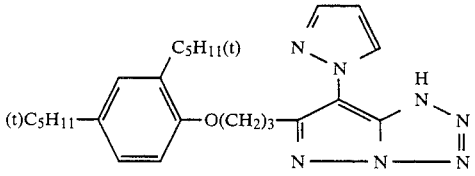
217
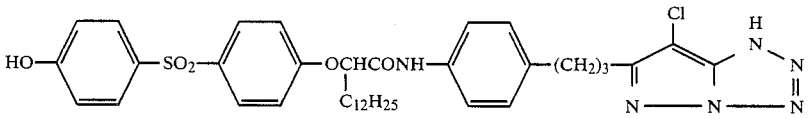
218
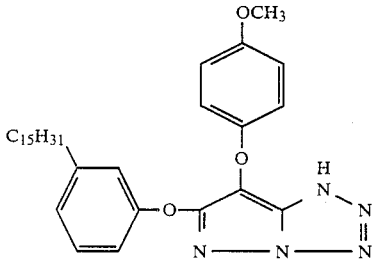
219
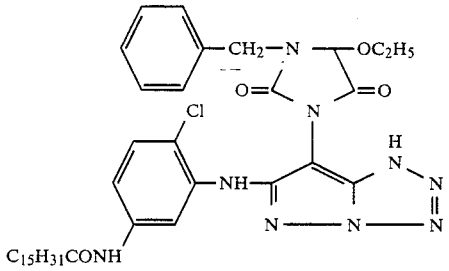
220
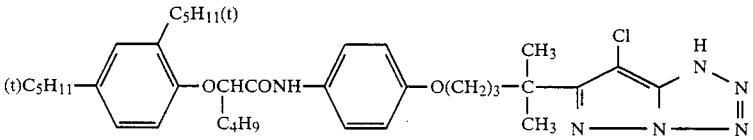

-continued

221

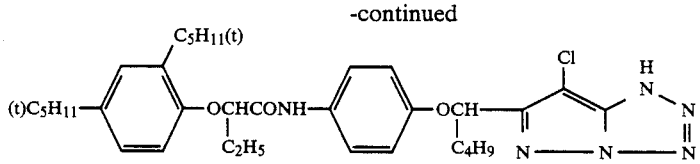

222

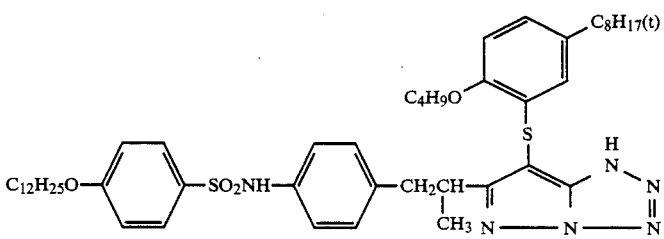

223

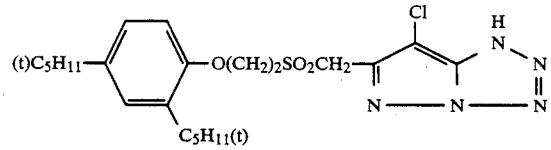

Syntheses of the above couplers can be carried out by making reference to Journal of the Chemical Society, Perkin I, 1977 , pp 2047–2052, U.S. Pat. No. 3,725,067 and Japanese Patent O.P.I. Publications No. 99437/1984, No. 42045/1983, No. 162548/1984, No. 171956/1984, No. 33552/1985, No. 43659/1985, No. 172982/1985 and No. 190779/1985, etc.

The couplers of the present invention can be used usually in the range of $1 \times 10^{-3}$ mole to 1 mole, preferably $1 \times 10^{-2}$ to $8 \times 10^{-1}$ mole, per 1 mole of silver halide.

The couplers of the present invention can be also used in combination with magenta couplers of other kinds.

Among magenta dye image stabilizing agents, always used is the compound represented by the foregoing General Formula (XII) having a morpholine ring or a thiomorpholine ring. Other magenta dye image stabilizer used in combination with the morpholine or thiomorpholine type compound represented by the above General Formula (XII) is at least one selected from the compound represented by the foregoing General Formula (XIIIa) having a coumaran ring or chroman ring and the hydroxyindane type compound represented by the foregoing General Formula (XIIIb).

Japanese Patent Application No. 31297/1985 and No. 85194/1985 disclose that the morpholine or thiomorpholine type compound of the present invention, represented by the above General Formula (XII), is effective for stabilizing the magenta dye image obtained from the magenta coupler of the present invention.

Japanese Patent Application No. 280486/1987 and No. 85195/1985 also disclose that the coumaran or chroman type compound of the present invention, represented by the above General Formula (XIIIa), is effective for stabilizing the magenta dye image obtained from the magenta coupler of the present invention. On the other hand, Japanese Patent Application No. 25793/1985 and No. 85193/1985 disclose that the hydroxyindane type compound of the present invention, represented by the above General Formula (XIIIb), is effective for stabilizing the magenta dye image obtained from the magenta coupler of the present invention.

However, none of the above respective publications disclose any effect achieved when the compound of Formula (XII) of the present invention and at least one selected from the compounds of General Formula (XIIIa) and General Formula (XIIIb) of the present invention are used in combination, regarding the stabilization of the magenta dye image obtained from the magenta coupler of the present invention.

As a result of intensive studies, the present inventors have found that the stability to light, of the magenta dye image obtained from the magenta coupler of the present invention dramatically increases when the compound of Formula (XII) of the present invention and at least one selected from the compounds of General Formula (XIIIa) and General Formula (XIIIb) of the present invention are used in combination together with the magenta coupler represented by General Formula (I) of the present invention.

Hereinafter, the compounds represented by the above General Formula (XII), General Formula (XIIIa) and General Formula (XIIIb) are each referred to as the magenta dye image stabilizing agent of the present invention or merely as the dye image stabilizing agent, unless particularly mentioned.

The magenta coupler of the present invention and the magenta dye image stabilizing agent of the present invention, used in combination therewith, are both not only have an effect of preventing color fading by light, of the magenta dye image, but also have an effect of preventing color change by light. One kind of the compounds is the morpholine or thiomorpholine type compound represented by General Formula (XII) shown below.

General Formula (XII)

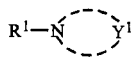

In the formula, $R^1$ represents an aliphatic group, a cycloalkyl group or an aryl group; and $Y^1$ represents a group of nonmetallic atoms necessary for the formation of a morpholine ring or thiomorpholine ring together with a nitrogen atom.

In General Formula (XII), $R^1$ represents an aliphatic group, a cycloalkyl group or an aryl group, and the aliphatic group represented by $R^1$ may include, for example, an alkyl group, an alkenyl group and an alkynyl group, including those having a substituent. The alkyl group may include, for example, a methyl group, an ethyl group, a butyl group, an octyl group, a dodecyl group, a tetradecyl group, a hexadecyl group, etc. The alkenyl group may include, for example, ethenyl group, a propenyl group, etc., and the alkynyl group may include, for example, an ethynyl group, a propynyl group, etc.

The cycloalkyl group represented by $R^1$ may include a 5- to 7-membered cycloalkyl group specifically including a cyclopentyl group, a cylcohexyl group, etc., which may have a substituent.

The aryl group represented by $R^1$ may include a phenyl group and a naphthyl group, including those having a substituent.

The heterocyclic group represented by $R^1$ may include, for example, a 2-pyridyl group, a 4-piperidyl group, a 2-furyl group, a 2-thienyl group, a 2-pyrimidinyl group, etc., including those having a substituent.

The substituents for the aliphatic group, the cycloalkyl group and the aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic group, an alkylthio group, an arylthio group, etc., and these substituents may further have a substituent.

In the above General Formula (XII), $Y^1$ represents a group of nonmetallic atoms necessary for the formation of a morpholine ring or thiomorpholine ring together with a nitrogen atom, and the morpholine ring or thiomorpholine ring may have a substituent, which substituent may include, for example, an alkyl group, a cycloalkyl group, an aryl group, a heterocyclic group, etc.

Typical examples of the compound represented by the above General Formula (XII) are shown below, but the present invention is by no means limited by these.

A-1

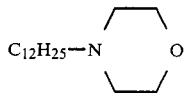

A-2

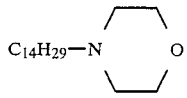

A-3

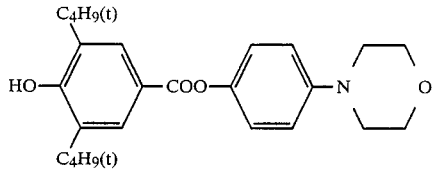

A-4

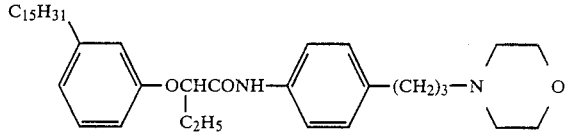

A-5

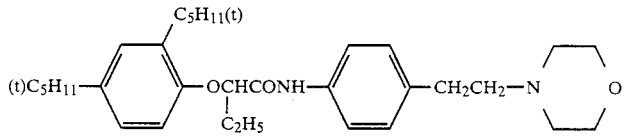

A-6

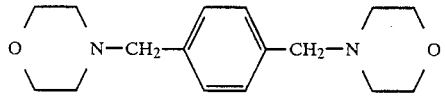

A-7

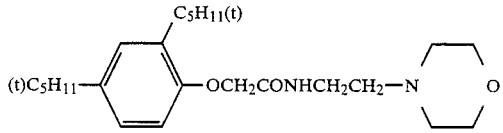

A-8

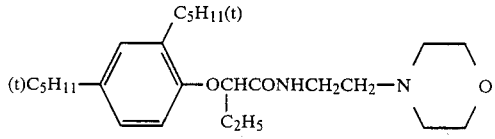

-continued
A-9
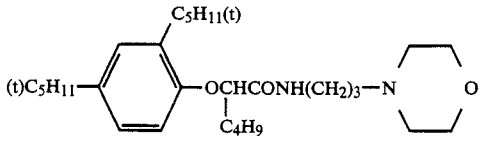
A-10
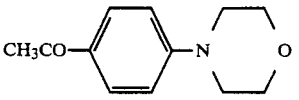
A-11
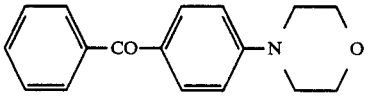
A-12
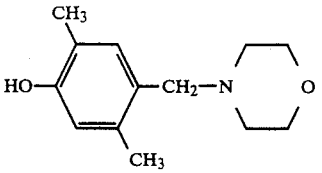
A-13
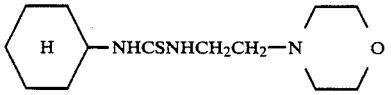
A-14
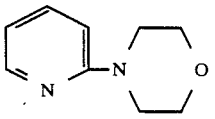
A-15
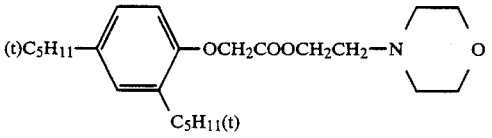
A-16
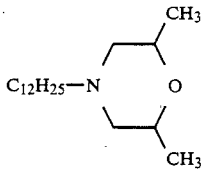
A-17
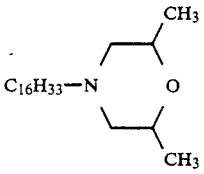
A-18
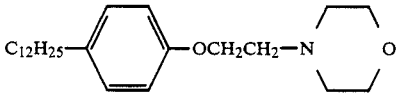
A-19
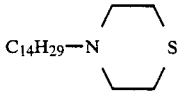

-continued

A-20

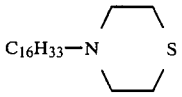

A-21

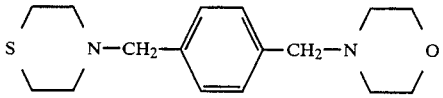

A-22

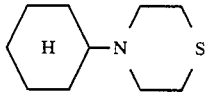

A-23

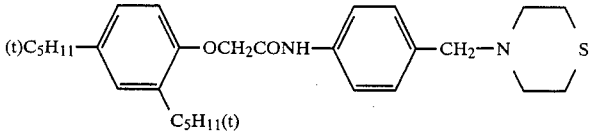

A-24

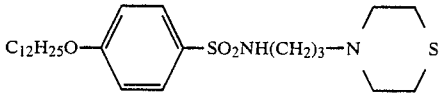

A-25

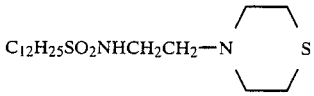

The above magenta dye image stabilizing agents of the present invention are commercially distributed in part, and available with ease. They may also include the compounds disclosed in Japanese Patent Application No. 31297/1985 and No. 85194/1985, and can be also synthesized according to a synthesis method disclosed therein.

They can be also synthesized according to the following synthesis method.

SYNTHESIS EXAMPLE 1

(Synthesis of Exemplary Compound A-7)

In 150 ml of ethyl acetate, 14 g of 4-(3-aminopropyl)-morpholine and 30 g of 2,4-di-t-aminophenoxy acetic acid chloride were dissolved with further addition of 10 mol of pyridine, and the solution was boiled under reflux for 5 hours. Crystals precipitated were removed by filtration, and the filtrate was evaporated under reduced pressure. Residues were recrystalized by use of methanol to obtain 21 g of white crystals. A nuclear magnetic resonance spectrum and a mass spectrum confirmed that obtained was the desired 4-{2-(2,4-di-t-amylphenoxyacetamide)ethyl} morpholine.

SYNTHESIS EXAMPLE 2

(Synthesis of Exemplary Compound A-20)

In 150 ml of ethanol, 11 g of thiomorpholine and 30 g of hexadecyl bromide were dissolved, and thereafter 7 g of potassium hydroxide were added. The solution obtained was boiled under reflux for 5 hours, and then crystals precipitated were removed by filtration, and filtrate was evaporated under reduced pressure. Residues were recrystalized by use of ethanol to obtain 18 g of white scaly crystals.

A nuclear magnetic resonance spectrum and a mass spectrum both supported the structure of 4-hexadecylthiomorpholine.

In the present invention, in addition to the morpholine or thiomorpholine type compound represented by the above General Formula (XII) of the present invention, at least one selected from the compound represented by General Formula (XIIIa) shown below and the compound represented by General Formula (XIIIb) shown below is used in combination with the magenta coupler of the present invention.

The compound represented by General Formula (XIIIa) is a compound of coumaran or chroman type.

General Formula (XIIIa)

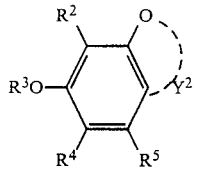

In the formula, $R^2$ and $R^5$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group, or an alkoxycarbonyl group; $R^3$ represents a hydrogen atom, an alkyl group, an alkenyl group, an aryl group, an acyl group, a cycloalkyl group or a heterocyclic group; and $R^4$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^3$ and $R^4$ may be combined each other to form a 5- or 6-membered ring. $R^3$ and $R^4$ may also combined to form a methylenedioxy ring.

$Y^2$ represents a group of atoms necessary for the formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by General Formula (XIIIa), compounds most useful for the present invention are included in the compounds represented by General Formulas (XIVa), (XVa), (XVIa), (XVIIa) and (XIIIa).

General Formula (XIVa)

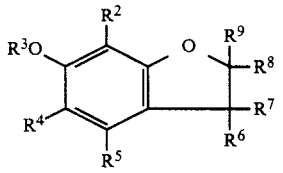

General Formula (XVa)

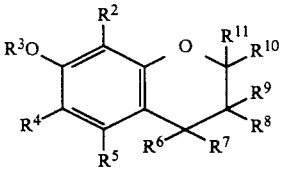

General Formula (XVIa)

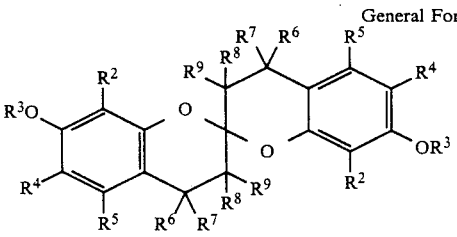

-continued

General Formula (XVIIa)

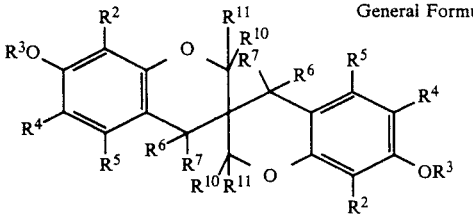

General Formula (XVIIIa)

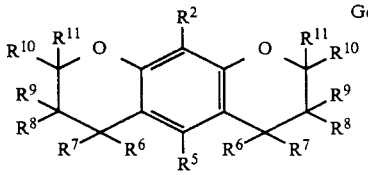

$R^2$, $R^3$ $R^4$ and $R^5$ in General Formulas (XIVa), (XVa), (XVIa), (XVIIa) and (XVIIIa) have the same meaning as those in the above General Formula (XIIIa), and $R^6$, $R^7$, $R^8$, $R^9$ $R^{10}$ and $R^{11}$ each represent a hydrogen atom, a halogen atom, an alkyl group, a cycloalkyl group, an alkoxy group, a hydroxyl group, an alkenyl group, an alkenyloxy group, an aryl group, an aryloxy group or a heterocyclic group.

Also, $R^6$ and $R^7$, $R^7$ and $R^8$, $R^8$ and $R^9$, $R^9$ and $R^{10}$, and $R^{10}$ and $R^{11}$ each may be cyclized each other to form a carbon ring, and such a carbon ring may be further substituted with an alkyl group.

In the above General Formulas (XIVa), (XVa), (XVIa), (XVIIa) and (XVIIIa), particularly useful compounds are those in which $R^2$ and $R^5$ are each a hydrogen atom, an alkyl group, an alkoxy group, a hydroxyl group or a cycloalkyl group; $R^3$ and $R^4$ are each a hydrogen atom, an alkyl group or a cycloalkyl group; and $R^6$, $R^7$, $R^8$, $R^9$, $R^{10}$, and $R^{11}$ are each a hydrogen atom, an alkyl group or a cycloalkyl group.

Typical examples of these compounds are shown below, but the compounds used in the present invention are by no means limited by these.

CH-1

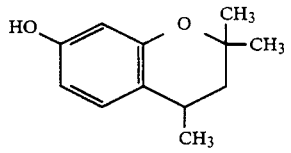

CH-2

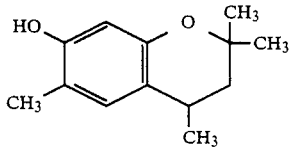

-continued
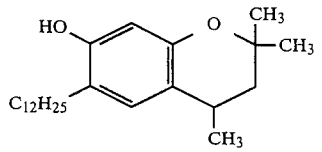
CH-3
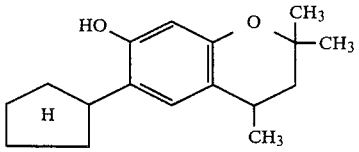
CH-4
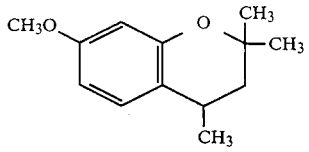
CH-5
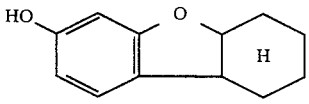
CH-6
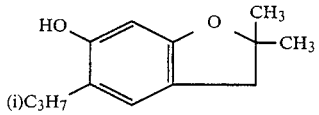
CH-7
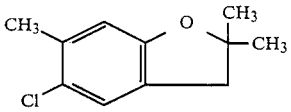
CH-8
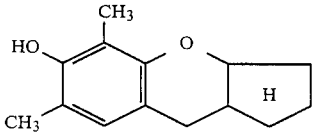
CH-9
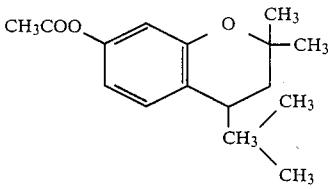
CH-10
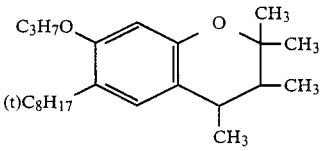
CH-11
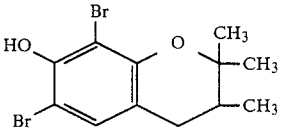
CH-12

-continued
CH-13
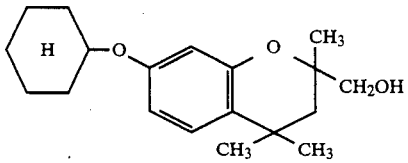
CH-14
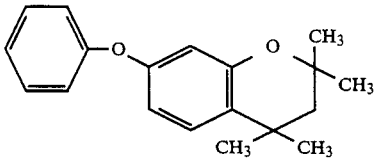
CH-15
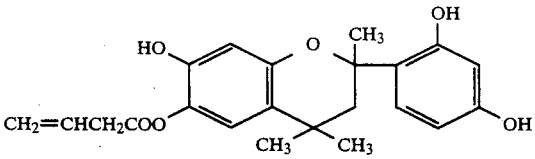
CH-16
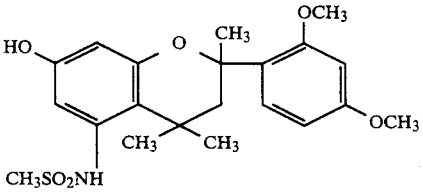
CH-17
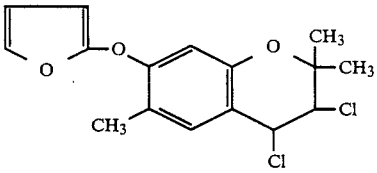
CH-18
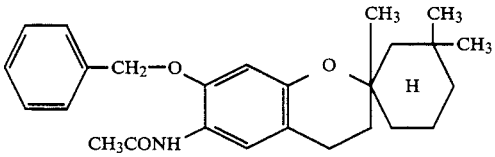
CH-19
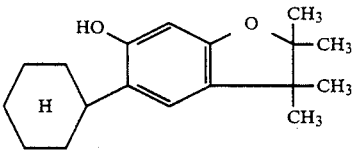
CH-20
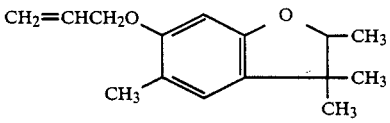
CH-21
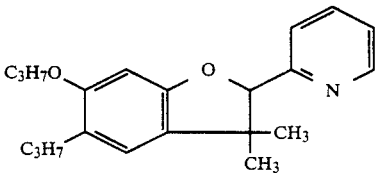

-continued
CH-22
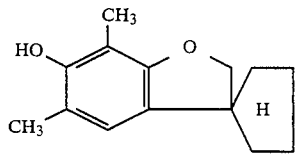
CH-23
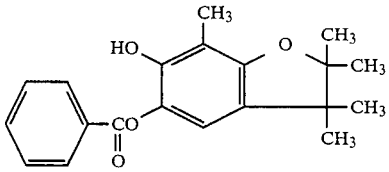
CH-24
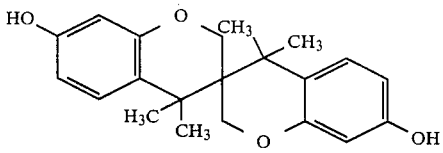
CH-25
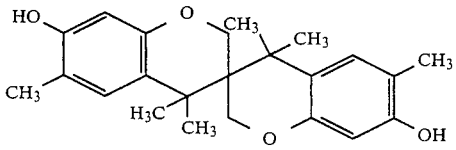
CH-26
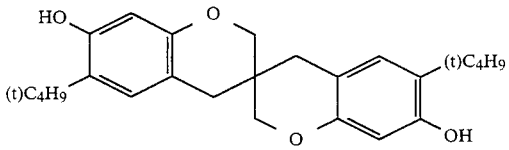
CH-27
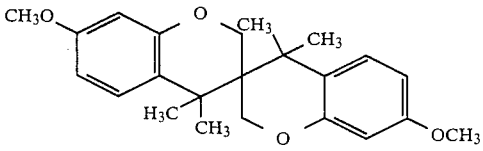
CH-28
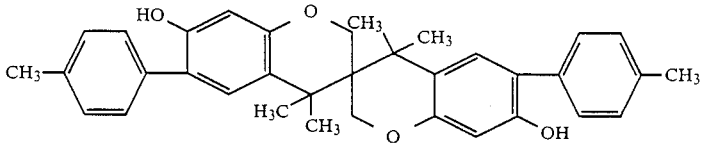
CH-29
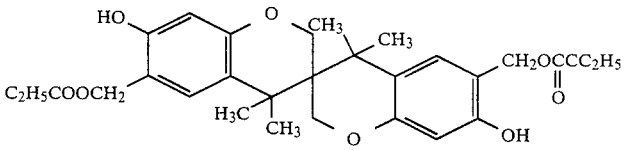
CH-30
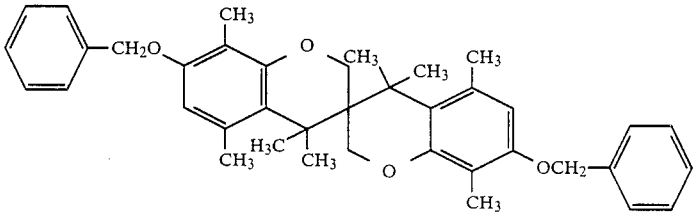

-continued
CH-31
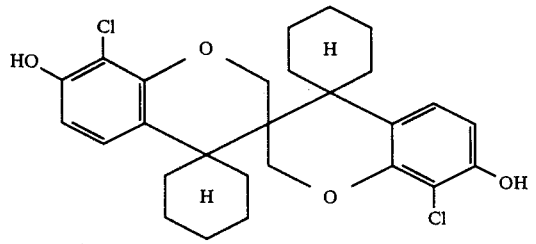
CH-32
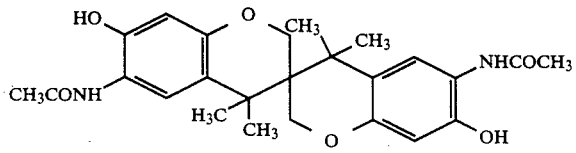
CH-33
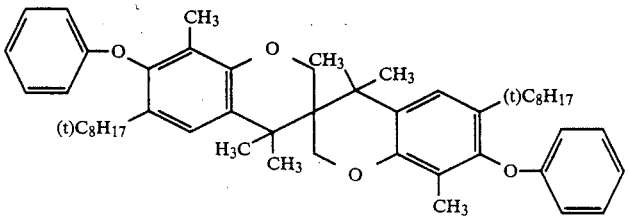
CH-34
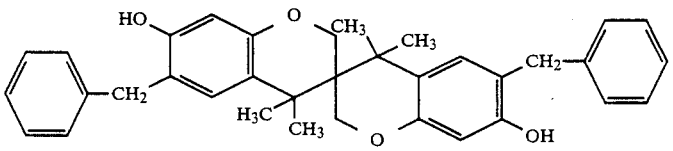
CH-35
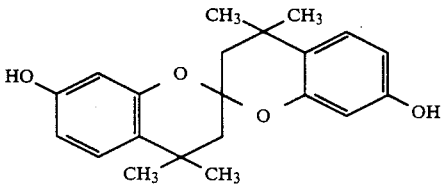
CH-36
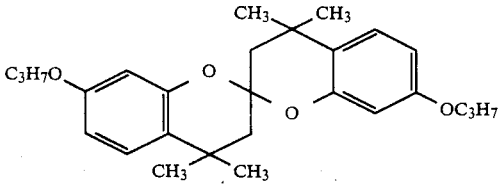
CH-37
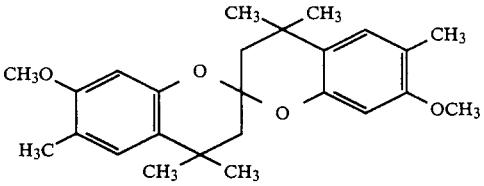
CH-38
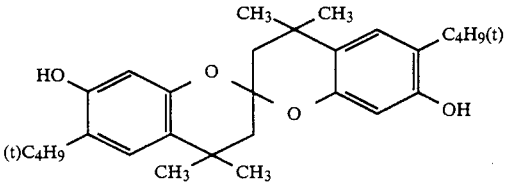

-continued
CH-39
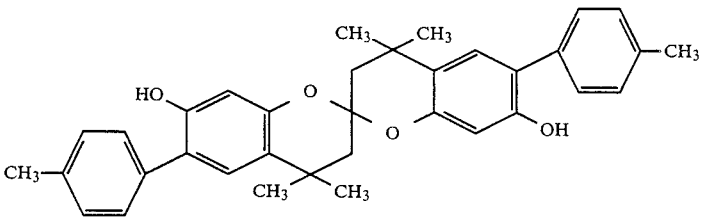
CH-40
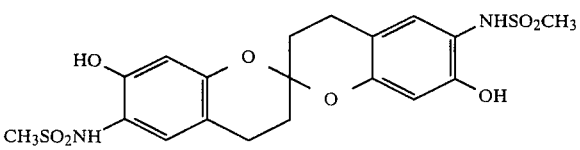
CH-41
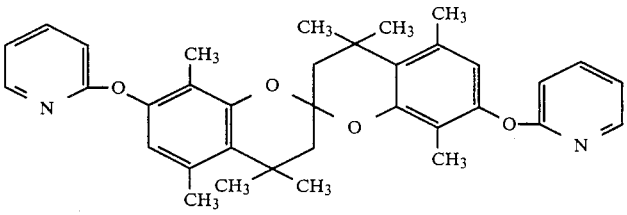
CH-42
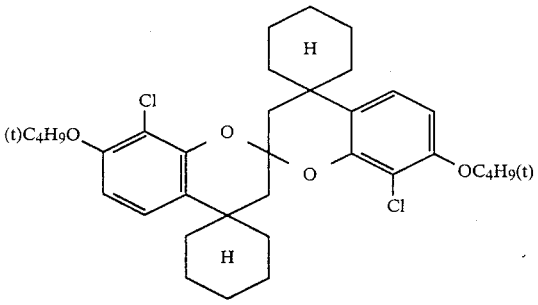
CH-43
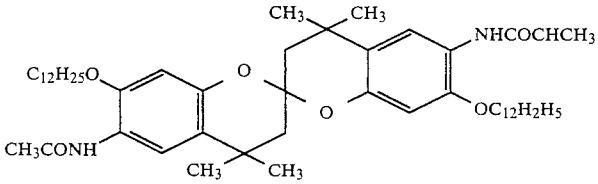
CH-44
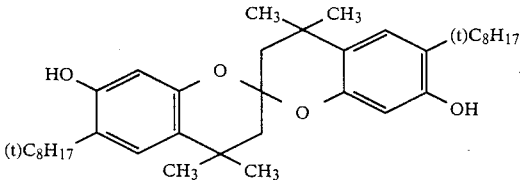
CH-45
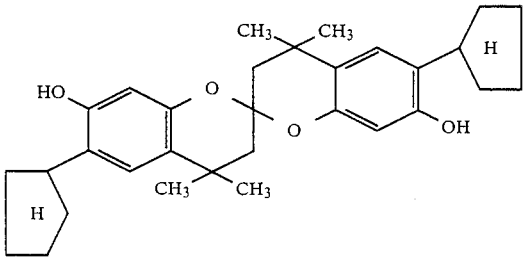

-continued

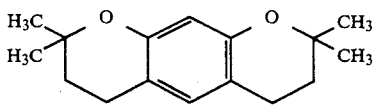

CH-46

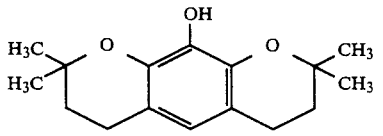

CH-47

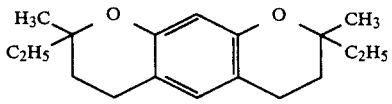

CH-48

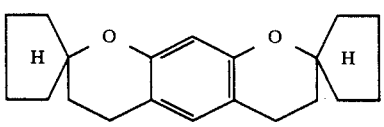

CH-49

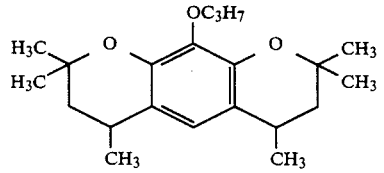

CH-50

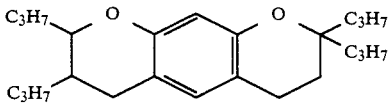

CH-51

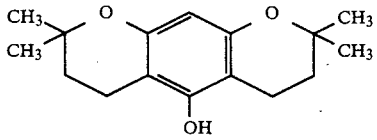

CH-52

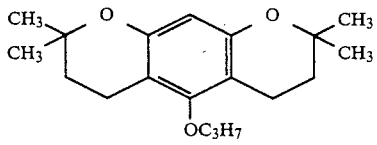

CH-53

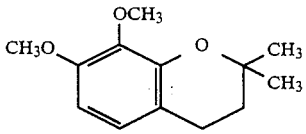

CH-54

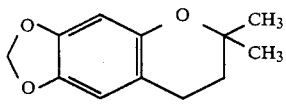

CH-55

The compounds represented by General Formula (XII) include the compounds disclosed in Tetrahedron Letters, 1970, Vol. 126, pp 4743–4751; Japan Chemical Society, 1972, No. 10, pp 0987–1990; Chem. Letter., 1972, (4), pp 315–316 and Japanese Patent O.P.I. Publication No. 139383/1980, and may be synthesized by the methods also disclosed in these publications.

On the other hand, the compound represented by General Formula (XIIIb) shown below is a compound of hydroxyindane type.

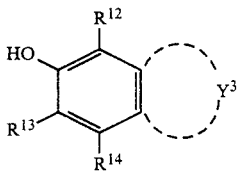

General Formula (XIIIb)

In the formula, $R^{12}$ and $R^{14}$ each represent a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group.

Specific example of the halogen atom, the alkyl group, the alkenyl group, the alkoxy group, the hydroxyl group, the aryl group, the aryloxy group, the acyl group, the acylamino group, the acyloxy group, the sufonamide group, the cycloalkyl group or the alkoxycarbonyl group represented by $R^{12}$ and $R^{14}$ may include the groups set out in detail for R in General Formula (I).

$R^{13}$ represents a hydrogen atom, a halogen atom, an alkyl group, an alkenyl group, a hydroxyl group, an aryl group, an acyl group, an acylamino group, an acyloxy group, a sulfonamide group, a cycloalkyl group or an alkoxycarbonyl group. Specific examples of the halogen atom, the alkyl group, the alkenyl group, the aryl group, the acyl group, the acylamino group, the acyloxy group, the sulfonamide group, the cycloalkyl group or the alkoxycarbonyl group represented by $R^{13}$ may include the groups set out in detail for R in General Formula (I).

The above-mentioned groups each may be substituted with other substituent, which substituent may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^{13}$ and $R^{14}$ may be combined each other to form a 5- or 6-membered hydrocarbon ring. This 5- or 6-membered hydrocarbon ring may be substituted with a halogen atom, an alkyl group, a cycloalkyl group, an alkoxy group, an alkenyl group, a hydroxyl group, an aryl group, an aryloxy group or a heterocyclic group.

$Y^3$ represents a group of atoms necessary for the formation of an indane ring. The indane ring may be substituted with a halogen atom, an alkyl group, an alkenyl group, an alkoxy group, a cycloalkyl group, a hydroxyl group, an aryl group, an aryloxy group or a heterocyclic group, or may further form a spiro ring.

Of the compounds represented by General Formula (XIIIb), compounds most useful for the present invention are included in the compounds represented by General Formulas (XIVb), (XVb) and (XVIb).

General Formula (XIVb)

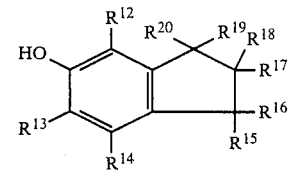

General Formula (XVb)

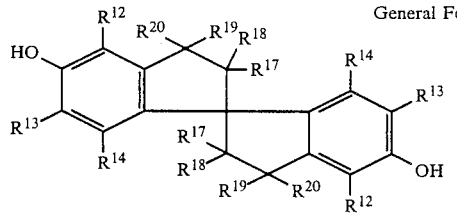

General Formula (XVIb)

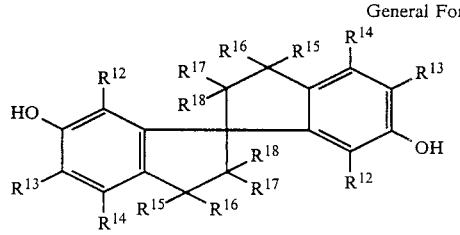

$R^{12}$, $R^{13}$ and $R^{14}$ in General Formulas (XIVb) to (XVIb) have the same meaning as those in the above General Formula (XIIIb), and $R^{15}$, $R^{16}$, $R^{17}$, $R^{18}$, $R^{19}$ and $R^{20}$ each represent a hydrogen atom, a halogen atom, an alkyl group, an alkoxy group, an alkenyl group, a hydroxyl group, an aryl group, an aryloxy group or a heterocyclic group. $R^{15}$ and $R^{16}$, $R^{16}$ and $R^{17}$, $R^{17}$ and $R^{18}$, $R^{18}$ and $R^{19}$, and $R^{19}$ and $R^{20}$ each may be combined each other to form a hydrocarbon ring, and such a hydrocarbon ring may be further substituted with an alkyl group.

In the above General Formulas (XIVb) to (XVIb), particularly useful compounds are those in which $R^{12}$ and $R^{14}$ are each a hydrogen atom, an alkyl group, an alkoxy group, a hydroxyl group or a cycloalkyl group; $R^{13}$ is hydrogen atom, an alkyl group, a hydroxyl group or a cycloalkyl group; and R15, $R^{15}$, $R^{16}$, $R^{17}$, $R^{18}$ $R^{19}$ and $R^{20}$ are each a hydrogen atom, an alkyl group or a cycloalkyl group.

Specific examples of these compounds are shown belwo, but the compounds used in the present invention are by no means limited by these.

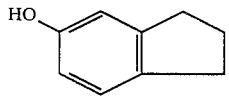

HI-1

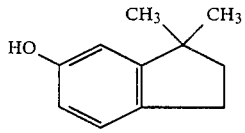

HI-2

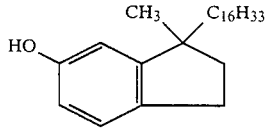

HI-3

-continued
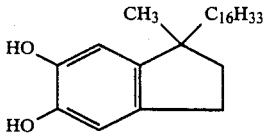
HI-4
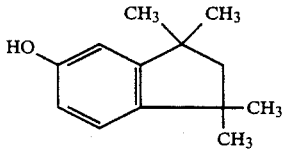
HI-5
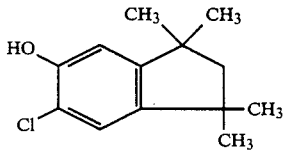
HI-6
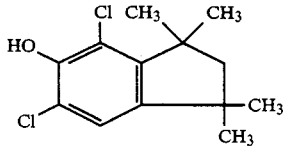
HI-7
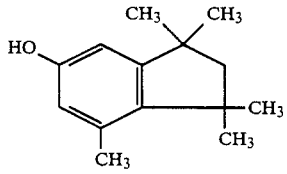
HI-8
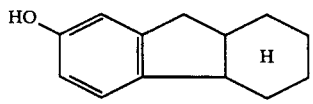
HI-9
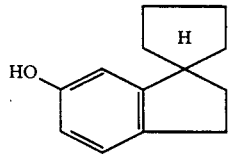
HI-10
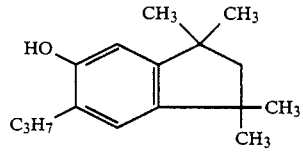
HI-11
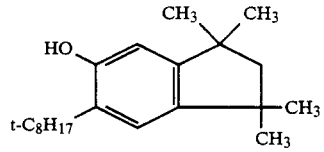
HI-12
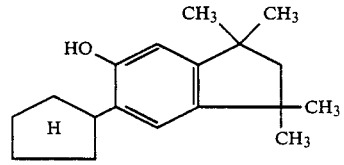
HI-13

-continued
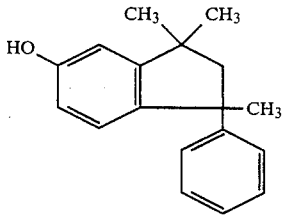
HI-14
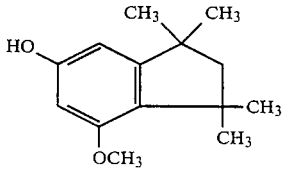
HI-15
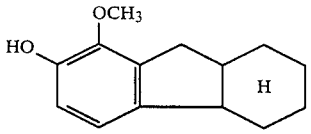
HI-16
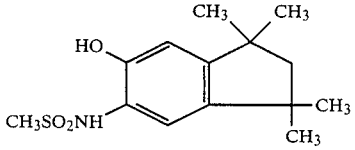
HI-17
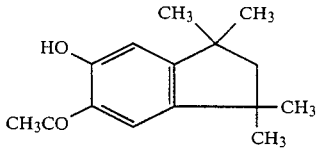
HI-18
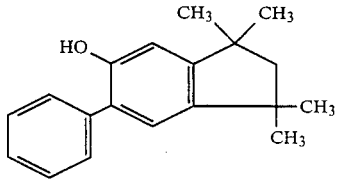
HI-19
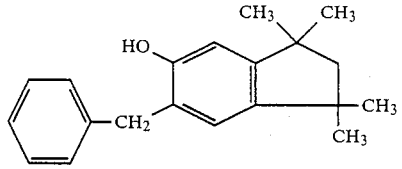
HI-20
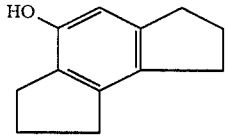
HI-21
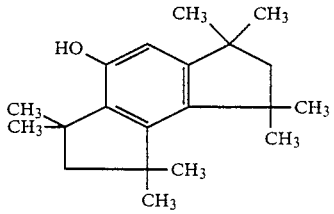
HI-22

-continued
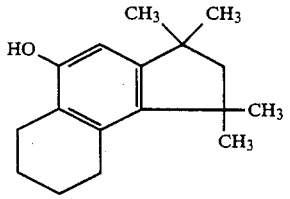
HI-23
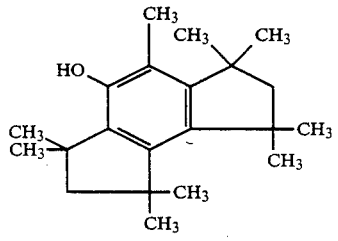
HI-24
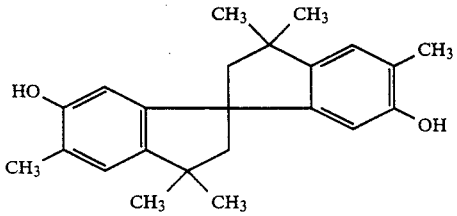
HI-25
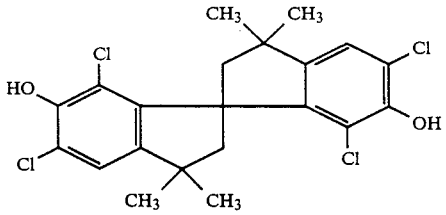
HI-26
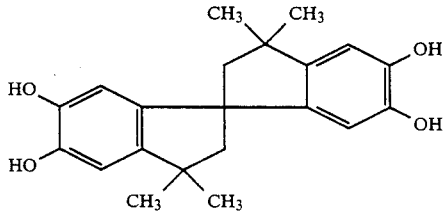
HI-27
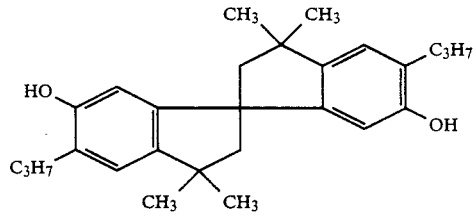
HI-28
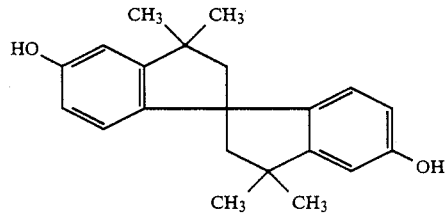
HI-29

-continued
HI-30
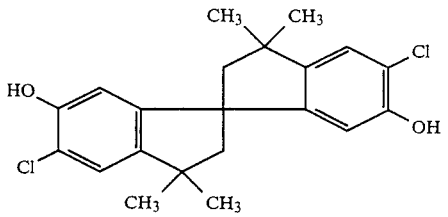
HI-31
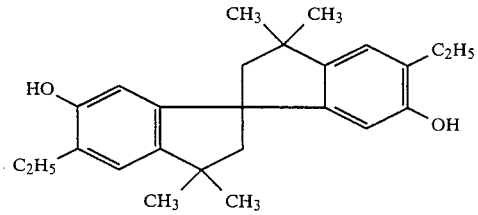
HI-32
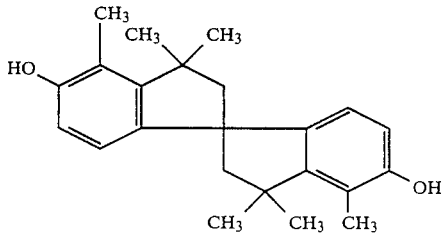
HI-33
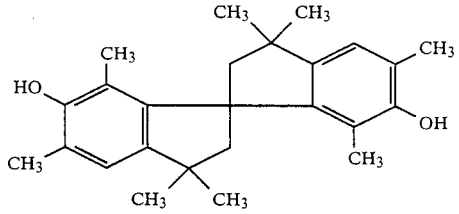
HI-34
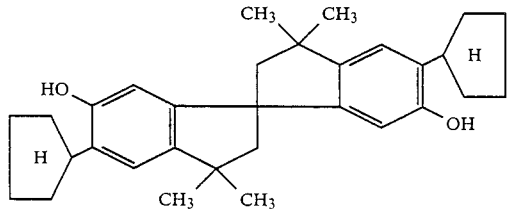
HI-35
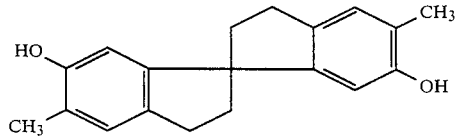
HI-36
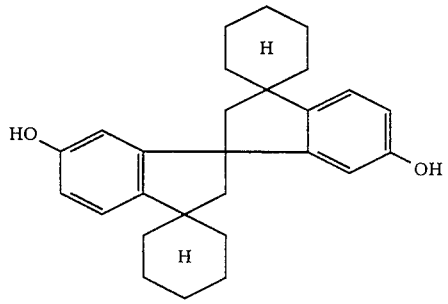

-continued
HI-37
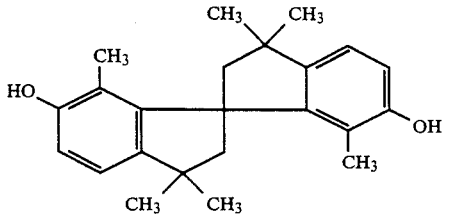
HI-38
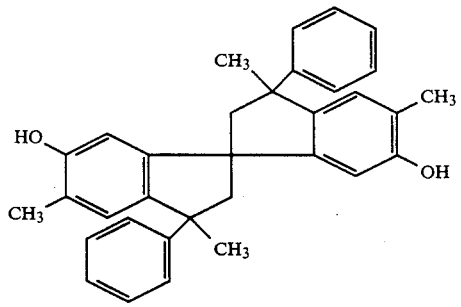
HI-39
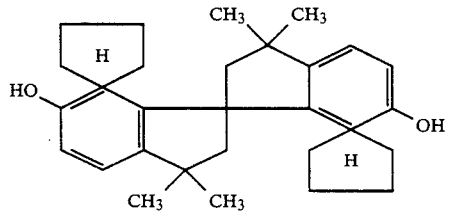
HI-40
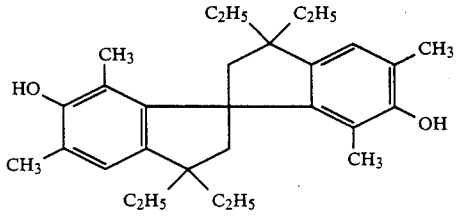
HI-41
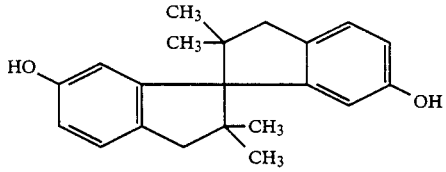
HI-42
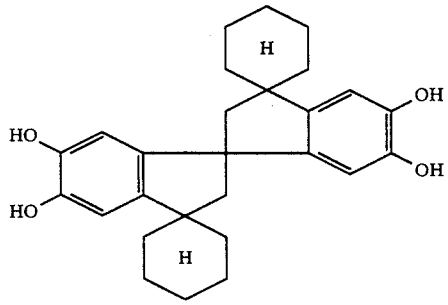

-continued

HI-43

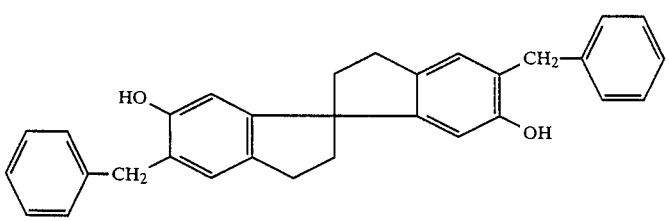

HI-44

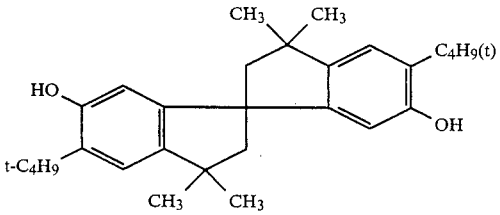

HI-45

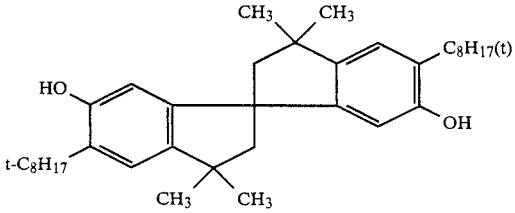

The method of synthesizing the dye image stabilizing agents represented by the above General Formulas (XIIIb) and (XIVb) to (XVIb) is known in the art, and they can be produced following the disclosure in Journal of Chemical Society, 1962, 415–417; Japanese Patent Examined Publication No. 32785/1984; or Bulletin of Chemical Society of Japan, 1980, 53, pp.555-556.

The dye image stabilizing agent of the present invention, represented by the above General Formula (XIIIb), is disclosed in Japanese Patent Examined Publication No. 32785/1984, and used as a stabilizing agent for a magenta dye image obtained form a pyrazolone, indazolone or cyanoacetyl type magenta coupler. There is a disclosure that it is particularly useful as a stabilizing agent for a magenta dye image obtained from a 5-pyrazolone type magenta coupler. However, there is no disclosure that it is useful as the stabilizing agent for the magenta dye images obtained from the magenta coupler of the present invention, which has structure different from the above magenta couplers. Moreover, quite unexpectable form the above publication is that an unexpected unique effect on the preservativity of the magenta dye image obtained form the magenta coupler of the present invention is exhibited when it is used in combination with the magenta dye image stabilizing agent represented by the above General Formula (XII).

The magenta dye image stabilizing agent of the present invention, represented by the above General Formula (XII), General Formula (XIIIa), and General Formula (XIIIb) may be used preferably in an amount of 5 to 400 mole %, more preferably 10 to 250 mole %, based on the magenta coupler of the present invention, represented by the above General Formula (I).

When two compounds of the compound represented by General Formula (XII) and the compound represented by General Formula (XIIIa), of the present invention are used in combination, and when two compounds of the compound of the above General Formula (XII) and the compound represented by the above General Formula (XIIIb), of the present invention are used in combination, the magenta dye image stabilizing agent may be used preferably in an amount, in total, of 10 to 500 mole %, more preferably 20 to 400 mole %, based on the magenta coupler of the present invention.

Also, the compound represented by the above General Formula (XII) and the compound represented by the above General Formula (XIIIa) or the above General Formula (XIIIb) may be used preferably in the ratio, in molar ratio, ranging between 0.1 and 10, more preferably 0.25 to 4.0.

When three compounds of the compounds represented respectively by the above General Formula (XII), the above General Formula (XIIIa) and the above General Formula (XIIIb) are used in combination, the magenta dye image stabilizing agent may be used preferably in an mount, in total, of 15 to 500 mole %, more preferably 30 to 400 mole %, based on the magenta coupler of the present invention.

When three compounds of these magenta dye image stabilizing agents are used, each of the dye image stabilizing agents may be used preferably in an amount of 5 to 90 moles %, more preferably 10 to 70 mole %, of the amount of all the dye image stabilizing agents used.

In the light-sensitive silver halide photographic material of the present invention, phenol compounds or phenyl ether compounds disclosed, for example, in U.S. Pat. Nos. 3,935,016, No. 3,982,944 and U.S. Pat. No. 4,254,216, Japanese Patent O.P.I. Publications No. 21004/1980 and No. 145530/1979, British Patent Publications No. 2,077,455 and No. 2,062,888, U.S. Pat. No. 3,764,337, No. 3,432,300, No. 3,574,627 and No. 3,573,050, Japanese Patent O.P.I. Publications No. 152225/1977, No. 20327/1978, No. 17729/1978, No. 6321/1980, No. 48538/1979 and No. 159644/1981, British Patent No. 1,347,556, British Patent Publication No. 2,066,975, Japanese Patent Examined Publications No. 12337/1979 and No. 31625/1973, U.S. Pat. No. 3,700,455, etc. may be used together with the above magenta dye image stabilizing agent of the present invention.

The magenta coupler of the present invention and the magenta dye image stabilizing agent of the present invention are preferably used in the same layer, but said stabilizing agent may be used in a layer contiguous to a layer in which said coupler is present.

The light-sensitive silver halide photographic material of the present invention may include, for example, color negative films, color positive films, color photographic paper and so forth, but, in particular, the effect of the present invention can be effectively exhibited when used in the color photographic paper used for direct appreciation.

The light-sensitive silver halide photographic material of the present invention, including the color photographic paper, may be for use in monochrome or multicolor. In the case of the light-sensitive silver halide photographic material for multicolor photography, the light-sensitive material has usually such structure that silver halide emulsion layers containing magenta couplers, yellow couplers and cyan couplers, respectively, as couplers for photography are laminated on a support in a suitable number and order of the layers to effect subtractive color reproduction, but the number and order of the layers may be appropriately varied depending on what are important performances and what the materials are used for.

In the silver halide emulsion used in the light-sensitive silver halide photographic material of this invention, there can be used any of silver bromide, silver iodobromide, silver iodochloride, silver chlorobromide, silver chloride, etc. which are used in ordinary silver halide emulsions.

Silver halide grains used in the silver halide emulsions may be obtained by any of an acidic method, a neutral method and an ammoniacal method. The grains may be allowed to grow at one time, or grow after seed grains have been formed. The manner to prepare the seed grains and the manner to grow them may be same or different.

The silver halide emulsion may be obtained by simultaneously mixing halide ions and silver ions, or by preparing an aqueous solution in which either one of them is present and then mixing in it the other of them. Alternatively, taking into account the critical growth rate of silver halide crystals, it may be formed by successively simultaneously adding halide ions and silver ions while controlling pH and pAg in a mixing vessel. Halogen formulation in a grain may be varied after growth by employing a conversion method.

During the preparation of the silver halide emulsion of this invention, a silver halide solvent can be optionally used for controlling the grain size, grain shape, grain size distribution and grain growth rate, of the silver halide grains.

In the course of formation and/or growth of the silver halide grains used in the silver halide emulsion, metal ions may be added to the grains by use of at least one of a cadmium salt, a zinc salt, a lead salt, a thallium salt, an iridium salt or a complex salt thereof, a rhodium salt or a complex salt thereof, and an iron salt or a complex salt thereof to incorporate any of these metal elements into the inside of the grains and/or the surface of the grains, and also a reduction sensitizing nuclei can be imparted to the inside of the grains and/or the surface of the grains by placing the grains in a suitable reductive atmosphere.

The silver halide emulsion may be either one from which unnecessary soluble salts have been removed after completion of the growth of silver halide grains, or one from which they remain unremoved. When the salts are removed, they can be removed according to the method disclosed in Research Disclosure No. 17643.

The silver halide grains used in the silver halide emulsion may comprise uniform layers in the inside and the surface, or comprise different layers.

The silver halide grains used in the silver halide emulsion may be grains such that a latent image is formed chiefly on the surface, or grains such that a latent image is formed chiefly in the inside of a grain.

The silver halide grains used in the silver halide emulsion may be any of those having a regular crystal form, or those having an irregular crystal form such as a sphere and a plate. In these grains, there can be used those having any ratio of {100} face to {111} face. Also, they may have a composite form of these crystal forms, or comprise a mix of grains having various crystal forms.

The silver halide emulsion may be used by mixing two or more kinds of silver halide emulsions which have been separately formed.

The silver halide emulsion can be chemically sensitized according to conventional methods. Namely, a sulfur sensitization method using a compound containing sulfur capable of reacting with silver ions, and active gelatin, a selenium sensitization method using a selenium compound, a reduction sensitization method using a reducing substance, and a noble metal sensitization method using noble metal compounds such a gold and so forth can be used alone or in combination.

The silver halide emulsion can be optically sensitized to a desired wavelength region by using a dye known as a sensitizing dye in the field of photography. The sensitizing dye may be used alone, or may be used in combination of two or more of the dye. Together with the sensitizing dye, a dye having itself no action of spectral sensitization, or a supersensitizing agent which is a compound substantially absorbing no visible light and capable of strengthening the sensitizing action of the sensitizing dye, may be contained in the emulsion.

To the silver halide emulsion, a compound known as an antifoggant or a stabilizer in the field of photography can be added during chemical ripening, and/or after completion of chemical ripening, and/or before coating of a silver halide emulsion after completion of chemical ripening, for the purpose of preventing a light-sensitive material from being fogged during production of light-sensitive materials, during preservation or during photographic processing, or for the purpose of keeping stable the photographic performances.

As a binder (or a protective colloid) for the silver halide emulsion, it is advantageous to use gelatin, but it is also possible to use hydrophilic colloids such as gelatin derivatives, a graft polymer of gelatin with other macromolecules, proteins, sugar derivatives, cellulose derivatives and synthetic hydrophilic high molecular substances such as homopolymer or copolymer.

Photographic emulsion layers and other hydrophilic colloid layers of the light-sensitive material in which the silver halide emulsion is used can be hardened by using one or more kinds of hardening agents that can cross-link binder (or protective colloid) molecules to enhance the film strength. The hardening agents can be added in such an amount that a light-sensitive material can be hardened to the extent that no hardening agent is required to be added in a processing solution. It, however, is also possible to add the hardening agent in the processing solution.

A plasticizer can be added o the silver halide emulsion layer and/or other hydrophilic colloid layers of the light-sensitive material, in which the silver halide emulsions are used, for the purpose of enhancing flexibility.

For the purpose of improving dimensional stability and the like, a dispersion (latex) of a water insoluble or hardly soluble synthetic polymer can be contained in the photographic emulsion layers and other hydrophilic colloid layers in which the silver halide emulsions are used,.

In a color developing processing, a dye-forming coupler capable of forming a dye through a coupling reaction with an oxidized product of an aromatic primary amine developing agent (for example, p-phenylenediamine derivatives, aminophenol derivatives, etc.) is used in the emulsion layers of the light-sensitive material of this invention. In a usual case, the dye forming coupler is selected in the manner that there can be formed a dye capable of absorbing light-sensitive spectral light in an emulsion layer with respect to the respective emulsion layers, and thus a yellow dye-forming coupler is used in a blue-sensitive emulsion layer; a magenta dye-forming coupler, in a green-sensitive emulsion layer; and a cyan dye-forming coupler, in a red-sensitive emulsion layer. However, the light-sensitive silver halide color photographic material may be prepared by using the couplers in the manner different from the above combination, depending on the purpose.

Yellow dye-forming couplers may include acyl acetamide couplers (for example, benzoylacetanilides and pivaloylacetanilides). Magenta dye-forming couplers may include, besides the couplers of the present invention, 5-pyrazolone couplers, pyrazolobenzimidazole couplers, pyrazolotriazole couplers, closed acylacetonitrile couplers, etc. Cyan dye-forming couplers may include naphthol couplers, phenol couplers, etc.

These dye synthesizing couplers may preferably comprise a group having 8 or more carbon atoms, which can make a coupler called a ballast group non-diffusible in the molecule. Also, these dye-forming couplers may be any of the four equivalent type in which four molecules of silver ions must be reduced in order to form one molecule of a dye, and the two equivalent type in which only two molecules of silver ions may be reduced.

To add hydrophilic compounds such as dye-forming couplers which are not required to be absorbed on the surface of silver halide crystals, there can be used a variety of methods such as a solid dispersion method, a latex dispersion method and and an oil-in-water emulsification dispersion method. This can be suitably selected depending on the chemical structure of the hydrophobic compounds such as couplers. As the oil-in-water emulsification dispersion method, a conventionally known method for dispersing hydrophobic additives such as couplers can be applied. Usually, the method may be carried out by dissolving the couplers in a high boiling organic solvent having a boiling point of 150° C. or more optionally together with a low boiling and/or water soluble organic solvent, and carrying out emulsification dispersion in a hydrophilic binder such as an aqueous gelatin solution by use of a surface active agent and by use of a dispersing means such as a stirrer, a homogenizer, a colloid mill, a flow jet mixer, an ultrasonic device, followed by adding the dispersion to an intended hydrophilic colloid layer. There may be inserted a step of removing the dispersing solution or, at the same time of the dispersion, the low boiling organic solvent.

The high boiling solvent to be used may include organic solvent having a boiling point of 150° C. or more such as phenol derivatives, phthalates, phosphates, citrates, benzoates, alkyl amides, aliphatic acid esters and trimesic acid esters which do not react with an oxidized product of a developing agent.

As a dispersion auxiliary used when the hydrophobic compound is dissolved in the solvent comprising the low boiling solvent alone, or the solvent in which the high boiling solvent is used together, and then dispersed in water with use of a mechanical or ultrasonic means, there can be used an anionic surface active agent, a nonionic surface active agent and a cationic surface active agent.

A color fog preventive agent can be used in order to prevent color turbidity from being caused by the migration of an oxidized product or an electron migrator of a developing agent between emulsion layers (between the same color sensitive layers and/or different color sensitive layers) of the light-sensitive material of the present invention, or prevent the deterioration of sharpness or prevent overly conspicuous graininess.

The color fog preventive agent may be contained in the emulsion layers per se, or may be contained in an intermediate layer by providing the intermediate layer between adjacent emulsion layers.

Hydrophilic colloid layer such as protective layers and intermediate layers of the light-sensitive material of the present invention may contain an ultraviolet absorbent in order to prevent the fog due to the discharge caused by static charge by friction or the like of light-sensitive materials and prevent the deterioration due to ultraviolet light.

The light-sensitive silver halide material using the silver halide emulsion can be provided with auxiliary layer such as filter layer, an anti-halation layer and an ant-irradiation layer. These layers and/or the emulsion layers may contain a dye that may be flowed out of the light-sensitive material, or bleached, during the development processing.

To the silver halide emulsion layers and/or other hydrophilic colloid layers of the light-sensitive material using the silver halide emulsion, a matte agent can be added for the purposes of decreasing the gloss of the light-sensitive material, improving the writing performance, and preventing mutual sticking of light-sensitive materials.

A lubricant can be added to the light-sensitive material using the silver halide emulsion, in order to decrease sliding friction.

An antistatic agent aiming at preventing static charge can be added to the light-sensitive material using the silver halide emulsion of the present invention. The antistatic agent may be used in an antistatic layer provided on the side of a support at which no emulsion layer is laminated, or may be used in an emulsion layer and/or a protective colloid layer other than the emulsion layers provided on the side of a support on which emulsion layers are laminated.

In the photographic emulsion layers and/or other hydrophilic colloid layers of the light-sensitive material using the silver halide emulsion, a variety of surface active agents can be used for the purpose of improving coating performance, preventing static charge, improving slidability, emulsification dispersion, preventing adhesion, and improving photographic performances (such as development acceleration, hardening and sensitization).

The light-sensitive material using the silver halide emulsion can be applied on flexible reflective supports made of baryta paper, paper laminated with α-olefin polymers or synthetic paper; films comprising semisynthetic or synthetic high molecular compounds such as cellulose acetate, cellulose nitrate, polystyrene, polyvinyl chloride, polyethylene terephthalate, polycarbonate and polyamide; rigid bodies such as glass, metals and ceramics; etc.

The light-sensitive silver halide material of the present invention may be applied, as occasion calls, after having been subjected to corona discharging, ultraviolet irradiation, flame treatment and so forth, directly on the surface of the support or through interposition of one or more subbing layer(s) for improving adhesion, antistatic performance, dimensional stability, abrasion resistance, hardness, anti-halation performance, friction characteristics and/or other characteristics of the surface of the support.

In the coating of the light-sensitive material, using the silver halide emulsion, a thickening agent may be used in order to improve the coating performance. Particularly useful coating method may include extrusion coating and curtain coating by which two or more layers can be simultaneously coated.

The light-sensitive material of the present invention can be exposed by use of electromagnetic wave having the spectral region to which the emulsion layers constituting the light-sensitive material of the present invention have the sensitivity. As a light source, there can be used any known light sources including natural light (sunlight), a tungsten lamp, a fluorescent lamp, a mercury lamp, a xenon arc lamp, a carbon arc lamp, a xenon flash lamp, a cathode ray tube flying spot, every kind of laser beams, light from a light-emitting diode, light emitted from a fluorescent substance energized by electron rays, X-rays, gamma-rays, alpha-rays, etc.

As for the exposure time, it is possible to make exposure, not to speak of exposure of 1 millisecond to 1 second usually used in cameras, or not more than 1 microsecond, for example, 100 microseconds to 1 microsecond by use of a cathode ray tube or a xenon arc lamp, and it is also possible to make exposure longer than 1 second. Such exposure may be carried out continuously or may be carried out intermittently.

The light-sensitive silver halide photographic material of the present invention can form images by carrying out color development known in the present industrial field.

The color developing agent used for a color developing solution in the present invention includes known ones widely used in the various color photographic processes. These developing agents include aminophenol type and p-phenylenediamine type derivatives. These compounds, which are more stable than in a free state, are used generally in the form of a salt, for example, in the form of a hydrochloride or a sulfate. Also, these compounds are used generally in concentration of about 0.1 to 30 g per 1 liter of a color developing solution, preferably in concentration of about 1 to 15 g per 1 liter of a color developing solution.

The aminophenol type developing agent may include, for example, o-aminophenol, p-aminophenol, 5-amino-2-oxytoluene, 2-amino-3-oxy-toluene, 2-oxy-3-amino-1,4-dimethyl-benzene, etc.

Most useful primary aromatic amine type color developing agent includes N,N'-dialkyl-p-phenylenediamine compound, wherein the alkyl group and the phenyl group may be substituted with any substituent. Of these, examples of particularly useful compounds may include N-N'-dimethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, etc.

In this invention, after color developing processing, processing by use of a processing solution having fixing ability is carried out. When the processing solution having fixing ability is a fixing solution, a bleaching is carried out beforehand. As a bleaching agent used in the bleaching step, there may be used a metal complex salt of an organic acid. The metal complex salt has an action to oxidize a metal silver formed by development to allow it to revert to silver halide, and, at the same time, color-develop a non-image portion of a coupler. It has the structure in which an ion of a metal such as iron, cobalt, cupper, etc. is coordinated with an organic acid such as an aminopolycarboxylic acid or oxalic acid, citric acid, etc. The organic acid most preferably used for the formation of the metal complex salt of such an organic acid may include polycarboxylic acid or aminopolycarboxylic acid. The polycarboxylic acid or aminopolycarboxylic acid may be in the form of an alkali metal salt, an ammonium salt or a water soluble amine salt.

Typical examples of these may include the following:

(1) Ethylenediaminetetraacetic acid
(2) Nitrilotriacetic acid
(3) Iminodiacetic acid
(4) Disodium ethylenediaminetetraacetate
(5) Tetra(trimethylammonium) ethylenediaminetetraacetate
(6) Tetrasodium ethylenediaminetetraacetate
(7) Sodium nitrilotriacetate A bleaching solution to be used may contain as the bleaching agent the above metal complex salt of the organic acid, and also contain various additives. Preferably, the additives to be contained may include, in particular, re-halogenating agents such as an alkali halide and an ammonium halide, for example, potassium bromide, sodium bromide, sodium chloride, ammonium bromide, etc., a metal salt and a chelating agent. Also, there may be optionally added those which are known to be usually added to a bleaching solution, including pH buffering agents such as borate, oxalate, acetate, carbonate and phosphate, alkylamines, polyethyleneoxides, etc.

Further, the fixing solution and bleach-fixing solution may contain a pH buffering agent including sulfites such as ammonium sulfite, potassium sulfite, ammonium bisulfite, potassium bisulfite, sodium bisulfite, ammonium metabisulfite, potassium metabisulfite and sodium metabisulfite, and boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide, etc., which may be added singularly or in combination of two or more.

When the processing of this invention is carried out while replenishing a bleach-fixing replenishing agent in a bleach-fixing solution (or bath), the bleach-fixing solution (or bath) may contain a thiosulfate, a thiocyanate or a sulfite, etc., or these salts may be contained in a bleach-fixing replenishing solution which is replenished to the processing bath.

In this invention, if desired, blowing of air or blowing of oxygen may be carried out in the bleach-fixing bath and in a storage tank for the bleach-fixing replenishing solution in order to enhance the activity in the bleach-fixing solution, or a suitable oxidizing agent including, for example, hydrogen peroxide, bromate, persulfate, etc., may be added.

The light-sensitive silver halide photographic material of the present invention not only has excellent color reproducibility and suffers less generation of Y-stain at a non-image portion against light, moisture and heat, but also can remarkably improve the fastness to light, of a magenta dye image, and also can prevent change in color against light.

The present invention will be described below specifically by showing Examples, but embodiments of the present invention are by no means limited by these.

EXAMPLE 1

A paper support laminated on both sides thereof with polyethylene was provided by coating with the following respective layers in the manner consecutive from the support side.

First layer: Emulsion layer

Applied were magenta Coupler 44 of the present invention to have a coating amount of 6.0 mg/100 cm $^2$; silver chlorobromide (containing 85 mole % of silver bromide), 3.5 mg/100 cm $^2$ in terms of silver; dibutylphthalate, 6.0 mg/100 cm $^2$; and gelatin, 15.0 mbg/100 cm $^2$.

Second layer: Intermediate layer (a layer containing an ultraviolet absorbent)

Applied were 2-(2-hydroxy-3-sec-butyl-5-tert-butylphenyl)benzotriazole as an ultraviolet absorbent to have a coating amount of 3.0 mg/100 cm $^2$; dibutylphthalate, 3.0 mg/100 cm $^2$; and gelatin, 12.0 mg/100 cm $^2$.

Third layer: Protective layer

Applied was gelatin to have a coating amount of 8.0 mg/100 cm $^2$.

The sample obtained in the above manner was designated as Sample 1.

To the above Sample 1, Examplary Compounds A-2, A-7, CH-35, CH-38, HI-25, HI-28 of the present invention, and Comparative Compounds (a) and (b) were each added as a magenta dye image stabilizing agent in an amount equimolar to magenta coupler to obtain Samples 2, 3, 4, 5, 6, 7 ,8 and 9.

Also, the above 8 kinds of the magenta dye image stabilizing agents were used in combination with 2 kinds for each sample in the manner as shown in Table 1 to obtain Samples 10 to 29.

In Samples 10 to 29, the two magenta dye image stabilizing agents used in combination were each used in the proportion of 1 : 1 in molar ratio, and used in an equimolar amount to magenta coupler as a total amount.

Comparative Compound (a):
(Compound disclosed in Japanese Patent O.P.I. Publication No. 43538/1979)

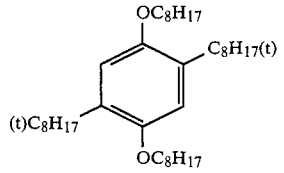

Comparative Compound (b):
(Compound disclosed in Japanese Patent O.P.I. Publication No. 159644/1981)

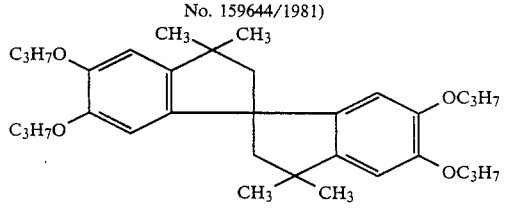

Samples obtained in the above were exposed according to a conventional manner and through an optical wedge, and thereafter processed according to the following steps:

| [Processing steps] | Processing temp. | Processing time |
|---|---|---|
| Color developing | 33° C. | 3 min. 30 sec. |
| Bleach-fixing | 33° C. | 1 min. 30 sec. |
| Washing with water | 33° C. | 3 min. |
| Drying | 50 to 80° C. | 2 min. |

Processing solutions each had the following composition:

[Color developing solution]

Benzyl alcohol: 12 ml
Diethylene glycol: 10 ml
Potassium carbonate: 25 g
Sodium bromide: 0.6 g
Anhydrous sodium sulfite: 2.0 g
Hydroxylamine sulfate: 2.5 g
N-ethyl-N-$\beta$-ethyl methanesulfonamide-3-methyl-4-aminoaniline sulfate: 4.5 g
Made up to 1 liter by adding water, and adjusted to pH 10.2 with use of sodium hydroxide.

[Bleach-fixing solution]

Ammonium thiosulfate: 120 g
Sodium metahydrogen sulfite: 15 g
Anhydrous sodium sulfite: 3 g
EDTA ferric ammonium salt: 65 g
Made up to 1 liter by adding water, and the pH was adjusted to 6.7 to 6.8.

On each of Samples 1 to 29 processed in the above, density was measured under the following conditions with use of a densitometer (KD-7R Type; produced by Konishiroku Photo Industry Co., LtD.)

The samples having processed as above were subjected to irradiation by used of a xenon fade meter for 12 days to examine the light-resistance of dye images. Evaluations on the light-resistance of dye images were made on the following items.

[Retention]

Percentage of retention of dyes after light-resistance and moisture resistance tests at the initial density of 1.0

[Degree of color change]

A value obtained by subtracting (Yellow density)/-Magenta density) gained before the light-resistance test from (Yellow density)/Magenta density) gained after the light-resistance test. Here is meant that the larger this value is, the more liable it is for the color tone to be changed form magenta to yellowish one.

Results obtained are shown in Table 1.

TABLE 1

| Sample No. | Magenta coupler | Dye image stabilizing agent | Light-resistance Retention (%) | Light-resistance Color change degree |
|---|---|---|---|---|
| 1(X) | 44 | — | 17 | 0.82 |
| 2(X) | " | A-2 | 52 | 0.13 |
| 3(X) | " | A-7 | 53 | 0.16 |
| 4(X) | " | CH-35 | 53 | 0.17 |
| 5(X) | " | CH-38 | 52 | 0.15 |
| 6(X) | " | HI-25 | 60 | 0.16 |
| 7(X) | " | HI-28 | 59 | 0.17 |
| 8(X) | " | Comparative (a) | 44 | 0.70 |
| 9(X) | " | Comparative (b) | 49 | 0.70 |
| 10(X) | " | A-2 + Comparative (a) | 58 | 0.20 |
| 11(X) | " | A-7 + Comparative (a) | 57 | 0.20 |
| 12(X) | " | CH-35 + Comparative (a) | 60 | 0.22 |
| 13(X) | " | CH-38 + Comparative (a) | 61 | 0.22 |
| 14(X) | " | HI-25 + Comparative (a) | 60 | 0.20 |
| 15(X) | " | HI-28 + Comparative (a) | 63 | 0.21 |
| 16(X) | " | A-2 + Comparative (b) | 60 | 0.20 |
| 17(X) | " | A-7 + Comparative (b) | 60 | 0.21 |
| 18(X) | " | CH-35 + Comparative (b) | 60 | 0.22 |
| 19(X) | " | CH-38 + Comparative (b) | 62 | 0.24 |
| 20(X) | " | HI-25 + Comparative (b) | 62 | 0.23 |
| 21(X) | " | HI-28 + Comparative (b) | 63 | 0.22 |
| 22(Y) | " | A-2 + CH-35 | 73 | 0.10 |
| 23(Y) | " | A-2 + CH-38 | 72 | 0.11 |
| 24(Y) | " | A-2 + HI-25 | 73 | 0.11 |
| 25(Y) | " | A-2 + HI-28 | 71 | 0.11 |
| 26(Y) | " | A-7 + CH-35 | 71 | 0.10 |
| 27(Y) | " | A-7 + CH-38 | 74 | 0.11 |
| 28(Y) | " | A-7 + HI-25 | 72 | 0.12 |
| 29(Y) | " | A-7 + HI-28 | 72 | 0.10 |

X: Comparative sample
Y: Present invention

As will be seen from the results shown in Table 1, in the samples (Samples 10, 11, 16, and 17) where the morpholine type magenta dye image stabilizing agent of the present invention and the conventional magenta dye stabilizing agent are used in combination with the magenta coupler of the present invention, and in the samples (Samples 12, 13, 18 and 19) where the chroman type magenta dye image stabilizing agent of the present invention and the conventional magenta dye stabilizing agent are used in combination with the magenta coupler of the present invention, and also in the samples (Samples 14, 15, 20 and 21) where the hydroxyindane type magenta dye image stabilizing agent of the present invention and the conventional magenta dye image stabilizing agent are used in combination with the magenta coupler of the present invention, it is true that the dye image retention in the light-resistance test has been improved as compared with the samples (Samples 2 to 9) produced by adding each the magenta dye image stabilizing agent solely to the magenta coupler of the present invention, but the degree of color change is somewhat larger.

On the other hand, it is seen that, in the samples (Samples 22 to 29) where the morpholine type magenta dye image stabilizing agent of the present invention and the chroman type or hydroxyindane type magenta dye image stabilizing agent of the present invention are used in combination with the magenta coupler of the present invention, the dye image retention in the light-resistance test has been improved to such an extent that can not be expected from the samples (Samples 2 to 7) produced by adding each the magenta dye image stabilizing agent of the present invention solely to the magenta coupler of the present invention, and, moreover, the degree of color change of dye images in the light-resistance test is very small.

As in the above, it is seen that the retention and color change degree of dye images in the light-resistance test are greatly improved in the samples produced by using the two kinds of the magenta dye image stabilizing agents of the present invention in combination with the coupler of the present invention than in the samples produced by using one kind of the magenta dye image stabilizing agent of the present invention and the conventional magenta dye image stabilizing agent in combination with the coupler of the present invention.

EXAMPLE 2

Using the combination of the coupler with the magenta dye image stabilizing agent as shown in Table 2, Samples 30 to 58 were produced in the quite same manner as in Example 1.

Samples 30 to 58 were processed according to the procedures described in Example 1. On these samples, the light-resistance test was carried out in the same manner as in Example 1 to obtain the results as shown in Table 2.

The total amount of the dye image stabilizing agents added in the respective samples is in an equimolar amount in both the cases of sole use and combined use. In the case of the combined use, the ratio of the amount of the respective dye image stabilizing agents were made equal to each other.

TABLE 2

| Sample No. | Magenta coupler | Dye image stabilizing agent | Dye retention (%) |
|---|---|---|---|
| 30(X) | 5 | A-9 | 40 |
| 31(X) | 5 | CH-25 | 43 |
| 32(X) | 5 | HI-37 | 47 |
| 33(Y) | 5 | A-9 + CH-25 | 64 |
| 34(Y) | 5 | A-9 + HI-37 | 66 |
| 35(Y) | 5 | A-9 + CH-25 + HI-37 | 68 |
| 36(X) | 54 | A-9 | 42 |
| 37(X) | 54 | CH-25 | 50 |
| 38(X) | 54 | HI-37 | 52 |
| 39(Y) | 54 | A-9 + CH-25 | 69 |
| 40(Y) | 54 | A-9 + HI-37 | 70 |
| 41(Y) | 54 | A-9 + CH-25 + HI-37 | 73 |
| 42(X) | 130 | A-9 | 50 |
| 43(X) | 130 | CH-25 | 51 |
| 44(X) | 130 | HI-37 | 55 |
| 45(Y) | 130 | A-9 + CH-25 | 73 |
| 46(Y) | 130 | A-9 + HI-37 | 72 |
| 47(Y) | 130 | A-9 + CH-25 + HI-37 | 76 |
| 48(Y) | 54 | A-2 + CH-6 | 67 |
| 49(Y) | 54 | A-2 + HI-3 | 69 |
| 50(Y) | 54 | A-13 + CH-6 | 69 |
| 51(Y) | 54 | A-13 + HI-3 | 67 |
| 52(Y) | 54 | A-17 + CH-6 | 68 |
| 53(Y) | 54 | A-17 + HI-3 | 69 |
| 54(Y) | 54 | A-18 + CH-27 | 69 |
| 55(Y) | 54 | A-19 + CH-36 | 68 |
| 56(Y) | 54 | A-20 + CH-47 | 69 |
| 57(Y) | 54 | A-22 + HI-12 | 70 |

TABLE 2-continued

| Sample No. | Magenta coupler | Dye image stabilizing agent | Dye retention (%) |
|---|---|---|---|
| 58(Y) | 54 | A-24 + HI-44 | 70 |

X: Comparative sample
Y: Present invention

It is seen from the results shown in Table 2 that the samples produced by using the two or three kinds of the magenta dye image stabilizing agent of the present invention in combination with the magenta coupler of the present invention show remarkably more improved light-resistance than the samples produced by using the magenta dye image stabilizing agent of the present invention solely in combination with the magenta coupler of the present invention.

EXAMPLE 3

A paper support laminated on both sides thereof with polyethylene was provided by coating with the following respective layers in the manner consecutive form the support side to produce a light-sensitive silver halide photographic material for multicolor photography, thereby obtaining Sample 59.

First layer: Blue-sensitive silver halide emulsion layer

Applied were α-pivaloyl-α-(2,4-dioxo-1-benzylimidazolidin-3-yl)-2-chloro-5-[γ-(2,4-di-t-amylphenoxy)butylamide]acetanilide as a yellow coupler to have a coating amount of 6.8 mg/100 cm $^2$; blue-sensitive silver chlorobromide (containing 85 mole % of silver bromide), 3.2 mg/100 cm $^2$ in terms of silver; dibutylphthalate, 3.5 mg/100 cm $^2$; and gelatin; 13.5 mg/100 cm $^2$.

Second layer: Intermediate layer

Applied were 2,5-di-ti-octylhydroquinone so as to be in amount of 0.5 mg/100 cm $^2$; dibutylphthalate, 0.5 mg/100 cm $^2$; and gelatin, 9.0 mg/100 cm $^2$.

Third layer: Green-sensitive silver halide emulsion layer

Applied were the aforesaid magenta coupler 31 so as to be in amount of 4.5 mg/100 cm $^2$; green-sensitive silver chlorobromide (containing 80 mole % of silver bromide), 2.0 mg/100 cm $^2$ in terms of silver; dibutylphthalate, 3.0 mg/100 cm $^2$; and gelatin, 12.0 mg/100 cm $^2$.

Fourth layer: Intermediate layer

Applied were 2-(2-hydroxy-3-sec-butyl-5-t-butylphenyl)benzotriazole as an ultraviolet absorbent so as to be in amount of 5.0 mg/100 cm $^2$; dibutylphthalate, 4.0 mg/100 cm $^2$; 2,5-di-t-octylhydroquinone, 0.5 mg/100 cm $^2$; and gelatin, 12.0 mg/100 cm $^2$.

Fifth layer: Red-sensitive silver halide emulsion layer

Applied were 2-[α-(2,4-di-t-pentylphenoxy)butanamide]-4,6-dichloro-5-ethylphenol as a cyan coupler so as to be in amount of 4.2 mg/100 cm $^2$; red-sensitive silver chlorobromide (containing 80 mole % of silver bromide), 3.0 mg/100 cm $^2$ in terms of silver; tricresyl phosphate, 3.5 mg/100 cm $^2$; and gelatin, 11.5 mg/100 cm $^2$.

Sixth layer: Intermediate layer

A layer constituted with the same composition as the fourth layer.

Seventh layer: Protective layer

Applied was gelatin so as to be in amount of 8.0 mg/100 cm $^2$.

In the above Sample 59, the dye image stabilizing agents of the present invention were added to the third layer in such a proportion as shown in Table 3 to produce multi-layered samples, Samples 60 to 77, which were exposed and processed in the same manner as in Example 1 , and thereafter the light-resistance tests (irradiated by a xenon fade meter for 14 days) were carried out. Results obtained are shown together in Table 3.

TABLE 3

| Sample No. | Dye image stabilizing agent | Amount mole %/coupler | Retention (%) |
|---|---|---|---|
| 59(X) | — | — | 12 |
| 60(X) | A-8 | 100 | 47 |
| 61(X) | A-8 | 150 | 55 |
| 62(X) | CH-35 | 100 | 47 |
| 63(X) | CH-35 | 150 | 54 |
| 64(X) | HI-28 | 100 | 50 |
| 65(X) | HI-28 | 150 | 56 |
| 66(Y) | A-8 + CH-35 | 75 + 25 | 63 |
| 67(Y) | A-8 + CH-35 | 50 + 50 | 70 |
| 68(Y) | A-8 + CH-35 | 25 + 75 | 66 |
| 69(Y) | A-8 + CH-35 | 100 + 50 | 67 |
| 70(Y) | A-8 + CH-35 | 75 + 75 | 73 |
| 71(Y) | A-8 + CH-35 | 50 + 100 | 68 |
| 72(Y) | A-8 + HI-28 | 75 + 25 | 64 |
| 73(Y) | A-8 + HI-28 | 50 + 50 | 72 |
| 74(Y) | A-8 + HI-28 | 25 + 75 | 68 |
| 75(Y) | A-8 + HI-28 | 100 + 50 | 69 |
| 76(Y) | A-8 + HI-28 | 75 + 75 | 75 |
| 77(Y) | A-8 + HI-28 | 50 + 100 | 70 |

X: Comparative sample
Y: Present invention

It is seen from the results shown in Table 3 that, when the total amount of the magenta dye image stabilizing agent of the present invention is made constant, the light-resistance of the magenta dye images can be more greatly improved in the case where the magenta dye image stabilizing agents of the present invention are used in combination in a suitable protection than in the case where the magenta dye image stabilizing agent of the present invention is used alone.

The samples according to the present invention were also found to have excellent color reproducibility and suffer less generation of Y-stain.

What is claimed is:

1. A light-sensitive silver halide photographic material comprising a magenta dye-forming coupler represented by formula I:

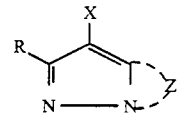

I wherein Z represents a group of non-metal atoms necessary to complete a nitrogen-containing heterocyclic ring; X represents a hydrogen atom or a substituent capable of being split off upon reaction with an oxidation product of a color developing agent and R represents a hydrogen atom or a substituent;

at least one compound represented by formula XII:

XII

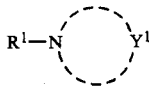

wherein, $R^1$ is selected from a group consisting of an aliphatic group, a cycloalkyl group, an aryl group and a heterocyclic group and $Y^1$ represents a group of non-metal atoms necessary to complete a morpholine ring or a thiomorpholine ring together with the nitrogen atom in formula XII; and at least one compound selected from a group consisting of compounds represented by formulas and XIIIa and XIIIb;

XIIIa

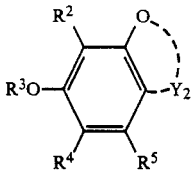

wherein, $R^2$ and $R^5$ are independently selected form a group consisting of hydrogen, a halogen, an alkyl group, an alkenyl group, an alkoxy group, an alkenyloxy group, a hydroxyl group, an aryl group, an aryloxy group, an acyl group, an acylamino group, an acyloxy group, a sulfonamide group, a cycloalkyl group and an alkoxycarbonyl group, $R^3$ is selected from a group consisting of hydrogen, an alkyl group, an alkenyl group, an aryl group, an acyl group, a cycloalkyl group and a heterocyclic group, $R^4$ is selected from a group consisting of hydrogen, a halogen, an alkyl group, an alkenyl group, an aryl group, an aryloxy group, an acyl group, an acylamino group, an acyloxy group, a sulfonamide group, a cycloalkyl group and an alkoxycarbonyl group, provided that $R^3$ and $R^4$ may be combined with each other to form a 5- or 6-membered ring or a methylenedioxy ring, and $Y^2$ represents a group of atoms necessary to complete a chroman or a coumaran XIIIb

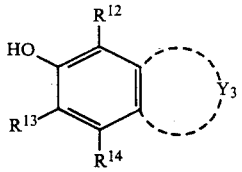

wherein, $R^{12}$ and $R^{14}$ are independently selected from a group consisting of hydrogen, a halogen, an alkyl group, an alkenyl group, an alkoxy group, a hydroxyl group, an aryl group, an aryloxy group, an acyl group, an acylamino group, an acyloxy group, a sulfonamide group, a cycloalkyl group and an alkoxycarbonyl group, $R^{13}$ is selected from a group consisting of hydrogen, a halogen, an alkyl group, an alkenyl group, a hydroxyl group, an aryl group, an acyl group, an acylamino group, an acyloxy group, a sulfonamide group, a cycloalkyl group and an alkoxycarbonyl group, provided that $R^{13}$ and $R^{14}$ may be combined with each other to form a 5- or 6-membered ring, and $Y^3$ represents a group of atoms necessary to complete an indane ring.

2. The light-sensitive silver halide photographic material of claim 1, wherein R is selected from the group consisting of a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

3. The light-sensitive silver halide photographic material of claim 1, wherein X is selected from the group consisting of a halogen atom and an organic group having a carbon atom, an oxygen atom, a sulfur atom, a nitrogen atom or phosphorus atom through which said organic group is connected with the remainder of the compound.

4. The light-sensitive silver halide photographic material of claim 1, wherein X is selected from the group consisting of a halogen atom, an alkoxy group, an aryloxy group, a heterocyclic oxy group, an acyloxy group, a sulfonyloxy group, an alkoxycarbonyloxy group, an aryloxycarbonyloxy group, an alkyloxalyloxy group, an alkoxyoxalyloxy group, an alkylthio group, an arylthio group, a heterocyclicthio group, an alkyloxythiocarbonylthio group, a group represented by the formula

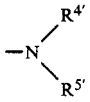

(wherein $R^{4'}$ and $R^{5'}$ independently represent a hydrogen atom, an alkyl group, an aryl group, a heterocyclic group, a sulfamoyl group, a carbamoyl group, an acyl group, a sulfonyl group, an aryloxycarbonyl group and an alkoxycarbonyl group, provided that $R^{4'}$ and $R^{5'}$ are not simultaneously hydrogen atoms and $R^{4'}$ and $R^{5'}$ may combine with each other to form a nitrogen-containing heterocyclic group), a carboxyl group, a hydroxymethyl group, a triphenylmethyl group and a group represented by the following formula:

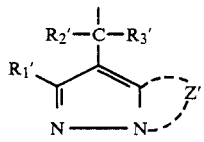

(wherein $R^{1'}$ is defined to be the same as R, $Z'$ is the same as defined for Z, and $R^{2'}$ and $R^{3'}$ are independently selected form the group consisting of a hydrogen atom, an aryl group, an alkyl group and a heterocyclic group).

5. The light-sensitive silver halide photographic material of claim 1, wherein said nitrogen-containing heterocyclic ring in formula is selected from the group consisting of a pyrazole ring, an imidazole ring, a triazole ring and a tetrazole ring provided that the above groups may have a substituent as defined as R in formula.

6. The light-sensitive silver halide photographic material of claim 1, wherein said magenta dye-forming coupler is incorporated at an amount of $1 \times 10^{-3}$ to 1 mol per 1 mol of silver halide.

7. The light-sensitive silver halide photographic material of claim 6, wherein said magenta dye-forming coupler is incorporated at an amount of $1 \times 10^{-2}$ to $8 \times 10^{-1}$ mol per 1 mol of silver halide.

8. The light-sensitive silver halide photographic material of claim 1, wherein $R^1$ is selected from a group consisting of an alkyl group, an alkenyl group and an alkynyl group, provided that the respective groups may be substituted.

9. The light-sensitive silver halide photographic material of claim 1, wherein X represents a hydrogen atom or a substituent capable of being split off upon reaction with an oxidation product of a primary amine color developing agent.

10. The light-sensitive silver halide photographic material of claim 9, wherein X represents a hydrogen atom or a substituent capable of being split off upon reaction with an oxidation product of a color developing agent selected from the group consisting of an aminophenol derivative and a p-phenylene diamine derivative and a salt thereof.

11. The light-sensitive silver halide photographic material of claim 1, wherein said compounds represented by the formulas and and/or XII and XIIIa and/or XIIIb are incorporated in said material in an amount ranging from 5 to 400 mole % based on said magenta dye-forming coupler.

12. The light-sensitive silver halide photographic material of claim 11, wherein said compounds represented by the formulas and and/or XII and XIIIa and/or XIIIb are incorporated in said material in an amount ranging from 10 to 250 mole % based on the magenta dye-forming coupler.

* * * * *

UNITED STATES PATENT AND TRADEMARK OFFICE

CERTIFICATE OF CORRECTION

PATENT NO. : 4,973,546

DATED : November 27, 1990

INVENTOR(S) : Yutaka Kaneko, et al

It is certified that error appears in the above-identified patent and that said Letters Patent is hereby corrected as shown below:

Column 117, line 26, "form" should be --from--;

Claim 1, Column 117, Line 45, "coumaran" should be followed by --ring--;

Claim 5, Column 118, Line 68, "formula" should be followed by -- [I] --;

Claim 5, Column 119, Lined 3-4, "formula" should be followed by -- [I]; and

Signed and Sealed this

Nineteenth Day of January, 1993

*Attest:*

*Attesting Officer*

DOUGLAS B. COMER

*Acting Commissioner of Patents and Trademarks*